US006959227B2

(12) United States Patent
Okada et al.

(10) Patent No.: US 6,959,227 B2
(45) Date of Patent: Oct. 25, 2005

(54) LENS LAYOUT SETTING APPARATUS FOR LENS GRINDING PROCESS AND DISPLAY APPARATUS FOR THE SAME

(75) Inventors: Hiroyuki Okada, Tokyo (JP); Mitsuo Ishii, Tokyo (JP); Jun Onose, Tokyo (JP); Takahiro Watanabe, Tokyo (JP); Toshihiro Iwai, Tokyo (JP); Akihiro Harada, Tokyo (JP); Yasuko Tsuruga, Tokyo (JP)

(73) Assignee: Kabushiki Kaisha Topcon, Tokyo (JP)

( * ) Notice: Subject to any disclaimer, the term of this patent is extended or adjusted under 35 U.S.C. 154(b) by 0 days.

(21) Appl. No.: 10/761,737

(22) Filed: Jan. 21, 2004

(65) Prior Publication Data

US 2004/0153198 A1 Aug. 5, 2004

Related U.S. Application Data

(62) Division of application No. 09/941,483, filed on Aug. 29, 2001, now Pat. No. 6,751,522.

(30) Foreign Application Priority Data

| | | |
|---|---|---|
| Aug. 30, 2000 | (JP) | 2000-260363 |
| Sep. 21, 2000 | (JP) | 2000-287040 |
| Sep. 25, 2000 | (JP) | 2000-290864 |
| Jul. 19, 2001 | (JP) | 2001-220321 |

(51) Int. Cl.[7] ..... G06F 19/00
(52) U.S. Cl. ..... 700/164; 700/95; 700/100
(58) Field of Search ..... 700/95, 100, 164, 700/15, 17; 345/22, 702, 703, 711, 735, 763, 764, 747, 964, 967; 706/11

(56) References Cited

U.S. PATENT DOCUMENTS

| | | | | | |
|---|---|---|---|---|---|
| 5,148,637 | A | * | 9/1992 | Byron | 451/5 |
| 5,664,129 | A | * | 9/1997 | Futatsugi et al. | 345/763 |
| 5,734,465 | A | * | 3/1998 | Kajino | 356/124 |
| 5,815,150 | A | * | 9/1998 | Shimizu | 345/764 |
| 6,059,635 | A | * | 5/2000 | Mizuno | 451/5 |
| 6,170,321 | B1 | * | 1/2001 | Suzuki et al. | 73/104 |
| 6,225,979 | B1 | * | 5/2001 | Taima et al. | 345/157 |
| 6,328,628 | B1 | * | 12/2001 | Mizuno et al. | 451/5 |
| 6,414,697 | B1 | * | 7/2002 | Amro et al. | 345/772 |
| 6,588,898 | B2 | * | 7/2003 | Iwai et al. | 351/159 |
| 6,751,522 | B2 | * | 6/2004 | Okada et al. | 700/164 |

* cited by examiner

*Primary Examiner*—Paul L. Rodriguez
*Assistant Examiner*—Carlos Ortiz Rodriguez
(74) *Attorney, Agent, or Firm*—Chapman and Cutler LLP

(57) ABSTRACT

A lens layout setting apparatus for lens grinding processing apparatus having a display screen of a display device for various settings for processing data of eyeglass lens shape for an eyeglass frame, and data of lens grinding process to grind the lens based on the data of lens shape for the frame, further including a control means to add, delete or rearrange a setting condition. The display device displays data of eyeglass lens shape for an eyeglass frame, and of eyeglass lens grinding process required for grinding the lens based on the data, and further displays tabs arranged to display a layout operating screen to set a layout of the data of lens shape for the frame, a state of measuring an edge thickness of the lens, simulation of the shape of a V-shaped protrusion formed on an edge of the lens, and a grinding process screen.

8 Claims, 68 Drawing Sheets

Fig. 11

| F- key | F 1 | F 2 | F 3 | F 4 | F 5 | F 6 |
|---|---|---|---|---|---|---|
| Kind | Lens type | Course | Lens | Frame | Chamfering | Mirror surface |
| Item | Single vision | Automated | Plastic | Metal | None | None |
| | Ophthalmological prescription | Try | High index | Celluloid | Small | Applicable |
| | Progressive | Monitor | Glass | Optil | Middle | Mirror surface at chamfering portion |
| | Bifocal | Frame change | Polycarbonate | Flat | Special | |
| | Lenticular | | Acrylic | Grooving (thin) | | |
| | Tsubokuri | | | Grooving (middle) | | |
| | | | | Grooving (thick) | | |

Fig. 31

| Lens type | Input format |
|---|---|
| Single vision | |

| | Right | Left |
|---|---|---|
| FPD | 70. 0 | |
| PD | 64. 0 | |
| UP | +2. 0 | |
| Size | +0. 05 | |

| Ophthalmological prescription Lenticular Tsubokuri | |
|---|---|

| | Right | Left |
|---|---|---|
| FPD | 70. 0 | |
| HPD | 32. 0 | 32. 0 |
| UP | +2. 0 | +2. 0 |
| Size | +0. 05 | |

| Progressive Bifocal | |
|---|---|

| | Right | Left |
|---|---|---|
| FPD | 70. 0 | |
| HPD | 32. 0 | 32. 0 |
| HIp | 23. 5 | 23. 5 |
| Size | +0. 05 | |

Fig. 32

| Initial setting items | Setting values | |
|---|---|---|
| Frame input method | FPD/DEL | |
| Pattern input method | FPD/DEL | |
| Height at center | Hlp/Hld | |
| Selection of adsorbing mode | Select / Not select | |

| | Right | Left |
|---|---|---|
| FPD | 70.0 | |
| PD | 64.0 | |
| UP | +2.0 | |
| Size | +0.05 | |
| Center of adsorbing | Optical axis | |

Fig. 33

| [Frame] selection | [chamfering] selection | Input format |
|---|---|---|
| Metal<br>Celluloid<br>Optil<br>Flat | None<br>Small<br>Middle | Size: +0.05 |
| | Special | Size: +0.05<br>Width of chamfering: 0.3 |
| Grooving (thin)<br>Grooving (middle)<br>Grooving (thick) | None<br>Small<br>Middle | Size: +0.05<br>Width of groove: 0.8<br>Depth of groove: 0.5 |
| | Special | Size: +0.05<br>Width of groove: 0.8<br>Depth of groove: 0.5<br>Width of chamfering: 0.3 |

LENS LAYOUT SETTING APPARATUS FOR LENS GRINDING PROCESS AND DISPLAY APPARATUS FOR THE SAME

This application is a DIV of U.S. application Ser. No. 09/941,483, filed Aug. 29, 2001, now U.S. Pat. No. 6,751, 552.

BACKGROUND OF THE INVENTION

1. Field of the Invention

The present invention relates to a lens layout setting apparatus for lens grinding process and display apparatus for the same to display a disposition of optical axis of a lens in a eyeglass lens shape and a layout of the shape of a cross section of the lens when processing data for the eye glass lens are calculated based on data of eyeglass lens shape (data of lens shape) for a eyeglass frame, or when a lens to be processed (unmachined lens) is ground into an eyeglass lens shape based on the data of eyeglass lens shape.

2. Description of the Prior Art

As a lens layout display apparatus for lens grinding process, for example, there has been known an apparatus disclosed in Japanese Utility Laid Open patent Hei 5-39855.

This lens layout display apparatus comprises an input menu area to display data for grinding as a plurality of input menu, a switching block having a plurality of selection switches arranged in accordance with the input menu to select the lens grinding data, and a page changeover switch.

As for a data input screen of the lens layout display apparatus, a flat display device such as a liquid crystal display is employed. When a set of lens grinding data has been input through the input menu and the switching portion of this kind of lens layout display apparatus, prescribed lens grinding data is output from the lens layout display apparatus. The lens grinding data which has been output is fed to a lens grinding mechanism of a lens grinding apparatus through an interface, then a lens grinding process is performed by the lens grinding apparatus.

In the lens layout display apparatus of a lens grinding apparatus having the aforementioned configuration, a routine for lens grinding process is not started unless input of the lens grinding data is completed. Accordingly, while an edge shape or edge thickness of an eyeglass is being measured, it is impossible to display another eyeglass lens shape data for an eyeglass frame required for lens grinding process for other lens or to perform adjustment of layout. As a result, in the above described prior lens grinding apparatus, it is impossible to improve the efficiency of lens grinding process for eyeglass lens or to perform data processing in user friendly manner.

Moreover, in the conventional lens layout display apparatus of the lens grinding apparatus, an operator cannot change a displaying order of specified items according as his preference, or to add/delete or to exchange an item itself.

This requires a complicated work procedure and a long time from a data input to a data setting, disabling smooth operation.

Moreover, in the conventional lens layout display apparatus of the lens grinding apparatus, since the data input format for lens grinding process is determined beforehand, it is troublesome and time-taking time to input data according to a kind of lenses such as a single vision lens and a progressive-multi-focus lens.

In addition to it, it is preferable that position for a V-shaped protrusion at the lens edge surface can be easily accomplished even in case of different kind of eyeglass lenses. However, there has been no methods suitable for data input of V-shaped protrusion at edge surface processing or method suitable for data calculation of V-shaped protrusion at edge surface processing. In this situation, conventionally, an operator should repeat simulation of V-shaped protrusion so as to suitably settle the position of V-shaped protrusion at the edge surface and adjust the data for processing the V-shaped protrusion. This procedure of settlement and adjustment is troublesome and time-taking.

To solve the above described problems, it is preferable to improve the processing efficiency of lens grinding process by improving display used for setting adjustment, thereby enabling to realize a format free data processing.

SUMMARY OF THE INVENTION

It is therefore an object of the present invention to provide a lens layout setting apparatus for the lens grinding apparatus and a display apparatus for it in which the processing efficiency of lens grinding process is improved by means of an improvement of display used for setting adjustment, thereby realizing format free data processing. To attain this purpose the lens layout setting apparatus for the lens grinding apparatus is configured as below.

The lens layout setting apparatus for lens grinding processing apparatus according to the present invention comprises function setting means on which is achieved various settings required to calculate data of eyeglass lens shape for an eyeglass frame, and to calculate data of eyeglass lens grinding process to grind the eyeglass lens based on the data of eyeglass lens shape for an eyeglass frame, wherein said layout setting apparatus further comprises control means to add, to delete or to sort a setting item of said function setting means, is provided.

According to another aspect of the present invention, the lens layout setting apparatus for lens grinding processing apparatus comprising function setting means on which is achieved at display screen various setting required to calculate data of eyeglass lens shape for an eyeglass frame, and to calculate data of eyeglass lens grinding process to grind the eyeglass lens based on the data of eyeglass lens shape for an eyeglass frame, wherein said layout setting apparatus further comprises control means to control so as to set the selected condition after a predetermined time interval when a indicator (cursor) has been put on an item to be selected which is displayed on said display screen corresponding to the setting item of said function setting means, is provided.

According to still another aspect of the present invention, the lens layout display apparatus for lens grinding processing apparatus comprising display means on which is displayed data of eyeglass lens shape for an eyeglass frame, and data of eyeglass lens grinding process which is required to grind the eyeglass lens based on the data of eyeglass lens shape for an eyeglass frame, wherein said display means displays a tab which is arranged to display a layout operating screen to set a layout of the data of eyeglass lens shape for an eyeglass frame, and a tub which is arranged to display a state of measuring an edge thickness of the eyeglass lens, to display a simulation of the shape of a V-shaped protrusion formed on an edge of the eyeglass lens, and to display a grinding process screen such as a state of the processing of an eyeglass lens, is provided.

According to yet another aspect of the present invention, the lens layout display apparatus for lens grinding processing apparatus comprising display means on which is displayed data of eyeglass lens shape for an eyeglass frame, and data of eyeglass lens grinding process which is required to grind the eyeglass lens based on the data of eyeglass lens shape for an eyeglass frame, wherein said display means displays an icon which shows a state of measuring an edge thickness of the eyeglass lens based on the data of eyeglass lens shape for an eyeglass frame, an icon which shows a state of simulation of the shape of a V-shaped protrusion formed on an edge of the eyeglass lens, an icon which shows a state processing the edge portion of the eyeglass lens, and an icon which shows a completion of the grinding process of the eyeglass lens, is provided.

According to yet still another aspect of the present invention, the lens layout display apparatus for lens grinding processing apparatus according to claim 4, wherein said icon which shows a state processing the edge portion of the eyeglass lens, is composed of any combination of the icons which shows a state processing the edge portion of the eyeglass lens as a rough processing, which shows a state processing the edge portion of the eyeglass lens as a finishing, which shows a state processing the edge portion of the eyeglass lens as a mirror finishing, which shows a state processing grooving on the edge portion of the eyeglass lens, and which shows a state processing chamfering on the edge portion of the eyeglass lens, is provided.

Further, in this lens layout display apparatus for lens grinding processing apparatus comprises display means on which is displayed data of eyeglass lens shape for an eyeglass frame, and data of eyeglass lens grinding process which is required to grind the eyeglass lens based on the data of eyeglass lens shape for an eyeglass frame, wherein said display means has a level display means which displays a level corresponding to a state of the progress of the grinding processing of a lens composed from a step measuring an edge thickness of the eyeglass lens based on the data of eyeglass lens shape for an eyeglass frame, to a step on which the grinding process of the eyeglass lens has been completed, can be composed.

In this configuration, the level display means is composed of a plurality of swhich is lit and displays corresponding to step like state of the progress of the grinding processing of a lens composed from the step measuring the edge thickness of the eyeglass lens to the step on which the grinding process of the eyeglass lens has been completed, can be composed.

Further, in accordance with a seventh aspect of the present invention, a layout display apparatus for lens grinding processing apparatus comprising display means on which is displayed data of eyeglass lens shape for an eyeglass frame, and data of eyeglass lens grinding process which is required to grind the eyeglass lens based on the data of eyeglass lens shape for an eyeglass frame, wherein said display means has an icon which shows a state of measuring an edge thickness of the eyeglass lens based on the data of eyeglass lens shape for an eyeglass frame, an icon which shows a state of simulation of the shape of a V-shaped protrusion formed on an edge of the eyeglass lens, an icon which shows a state processing the edge portion of the eyeglass lens, and an icon which shows a completion of the grinding process of the eyeglass lens with adjoining together, and at the same time said display means has a plurality of indicators which is lit and displays corresponding to a continuous state of the progress of the grinding processing of a lens, is provided.

Further, in this seventh aspect of the present invention, a layout display apparatus for lens grinding processing apparatus according to claim 8, wherein said icon which shows a state processing the edge portion of the eyeglass lens, is composed of any combination of the icons which shows a state processing the edge portion of the eyeglass lens as a rough processing, which shows a state processing the edge portion of the eyeglass lens as a finishing, which shows a state processing the edge portion of the eyeglass lens as a mirror finishing, which shows a state processing of grooving on the edge portion of the eyeglass lens, and which shows a state processing chamfering on the edge portion of the eyeglass lens, can be composed.

BRIEF DESCRIPTION OF THE DRAWINGS

FIG. 11 is a table showing all items of processing mode.

FIG. 31 is an explanatory table showing display items in accordance with the kind of lenses.

FIG. 32 is an explanatory table showing an example of numerical values as display items in a default mode.

FIG. 33 is an explanatory table showing an example of numerical values used for selecting an eyeglass frame.

DETAILED DESCRIPTION OF THE PREFERRED EMBODIMENT

Hereinafter the preferred embodiment of the present invention will be described with reference to the drawings.

[Composition]

Figure 1:
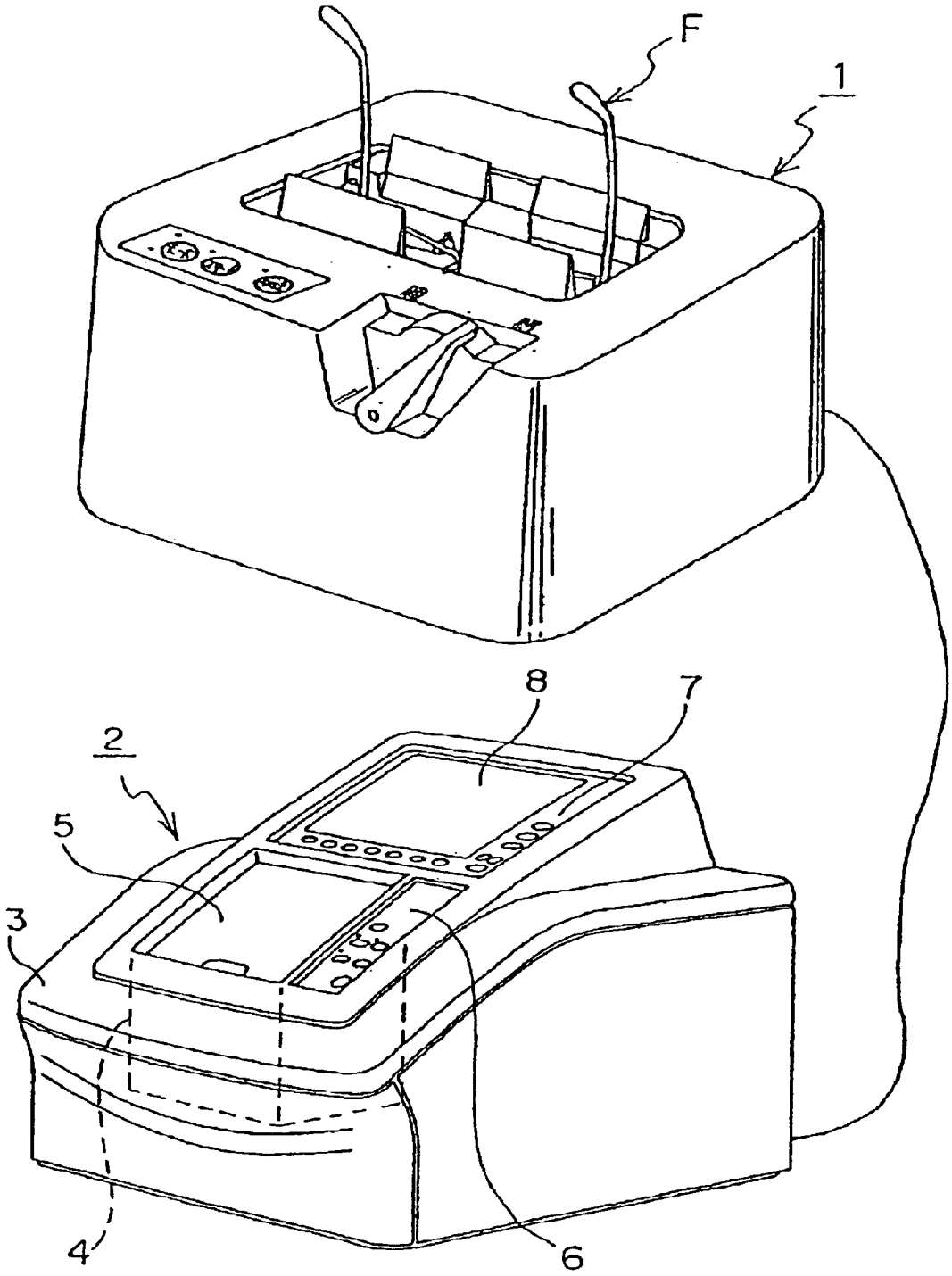
FIG. 1 is a perspective view showing a relationship between an eyeglass frame shape measuring apparatus and a lens grinding apparatus having a layout setting apparatus and its display apparatus according to an embodiment of the present invention.

In FIG. 1 a reference numeral 1 designates an eyeglass frame shape measuring apparatus (lens shape data measuring apparatus) as the lens shape data by which a lens shape information (θi, ρi) is read based on a lens frame shape of the eyeglass frame F, its template or a model of lens shape, and a reference numeral 2 designates a lens grinding processing apparatus (lens grinding apparatus) by which lenses for the eyeglass frame is ground based on the lens shape data of the eyeglass frame being sent from the eyeglass frame measuring apparatus through communication. Herein, because the eyeglass frame shape measuring apparatus 1 can be utilized from those which are well known in the prior art, the explanation on detailed composition of it and the method for data measuring by it are omitted.

<Lens Grinding Processing Apparatus 2>

The lens grinding processing apparatus 2 has a cover 5 which is made of semi transparent material, for example transparent material with thin colored such as gray, and is opened to uncover and closed to cover a processing room 4 disposed in a front surface side of the lens grinding processing apparatus main body 3 as shown in FIG. 2 to FIG. 9. And the lens grinding processing apparatus 2 has a grinding means which is disposed in the processing room 4, and a lens edge thickness measuring means which is reciprocatedly disposed in the processing room 4, though both of them are not shown in the drawings. Moreover, the lens grinding processing apparatus 2 has a first and a second operating panels (operating means) 6, 7 which are used when controlling operation and data setting operation are achieved for each driving motors of the grinding means and a driving motor of the edge thickness measuring means. Also the lens grinding processing apparatus has a liquid crystal display device 8 as a display device (display means) to display the operating state by the control panel 6, 7 and the like.

Figure 2:
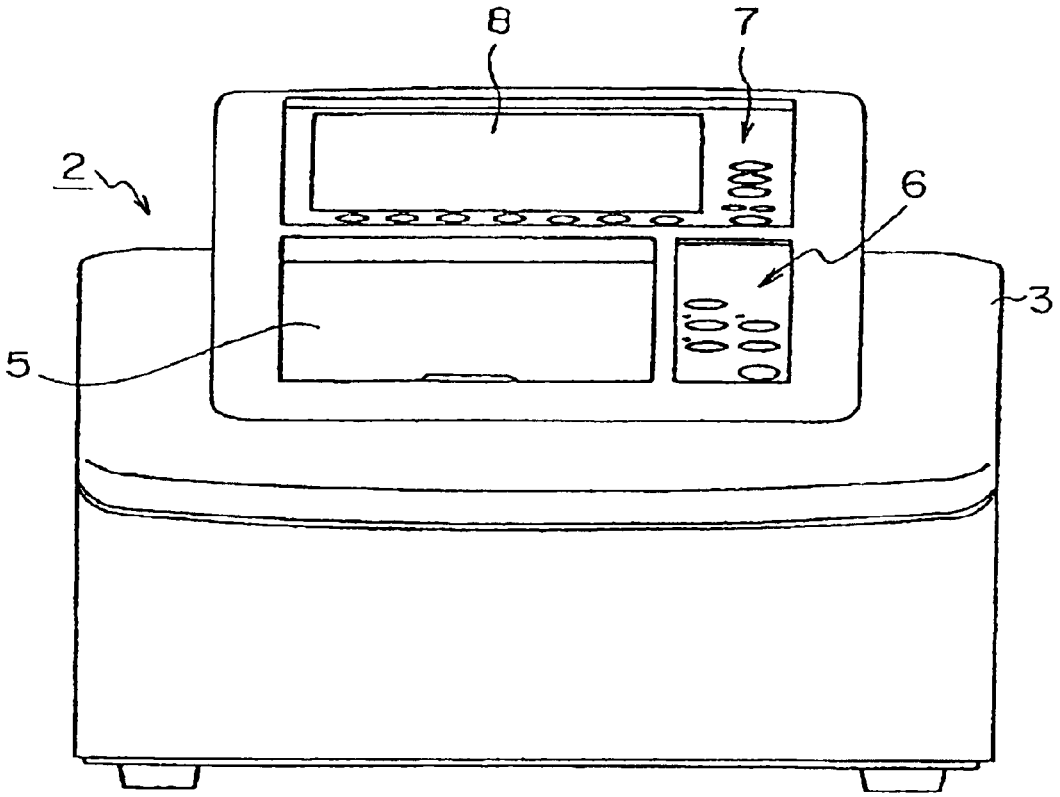
FIG. 2 is a front view of the lens grinding apparatus according to one embodiment of the present invention.
Figure 3:
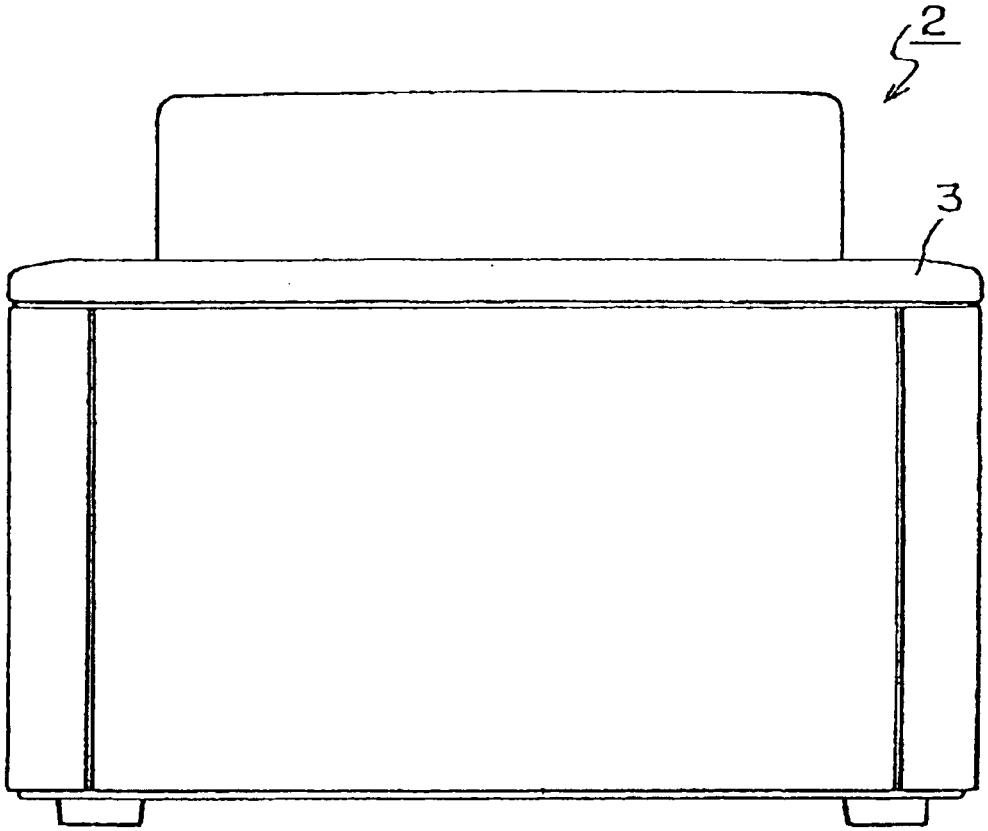
FIG. 3 is a back side view of the lens grinding apparatus according to the embodiment of the present invention.
Figure 4:
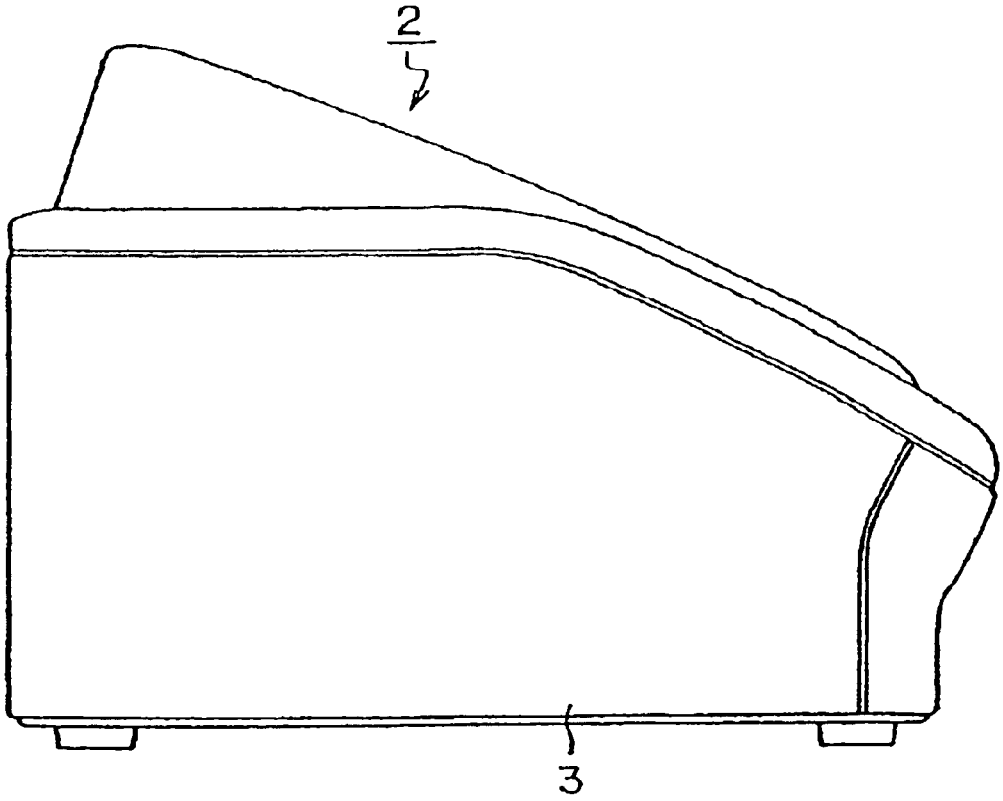
FIG. 4 is a right side view of the lens grinding apparatus according to the embodiment of the present invention.
Figure 5:
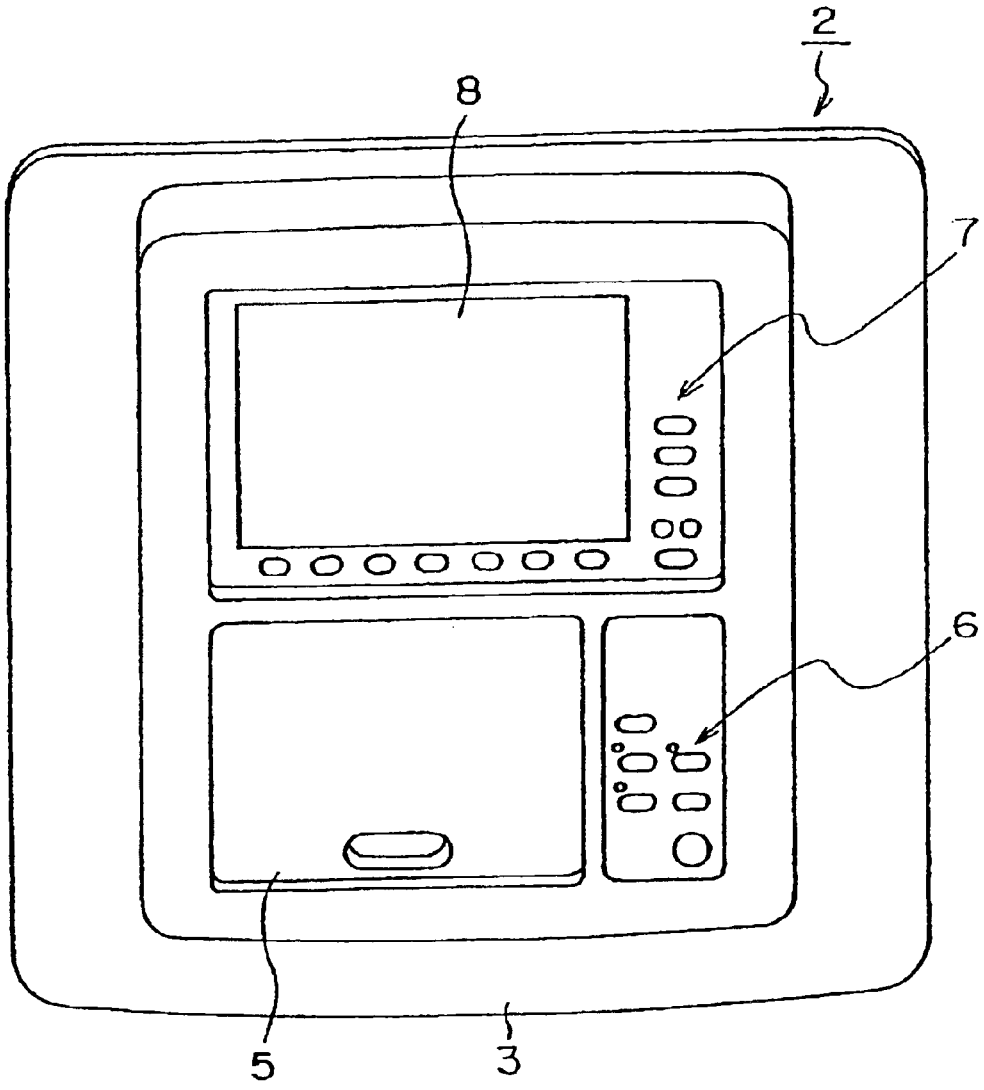
FIG. 5 is a plan view of the lens grinding apparatus according to the embodiment of the present invention.
Figure 6:
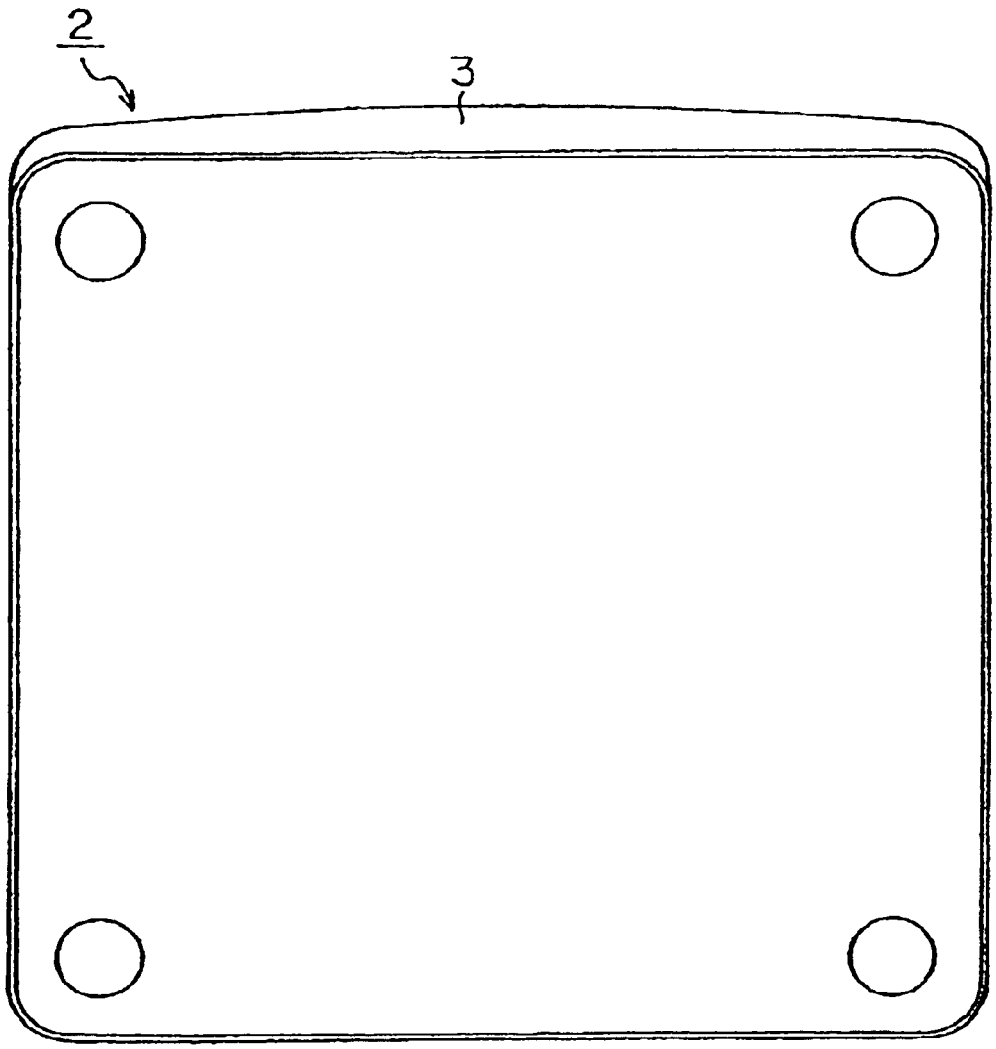
FIG. 6 is a bottom view of the lens grinding apparatus according to the embodiment of the present invention.
Figure 7:
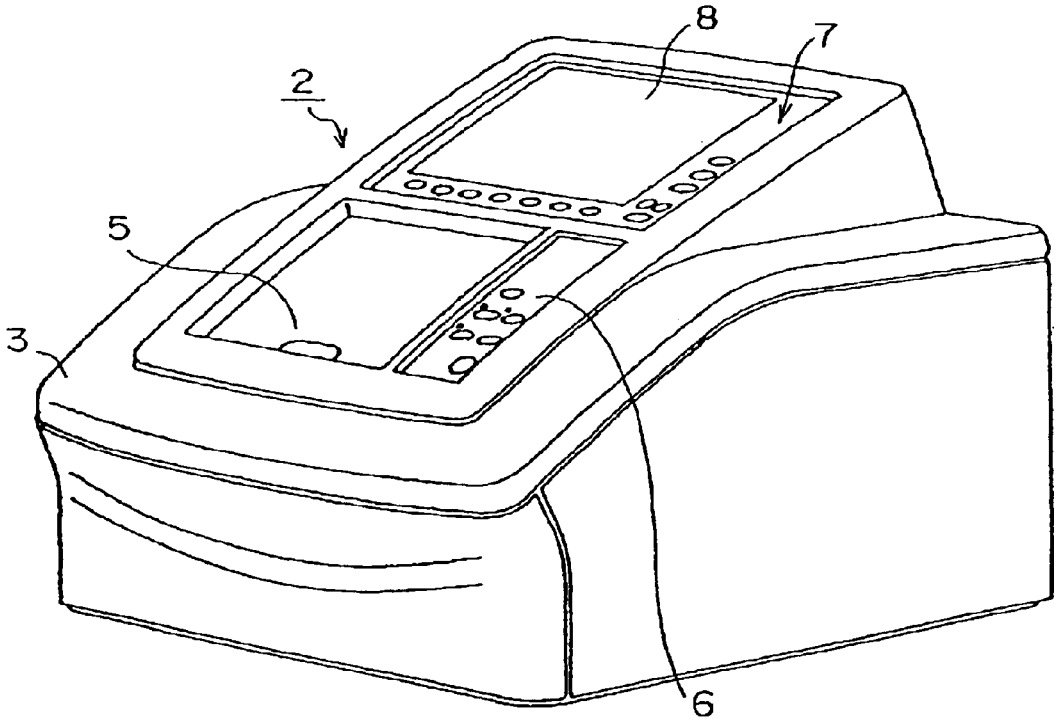
FIG. 7 is a perspective view of the lens grinding apparatus according to the embodiment of the present invention.

Herein, for understanding appearance of the lens grinding processing apparatus 2, a front view of it is shown in FIG. 2, a back side view of it is shown in FIG. 3, a right side view of it is shown in FIG. 4, a plan view of it is shown in FIG. 5, a bottom view of it is shown in FIG. 6 and a perspective view of it is shown in FIG. 7.

The lens grinding processing apparatus 2 has the liquid crystal display device 8, the first and second control panel 6, 7, and the cover 5 on the same flat surface as shown in the front view of FIG. 2 and the plan view of FIG. 5, with an arrangement that the first control panel 6 is disposed adjoining to the right side of the cover 5 and the second control panel 7 is disposed adjoining to the right side of the liquid crystal display device 8, and the cover 5 and the first control panel 6 are disposed in front of the liquid crystal display device 8 and the second control panel 7 for an easy handling by the operator. These control panel 7 and the liquid crystal display device 8 are used as a function setting means, too. Combination of both the control panel 7 and the liquid crystal display device 8 compose the function setting means. However, in this specification, the second control panel 7 may be solely called the function setting means.

Herein, in the control panel 7, the function keys F1–F6 are disposed. These function keys F1–F6 are arranged in a lower portion of the liquid crystal display device 8 and they are used for setting and achieving various function. In this context they also may be called as the function setting means in this specification, though other switches (which will be described later) on the control panel 7 may be also called as the function setting means in this specification.

Further, as described later, the icons displayed on the liquid crystal display device 8 (which will be described later), the displaying area (which will be described later), and the display window for the message display and the error display (which will be described later) compose a part of the function setting means. These are obvious from the explanation of the screen of the liquid crystal display device 8 which will be described later.

The flat surface portion on which the liquid crystal display device 8, the first and the second operating panel 6, 7 and the cover 5 are disposed, is arranged slantedly on the grinding apparatus main body 3, and as shown in the right side view of FIG. 4, a top portion of the apparatus main body is also arranged to be gently slanted toward its front side so as to have the same angle of inclination with the flat surface portion, and it gives a feeling of stream line as a whole. This causes that an operator can achieve the lens grinding work without taking unnatural posture and that a screen (grinding work screen) of the liquid crystal display device 8 can be easily looked, and at the same time it makes the operator feel friendly to the apparatus it removes a psychological oppressive feeling from a view point of the human engineering.

The slanted top surface portion of the apparatus main body 3 is projecting toward the operator (toward its front side), and has a gently rounded shape as shown in the right side view of FIG. 4, the plan view of FIG. 5 and the perspective view of FIG. 7. This is also arranged to cause the operator feel friendly to the apparatus and to remove the psychological oppressive feeling.

Figure 8A:
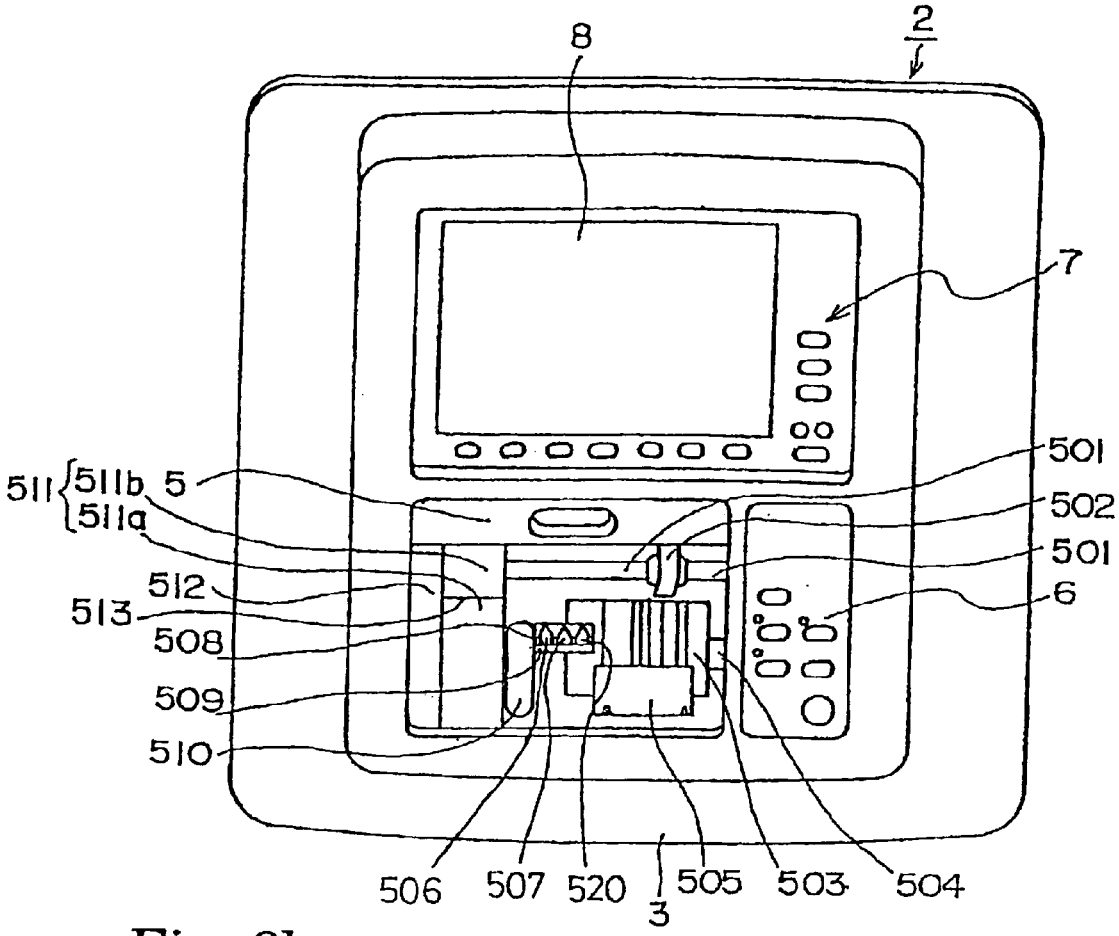
FIG. 8A is a plan view of the lens grinding apparatus according to an embodiment of the present invention in a state with its cover opened.
Figure 9:
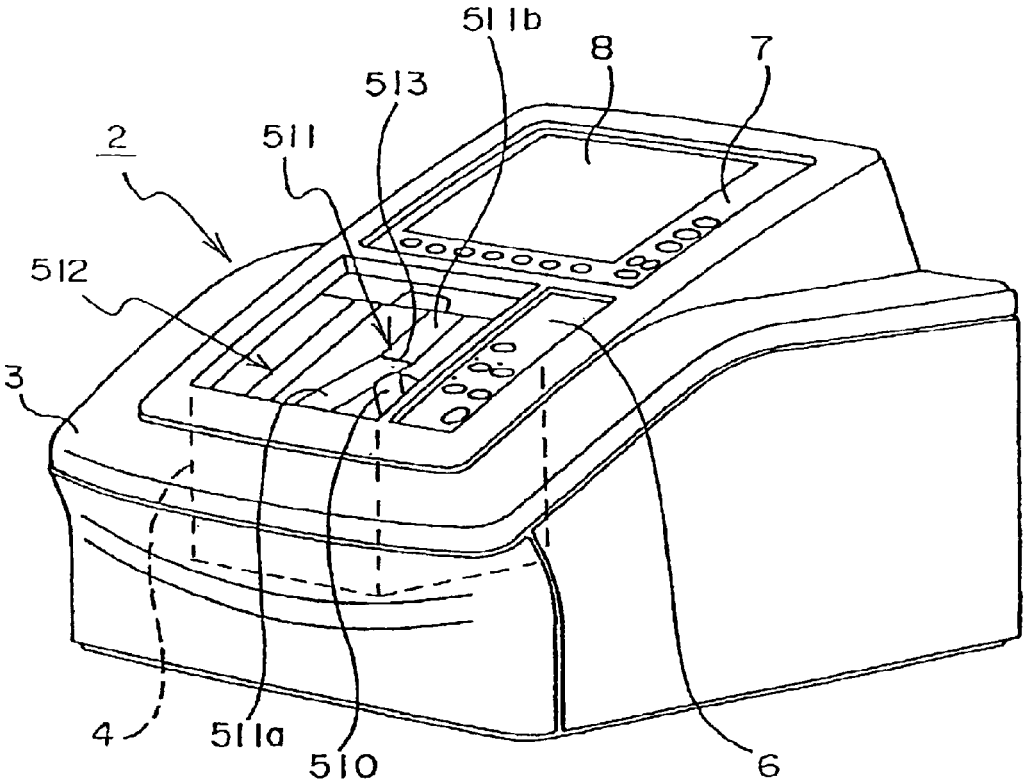
FIG. 9 is a perspective view of the lens grinding apparatus according to one embodiment of the present invention in a state with its cover opened.

The cover 5 is opened to uncover and closed to cover the processing room 4 by a sliding movement along its front and back direction as shown in the plan view of FIG. 8A with the cover opened and as shown in the perspective view of FIG. 9 with the cover opened. The processing room 4 has a structure with a deep bottom and includes a portion 512 which is parallel to an inner wall (a vertical wall) as shown in left side of FIG. 8A and includes a portion 511 which is gently slanted from the front side to the back side, and each portions 511, 512 have steps respectively. A bent portion 513 is formed on the portion 511, and slanted surfaces 511*a*, 511*b* are made to form the bent portion which are opened toward the cover 5. Herein an angle of the slanted surface 511*b* is arranged to be larger than that of the slanted surface 511*a*.

A car ridge which is not shown in the drawings is disposed at a back side of the processing room 4, and arm portions (not shown) of the car ridge are also disposed respectively at the outside of the left and right side walls (not shown) which form the processing room 4. And the car ridge is made rotatably around a supporting axis (not shown) whose back end portions are extending in left and right direction, and the arm portions are made swingably in vertical direction. Herein the car ridge is arranged to be able to reciprocate in the left and right direction. As for supporting structure of the car ridge of this kind a well know structure can be selected from the prior art, since, the detailed explanation is omitted here.

A pair of lens rotating shafts 501, 501 which extends in the left and right direction, are disposed in the processing room 4. One of the lens rotating shafts 501, 501 is held rotatably and at the same time fixedly along the shaft axis direction by one of the arm portion of the car ridge, and another one of the lens rotating shafts 501, 501 is held rotatably and at the same time movably for adjustment along the shaft axis direction by another one of the arm portion of the car ridge. A well known structure also can be applicable to this kind of holding structure for the lens rotating shafts 501, 501 on the car ridge, the detailed explanation is omitted, too.

An unmachined raw material lens with rounded shape (unmachined eyeglass lens i.e. lens to be processed) 502 is held by the one pair of lens rotating shaft 501, 501 which are disposed in the left and right. A grinding stone 503 and a grinding stone shaft 504 which holds the grinding stone 503, are disposed obliquely under the lens rotating shaft 501. This grinding stone shaft 504 is arranged to be driven for rotation by a driving motor which is not shown in the drawings.

The grinding stone has a set of grinding stone such as a rough grinding stone 503*a*, a V shape grinding stone 503*b* with V-shaped groove for V shape portion processing, and a mirror finishing grinding stone 503*c*. In front of the grinding stone 503, a cover 505 is disposed.

Further, a rotating arm 510 is disposed in the opposing left side portion of the processing room 4. This rotating arm 510 is arranged rotatably (swingably) in vertical direction with its lower end portion as a center, and at the same time it is arranged to be rotated in vertical direction by a pulse motor for the arm rotation. Also a rotating shaft 508 is rotatably held by the top end portion (upper end portion) of the rotating arm 510 as shown in FIG. 8A, 8(*b*). This rotating shaft 508 is driven to rotate by another pulse motor for shaft rotation which is not shown in the drawings. Further a chamfering grinding stone 506, 507 are attached to this rotating shaft 508, and at the same time a cutter for grooving (grooving grinding stone) 520 is also attached as well.

Herein, the chamfering grinding stone 506, 507 are covered with a cover 509 to prevent from the operator touching with it erroneously. A hose (not shown) is disposed to supply cooling water onto a surface of the grinding stone 503.

For a grinding process of the eyeglass lens from the raw material lens 502 to a specified lens shape (lens shape of an eyeglass frame) utilizing this kind of grinding stone 503, firstly the lens shape data (θi, ρi) of an eyeglass frame, eyeglass lens (model lens) or a template are measured by the eyeglass frame shape measuring apparatus 1, and the resulted lens shape data (θi, ρi) are input to the lens grinding processing apparatus 2.

Secondly, after the lens grinding processing apparatus 2 has received the lens shape data (θi, ρi), the apparatus makes the car ridge which is not shown in the drawings turn in vertical direction and controls it based on the lens shape data (θi, ρi), and it roughly grinds the raw material lens 502 into an eyeglass lens with a shape of the specified eyeglass frame by the rough grinding stone 503*a* through a rotation and a controlling of the lens rotating shaft 501, 501 and the raw material lens 502 with a combined rotation and controlling of the car ridge in the vertical direction.

Figure 8B:
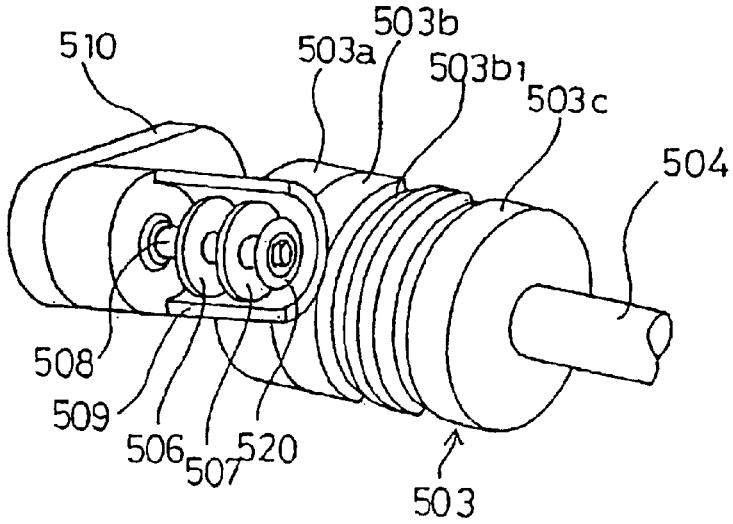
FIG. 8B is a perspective view of a chamfering grindstone and grooving cutter which are utilized in the lens grinding apparatus shown in FIG. 8A.

And, at an edge portion of the roughly ground eyeglass lens, V-shaped protrusion by which the ground eyeglass lens is fixed into the frame of the eyeglass, and a wiring grooving for a wire by which the eyeglass lens is held in the frame of the eyeglass, are formed. When the V-shaped protrusion to fix the eyeglass lens into the frame of the eyeglass is formed at the edge portion of the eyeglass lens, the lens grinding processing apparatus 2 further grinds the eyeglass lens ML which has been ground in the specified shape for the lens shape of an eyeglass frame based on the lens shape data (θi, ρi) by the V-shaped protrusion grinding stone 503*b* shown in FIG. 8B to form the V-shaped protrusion at the edge portion (lens peripheral portion) of the eyeglass lens ML, and after the V-shaped protrusion has been formed, the lens grinding processing apparatus 2 makes the edge portion of the eyeglass lens to be formed chamfering by the chamfering grindstone 506, 507 which are shown in FIG. 8B. Further, when the wiring grooving for the wire by which the eyeglass lens is held in the frame of the eyeglass, is formed at the peripheral portion of the eyeglass lens, the lens grinding processing apparatus 2 grinds the eyeglass lens ML which has been ground in the specified shape for the lens shape of an eyeglass frame based on the lens shape data (θi, ρi) by the grooving cutter 520 shown in FIG. 8B to form the wiring groove at the edge portion (lens peripheral portion) of the eyeglass lens ML, and after the wiring groove has been formed, the lens grinding processing apparatus 2 makes the edge portion of the eyeglass lens to be formed chamfering by the chamfering grindstone 506, 507 which are shown in FIG. 8B.

<Edge Thickness Measuring Apparatus>

For the edge thickness measuring means which is arranged to be able to enter into and get out of the processing room 4, there may be used those of well known in the prior art. For example, there may be an edge thickness measuring means composed by that a pair of feelers which are arranged to be able to enter into and get out of the processing room 4 by a driving motor such as a pulse motor, are disposed in the processing room 4 while the lens to be ground is held between the above described lens rotating shafts, and the distance between these feelers are detected as an edge thickness value. In this edge thickness measuring means with the above described composition, the lens thickness Wi corresponding to a point (θi, ρi) of the lens is measured by means that the top end portions of the feelers which are made into the processing room 4 are arranged to abut with a front refracting surface and a back refracting surface of the lens to be ground, and at the same time the driving motors which drive the pair of lens rotating shafts are operated and controlled in accordance with the angle θi based on the lens shape data (θi, ρi), and the driving motors for driving the pair of lens rotating shafts are operated and controlled based on the lens shape data (θi, ρi), and the abutment point of the feelers on the lens to be ground is moved to corresponding to the point of ρi on the lens to be ground, since, the thickness Wi is thought to be the edge thickness corresponding to the lens shape data (θi, ρi).

(Operating Panel 6)

Figure 10A:
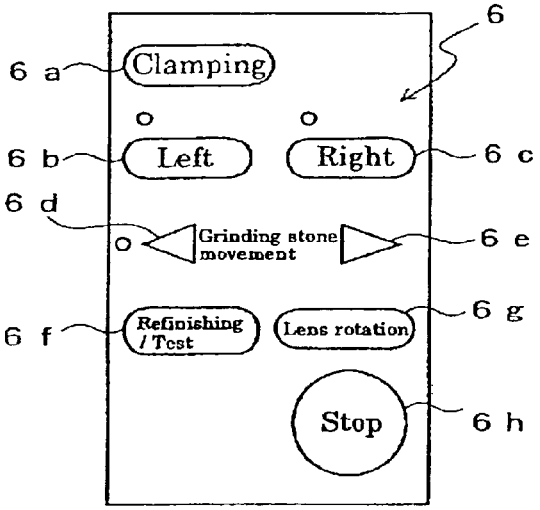
FIG. 10A is an enlarged explanatory front view of a first control panel.

The control panel 6 has "Clamp" switch 6*a* to clamp the eyeglass lens by the lens rotating shafts, "Left" switch 6*b* and "Right" switch 6*c* to designate which side of the eyeglass lens is processed or to change which side of the eyeglass lens is displayed, "Grinding stone movement" switches 6*d*, 6*e* to move the grinding stone in left and right direction, "Re-finishing/Test" switches 6*f* to process again when a state of the finished eyeglass lens is not enough or to grind as a testing, "Lens rotating" switch 6*g* for a lens rotating mode and "Stop" switch 6*h* to stop the lens processing operation as shown in FIG. 10A.

By this arrangement of disposition of all switches to be required for the actual lens processing operation, a load to the operator can be reduced.

<Operating Panel 7>

(Operating Panel 7)

As described above, the control panel 7 and the liquid crystal display device 8 composes the function setting means in combination as a whole. However, in this specification, only the operating panel 7 may solely be called as a function setting means. This is because the function keys F1–F6 are all made in the control panel 7 as described above. These function keys F1–F6 are arranged at the lower portion of the liquid crystal display device 8 to be used for setting various functions and for achievement of them. In this context, it can be called that these function keys F1–F6 are the function setting means which are merely one part of the control panel 7. In addition to it, other switches (which will be explained later) which are other part of the control panel 7, may be also called the function setting means. Hereinafter the concrete function of these function keys F1–F6 and the function of the other various kind oF keyes will be explained.

Figure 10B:
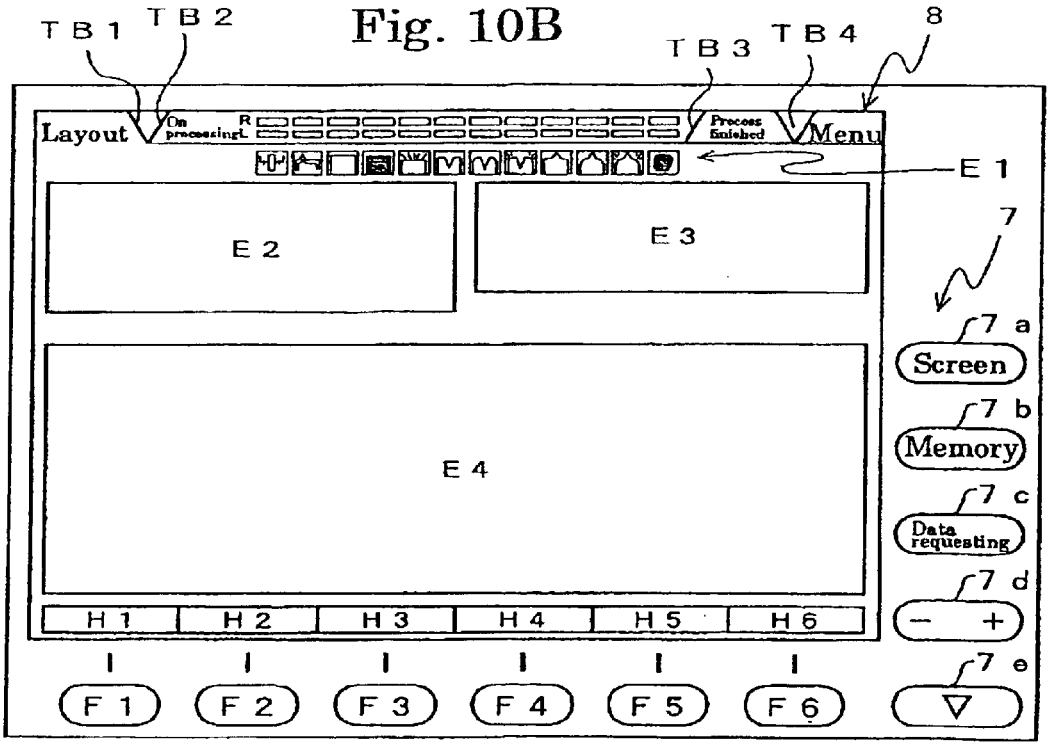
FIG. 10B is an enlarged explanatory front view of a second control panel.

This control panel (function setting means) 7 has "Screen" switch 7*a*, "Memory" switch 7*b*, "Data demand" switch 7*c*, "–, +" switch with seesaw mechanism 7*d* and "▽" switch 7*e* as shown in FIG. 10B. All of these switches 7*a*, 7*b*, 7*c*, 7*d* and 7*e* are disposed in a side portion of the liquid crystal display device 8.

Herein, the above described "Screen" switch 7*a* is used to change a display state of the liquid crystal display 8, and the "Memory" switch 7*b* is used to memorize a setting condition about the grinding process into memory. Also, the "Data demand" switch 7*c* is used to get the lens shape data (θi, ρi), and the "–, +" switch 7*d* with seesaw mechanism is used to adjust a value of input data and so on. It may also be suitable that "–" and "+" switches of this "–, +" switch 7*d* are separately disposed.

The "▽" switch 7*e* is used to operate and move a indicator pointer P, PE1, PE2, PE3 and so on which will be explained later, when various setting which are required for data processing, are achieved.

For example, this "▽" switch 7*e* can be used as a selecting means for eyeglass lens. That is to say, "▽" switch 7*e* is used when one of a kind of the eyeglass lens is selected to locate the indicator pointer PE2 on the items such as within "Single vision", "Ophthalmological prescription", "Progressive", "Bifocal", "Lenticular" and "Tsubokuri" which show various kinds of eyeglass lens.

At the same time, the control panel 7 has function keys F1–F6 which are disposed in the lower portion of the liquid crystal display device 8. These function keys F1–F6 are used when a setting about the grinding process of the eyeglass lens is achieved. That is to say, these function keys F1–F6 are used as a function setting means to achieve various setting which are required for data processing about the grinding process of the eyeglass lens. For the examples of these kind of data, there are lens shape data for the eyeglass frame of an eyeglass or an rimless frame of an eyeglass, lens shape processing data to grind the raw material lens based on this lens shape data and so on.

Moreover, in addition that the function keys F1–F6 are used when setting about the grinding process for an eyeglass lens, they are used for responding and selection to various message which are displayed during the grinding process on the liquid crystal display device 8.

Among these function keys F1–F6, the function key F1 is used to input the kind of lens, the function key F2 is used to input the course of processing, the function key F3 is used to input a kind of lens material, the function key F4 is used to input a kind of eyeglass frame, the function key F5 is used to input a kind of chamfering process and the function key F6 is used to input a mirror finishing process at the setting of grinding process (screen for layout) as shown in FIG. 11.

As for the kind of lenses which are input by the function key F1, there are "Single vision", "Ophthalmological prescription", "Progressive", "Bifocal", "Lenticular", "Tsubokuri" and so on. Herein the "Lenticular" generally means a lens of plus with much degree of refracting, and "Tsubokuri" generally means a lens of minus with much degree of refracting in the optician's industry.

As for the course of processing which are input by the function key F2, there are "Auto", "Try", "Monitor", "Change of frame" and so on.

As for the kind of lens material which are input by the function key F3, there are "Flat", "High index", "Glass", "Polycarbonate", "Acrylic" and so on.

As for the kind of eyeglass frame which are input by the function key F4, there are "Metal", "Celluloid", "Optil", "Flat", "Grooving (thin)", "Grooving (middle) ", "Grooving (thick)" and so on.

As for the kind of chamfering process which are input by the function key F5, there are "None", "Small", "Middle", "Large", "Special" and so on.

As for the mirror finishing which are input by the function key F6, there are "None", "Applicable", "Mirror finishing at the chamfering portion" and so on.

Herein, the above described mode, kind and order of the function keys F1–F6 are no need to be restricted as the embodiment. Further, the number of the function keys is also no need to be restricted as the embodiment, for example, it may be suitable to dispose another function keys to select such as "Layout", "On processing", "Process finished", "Menu" and so on for selection of tubs TB1-TB4 which will be explained later.

<Control Circuit (Control Means)>

Figure 64:
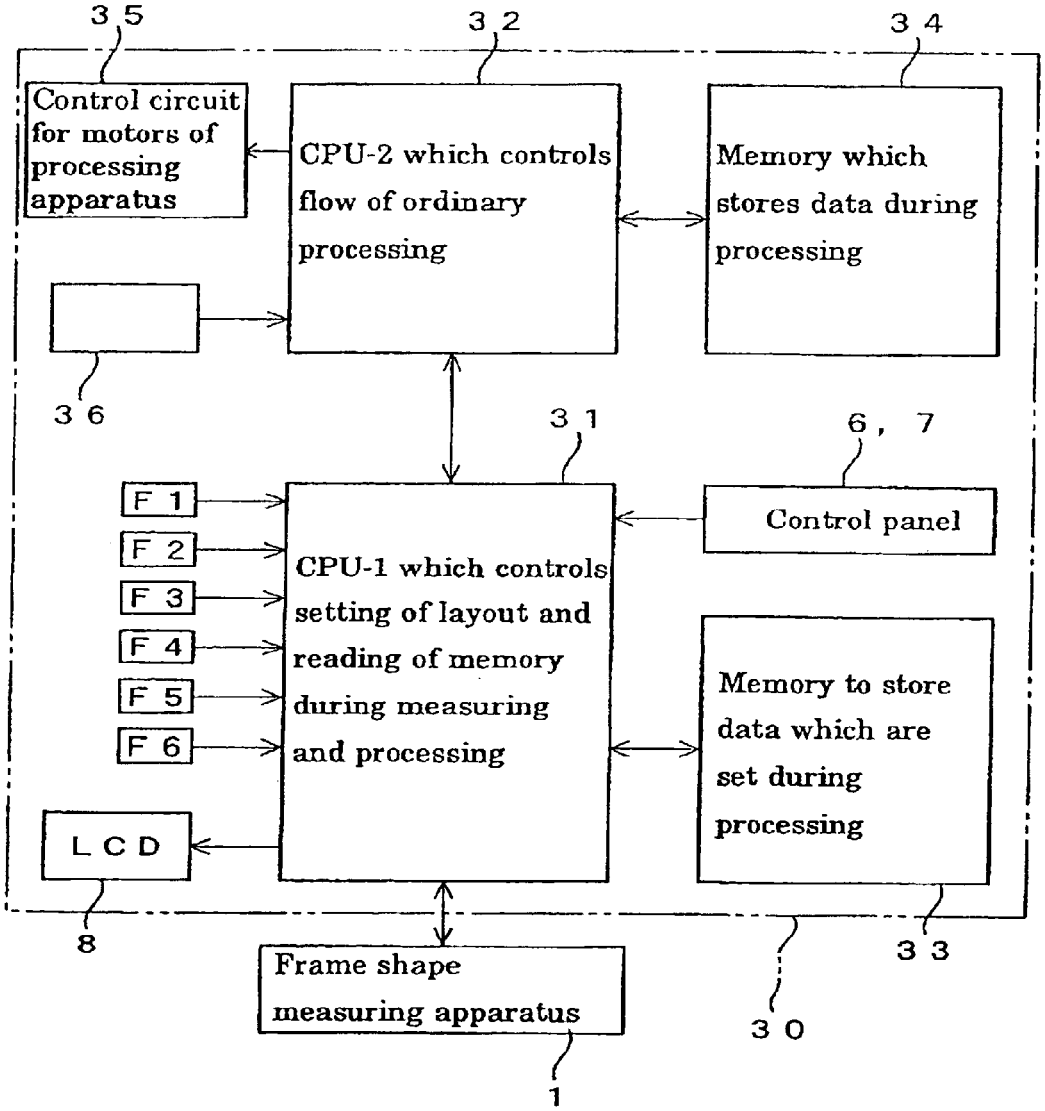
FIG. 64 is an explanatory view showing one example of a control circuit for the lens grinding apparatus.

The lens grinding processing apparatus 2 has a control circuit (control means) 30 as shown in FIG. 64. This control circuit 30 has a first calculation control circuit (first calculation control means) 31 which includes a first CPU (CPU-1) and at the same time it has a second calculation control circuit (second calculation control means) 32 which includes a second CPU (CPU-2) and which is connected to the first calculation control circuit 31.

The first calculation control circuit 31 is used to read data from a memory and to control the setting of a layout for lens grinding process when the edge thickness is measured and when the lens is ground for processing. And the second calculation control circuit 32 is used to control the continued steps of lens grinding process based on the layout information (processing condition), such as rough grinding of the lens to be processed, V-shaped protrusion processing, finishing process and so on after the edge thickness of lens has been measured.

To the first calculation control circuit 31 there is connected the liquid crystal display device 8 and a setting data memory 33 to store the data which are set by the eyeglass frame shape measuring apparatus 1, each oF keyes 6*a*–6*n* on the control panel 6 and the function keys F1–F6.

To the second calculation control circuit 32 there is connected the processing data memory 34 to store the data during the grinding process, a control circuit 35 to control and drive the each driving motors of the grinding processing apparatus and a distance measuring means 36 of the edge thickness measuring means.

The operating signal of the function keys F1–F6 are input to the first calculation control circuit 31. The first calculation control circuit 31 achieves to change a part or all of the displayed screen on the liquid crystal display device 8, to change the mode of process or to complete the task by means of pushing a selected function key from F1–F6 which corresponds to the function displayed portion H1–H6 on the liquid crystal display device 8, in accordance with the designated display which corresponds to the selected function key F1–F6. Also the first calculation control circuit 31 controls a display state of a state display area E4 on the liquid crystal display device 8.

[Operation]

In the following, a display onto a liquid crystal display device 8 by the arithmetic control circuits 31, 32 constituted as described above will be explained.

(1) Initial Display of the Liquid Crystal Display Device 8, and so on

On the upper edge of the liquid crystal display device 8 are provided display parts such as "Layout" tab TB1, "Processing" tab TB2, "Processed" tab TB3, and "Menu" tab TB4. On the "Processing" tab TB2 portion are provided a plurality of indicator (cursor) C1–C12 for displaying process progressing circumstances of a right eye-lens and a plurality of indicators (indicators) C1–C12 for displaying process progressing circumstances of a left eye-lens in a vertically corresponding manner. The indicators (indicators) C1–C12 are used to display the processing state.

Further, on the lower edge of the liquid crystal display device 8 are provided function display parts H1–H6 corresponding to function keys F1–F6.

The liquid crystal display device 8 selects the tab TB1 to switch a display to the "Layout" display, selects the tab TB2 to switch a display to the "Processing" display, selects the tab TB3 to switch a display to the "Processed" display, and selects the tab TB4 to switch a display to the "Menu" display.

Colors of these tabs TB1–TB4 are set to independent different colors. Moreover, the circumferential background except areas E1–E4 described later is also switched to background color which is the same color as the tabs TB1–TB4 simultaneously with the switching of selection of the tabs TB1–TB4.

For example, the "Layout" tab TB1 and the whole display screen (background) marked with the tab TB1 is displayed in blue, and the "Processing" tab TB2 and the whole display screen (background) marked with the tab TB2 is displayed in green. Further, the "Processed" tab TB3 and the whole display screen (background) marked with the tab TB3 is displayed in red, and the "Menu" tab TB4 and the whole display screen (background) marked with the tab TB4 is displayed in yellow.

As described above, since the tab TB1–tab TB4 separated in color by work and the circumferential background are displayed in the same color, the worker is able to recognize or confirm easily what work is now doing.

Further, operating contents selected for operation by the function keys F1–F6 such operating contents as screen switching, and mode selection are displayed suitably as necessary on the function display parts H1–H6. However, in an undisplay state at which the operating contents are not displayed on the function display parts H1–H6, a pattern, a numerical value or a state different from those corresponding to the functions of the function keys F1–F6 can be displayed on the function display parts H1–H6.

Further, when the function keys F1–F6 are operated, that is, when either key of the function keys F1–F6 is depressed, a display of a mode or the like may be switched every time either one of the function keys F1–F6 is depressed. For example, when the function key F1 is operated, a display of a mode or the like may be switched every time the function key F1 is depressed.

Figure 12:
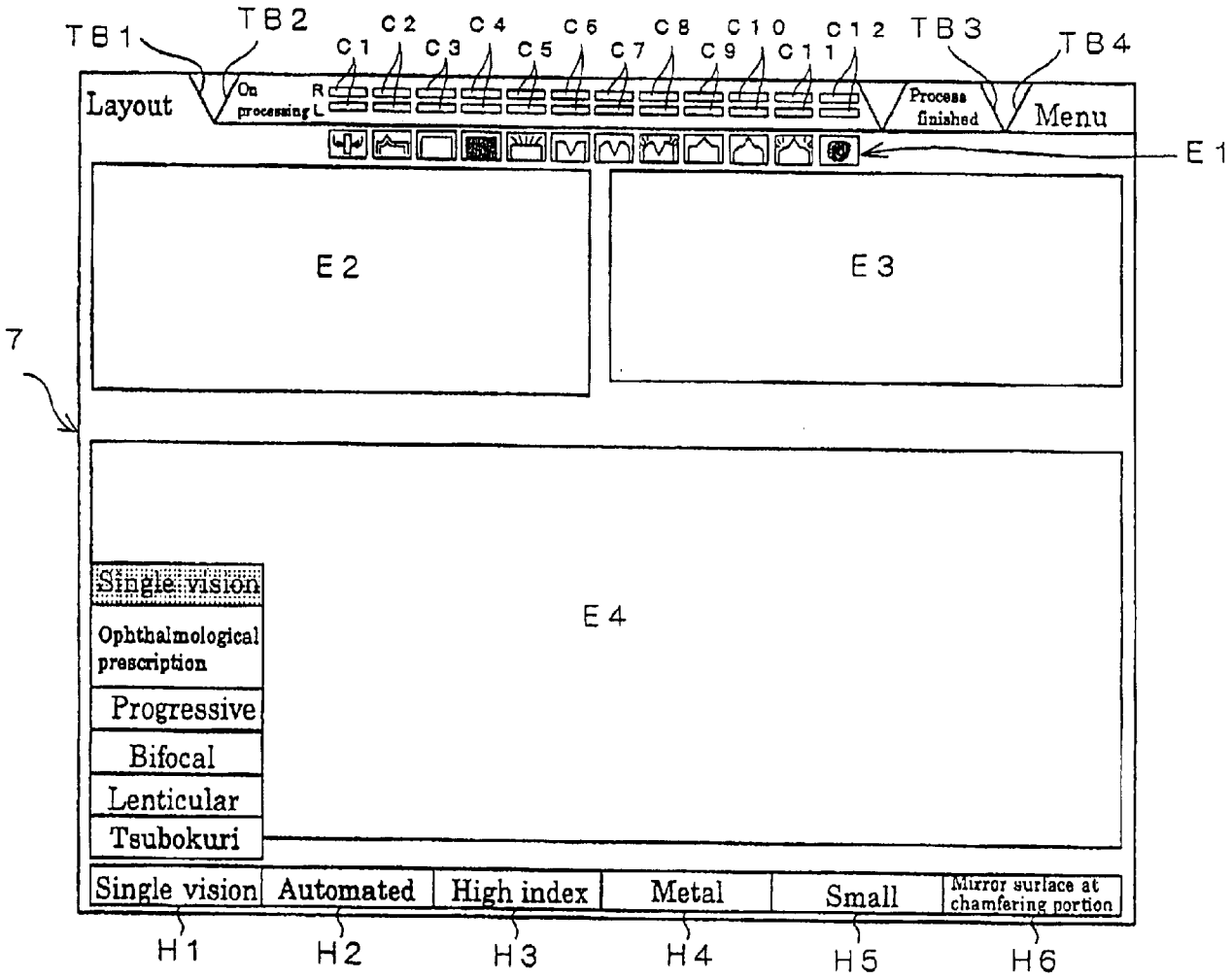
FIG. 12 is a front view of a liquid crystal display device showing one example of a display screen in a state for changing (modifying) detailed processing mode.

Further, it is also possible that when the function keys F1–F6 are depressed, a list of modes corresponding to the function keys F1–F6 is displayed (a pop-up display) to enable the selection operation. It is also possible that for example, when the function key F1 is operated, a list of modes corresponding to the function key F1 is displayed (a pop-up display) to enable the selection operation, as shown in FIG. 12. The list in the pop-up display is displayed by a letter, a pattern or an icon or the like.

Further, when either of "Layout" tab TB1, "Processing" tab TB2, or "Processed" tab TB3 is selected, an icon display area E1, a message display are E2, a numerical value display area E3, and a state display area E4 are divisionally displayed.

Figure 13:
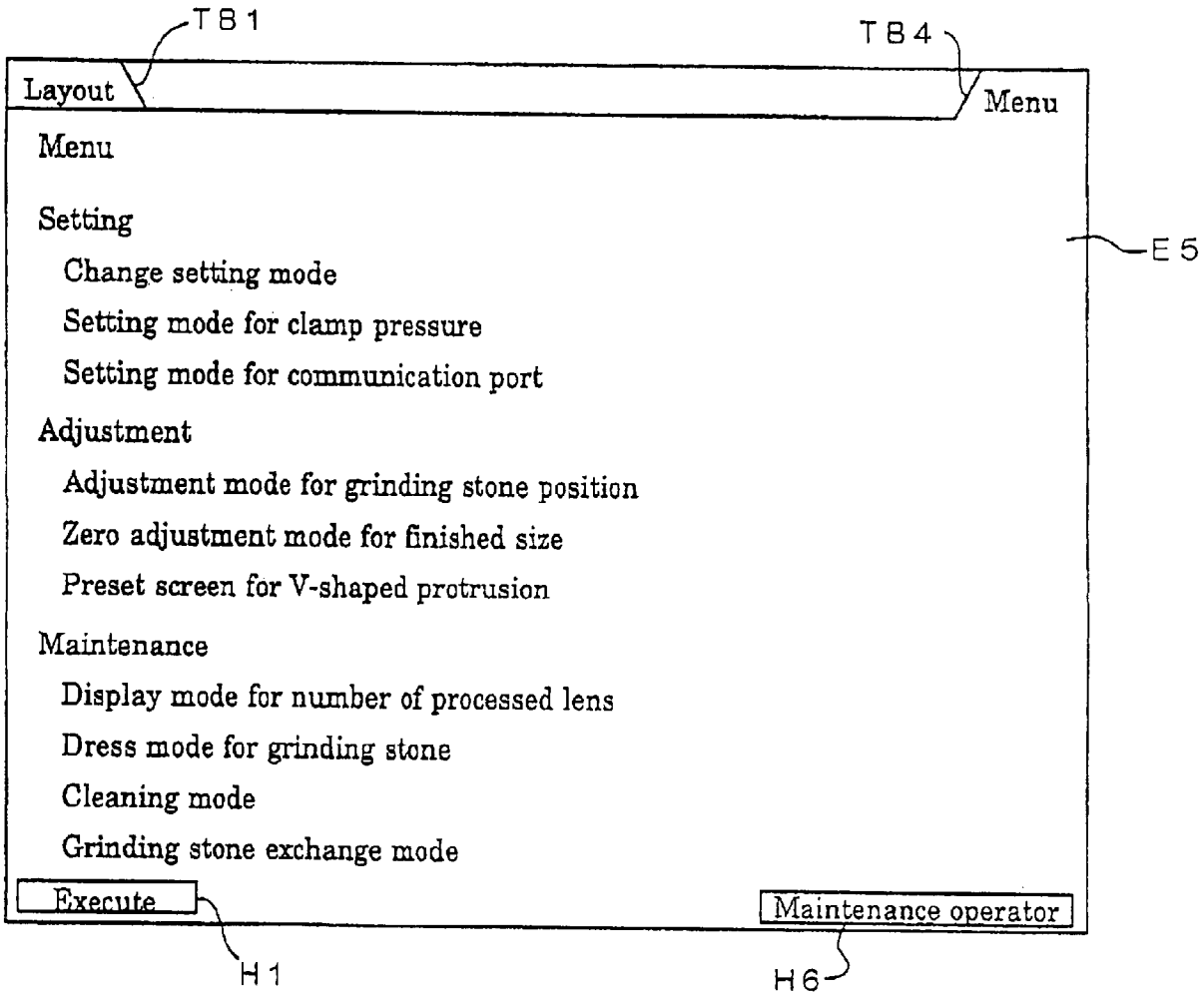
FIG. 13 is a front view of the liquid crystal display device showing one example of a display screen in a state in which a user operation mode is selected.
Figure 14:
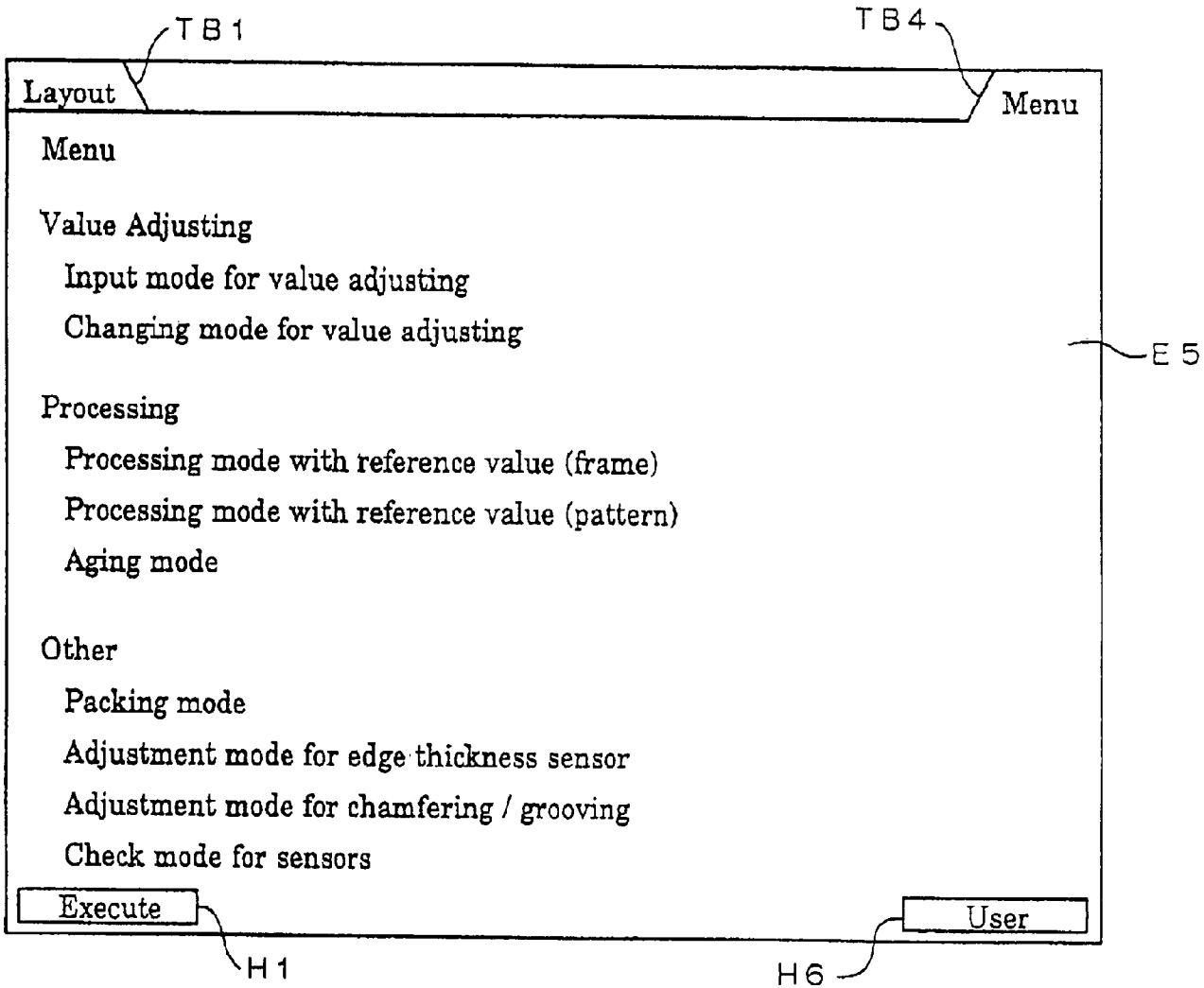
FIG. 14 is a front view of the liquid crystal display device displaying one example of a display screen in a state in which a maintenance operation mode is selected.

Further, in the state that selected the "Menu" tab TB4, a user using mode of FIG. 13 or a service-man using mode of FIG. 14 is displayed as a menu display area E5. Alternatively, in the state that selected the "Layout" tab TB1, the "Processing" tab TB2 and "Processed" tab TB3 are not displayed but when the layout setting is completed, the "Processing" tab TB2 and "Processed" tab TB3 may be displayed.

That is, in the state that selected the "Menu" tab TB4, first, the "Menu" of the user using mode as shown in FIG. 13 is displayed on the left side of the menu display area E5, a letter 'Execution' corresponding to the function key F1 is displayed at the left bottom of the menu display area E5, and a letter 'Repairman' corresponding to the function key F6 is displayed at the right bottom of the menu display area E5. One out of the menu is selected and the F1 is depressed, then the selected menu can be executed. Further, by depressing the F6, the user using mode shown in FIG. 13 is switched to the menu screen of the service man, i.e., the repairman using mode shown in FIG. 14. Also in this case, the letter 'Execution' corresponding to the function key F1 is displayed at the left bottom of the menu display area E5. However, at the right bottom of the menu display area E5 is displayed a letter the letter 'User' instead of a letter the letter 'Repairman'. In this state, when the F6 is depressed, the menu screen of the repairman using mode shown in FIG. 14 is switched to the user using mode shown in FIGS. 13 and 14.

Further, in the state that selected the "Menu" tab TB4, matters set from the menu display area E5 become a detailed menu display area E6, as shown in FIGS. 15–26, and setting of the detailed menu is carried out. It is noted that a detailed menu display shown in FIG. 15 may be employed in place of the menu display shown in FIG. 13. Next, a description will be made of a case where the 'Setting' is selected.

<Setting, Setting Changing Mode>

When "Setting" is selected from a menu display displayed on the menu display area E5 shown in FIG. 13, a guidance display area E61, a first detail display area E62, a second detail display area E63, a third detail display area E64 are divisionally on the detail menu display area E6. Moreover, on the guidance display area E61 are display in letter an explanation of a screen display state based on a present setting or a setting changing mode, and a guidance such as a message for urging work in next step. Further, a letter of "Down" is displayed on function display parts H1, H3, and H5 corresponding to the function keys F1, F2 and F3, and a letter of "Execution" is displayed on a function display part H6 corresponding to a function key F6.

On the first detail display area E62 are displayed items of "Setting", "Adjustment", and "Maintenance", and a cursor-type pointer PE1 for inverting a background color and a letter color every time the function key F1 is depressed. Every time the function key F1 is depressed, the cursor-type pointer PE1 is moved in order of "Setting", "Adjustment", and "Maintenance" to invert and display a background color and a letter color of the moved position. In this manner, either of "Setting", "Adjustment", or "Maintenance" is selected and designated by the cursor-type pointer PE1. Thereafter, a selection (designation) item is decided by operation of the function key F6 corresponding to "Execution" of the function key display part H6.

When "Setting" is selected in the first detail display area E62 as described above, the second detail display area E63 is displayed. On the second detail display area E63 are displayed "Setting changing mode", "Clamp pressure setting mode", and "Communication port setting mode", and a cursor-type pointer PE2 for inverting a background color and a letter color every time the function key F3 is depressed. Every time the function key F3 is depressed, the cursor-type pointer PE2 is moved in order of "Setting changing mode", "Clamp pressure setting mode", and "Communication port setting mode" to invert and display a background color and a letter color of the moved position. In this manner, either of "Setting changing mode", "Clamp pressure setting mode", or "Communication port setting mode" is selected and designated by the cursor-type pointer PE2. Thereafter, a selection (designation) item is decided by operation of the function key F6 corresponding to "Execution" of the function key display part H6.

When "Setting changing mode" is selected in the second detail display area E63 as described above, a third detail display area E64 is displayed. On the third detail display area E64 are displayed items of "Setting of language", "Initial setting of F key (function switch)", "Setting of pop-up display", "Setting of layout initial value", "Setting of display screen", "Setting of adsorption mode", "Setting of size" and, "Contrast adjustment of screen", and a cursor-type pointer PE3 for inverting a background color and a letter color every time the function key F3 is depressed. Every time the function key F5 is depressed, the cursor-type pointer PE3 is moved in order of "Setting of language", "Initial setting of F key (function switch)", "Setting of pop-up display", "Setting of layout initial value", "Setting of display screen", "Setting of adsorption mode", "Setting of size" and, "Contrast adjustment of screen" to invert and display a background color and a letter color at the moved position. In this manner, "Setting of language", "Initial setting of F key (function switch)", "Setting of pop-up display", "Setting of layout initial value", "Setting of display screen", "Setting of adsorption mode", "Setting of size" or, "Contrast adjustment of screen" is selected and designated by the cursor-type pointer PE3. Thereafter, a selection (designation) item is decided by operation of the function key F6 corresponding to "Execution" of the function key display part H6.

Figure 15:
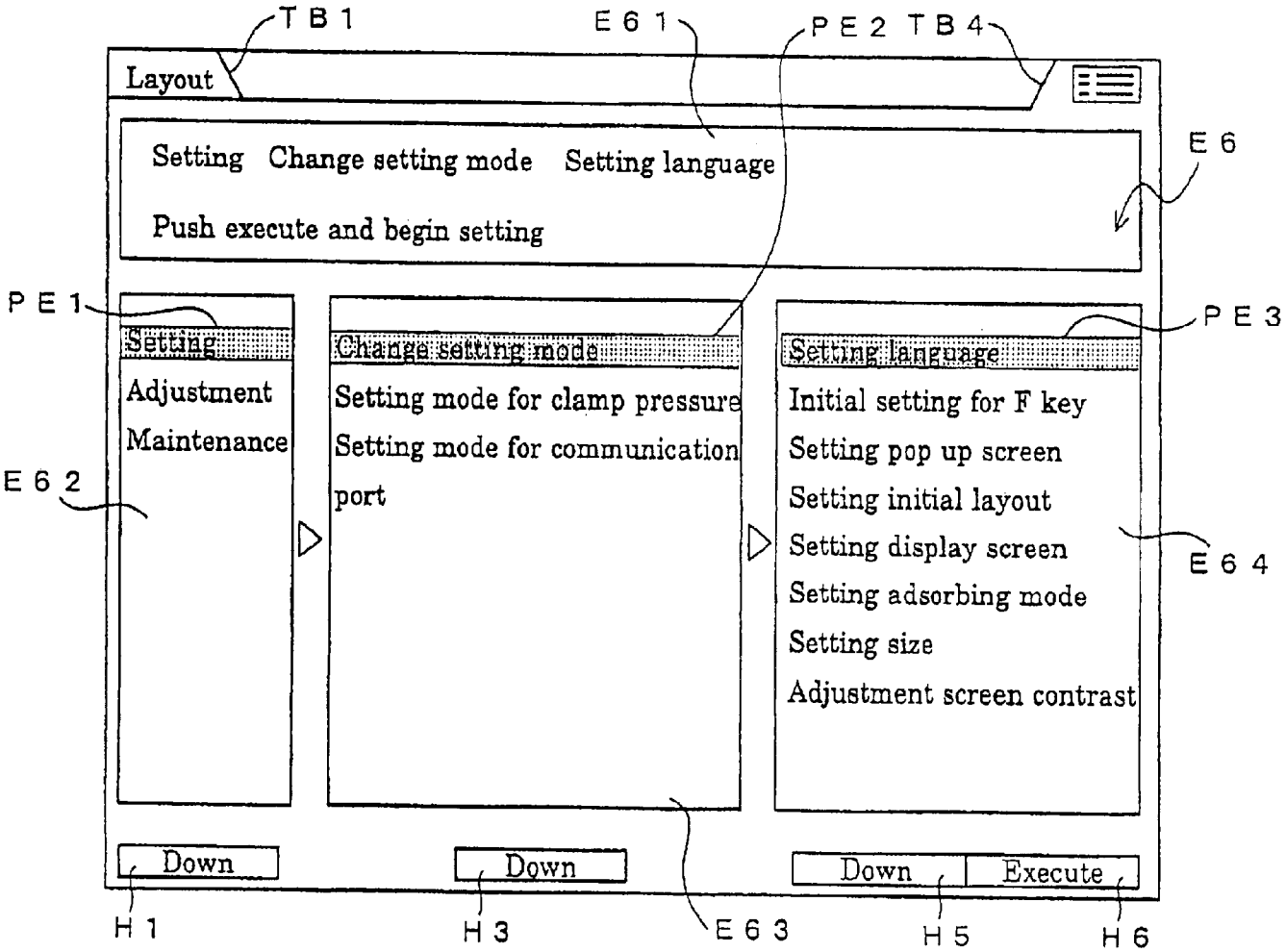
FIG. 15 is a front view of the liquid crystal display device displaying a detailed menu area in a setting/change setting mode.
Figure 17:
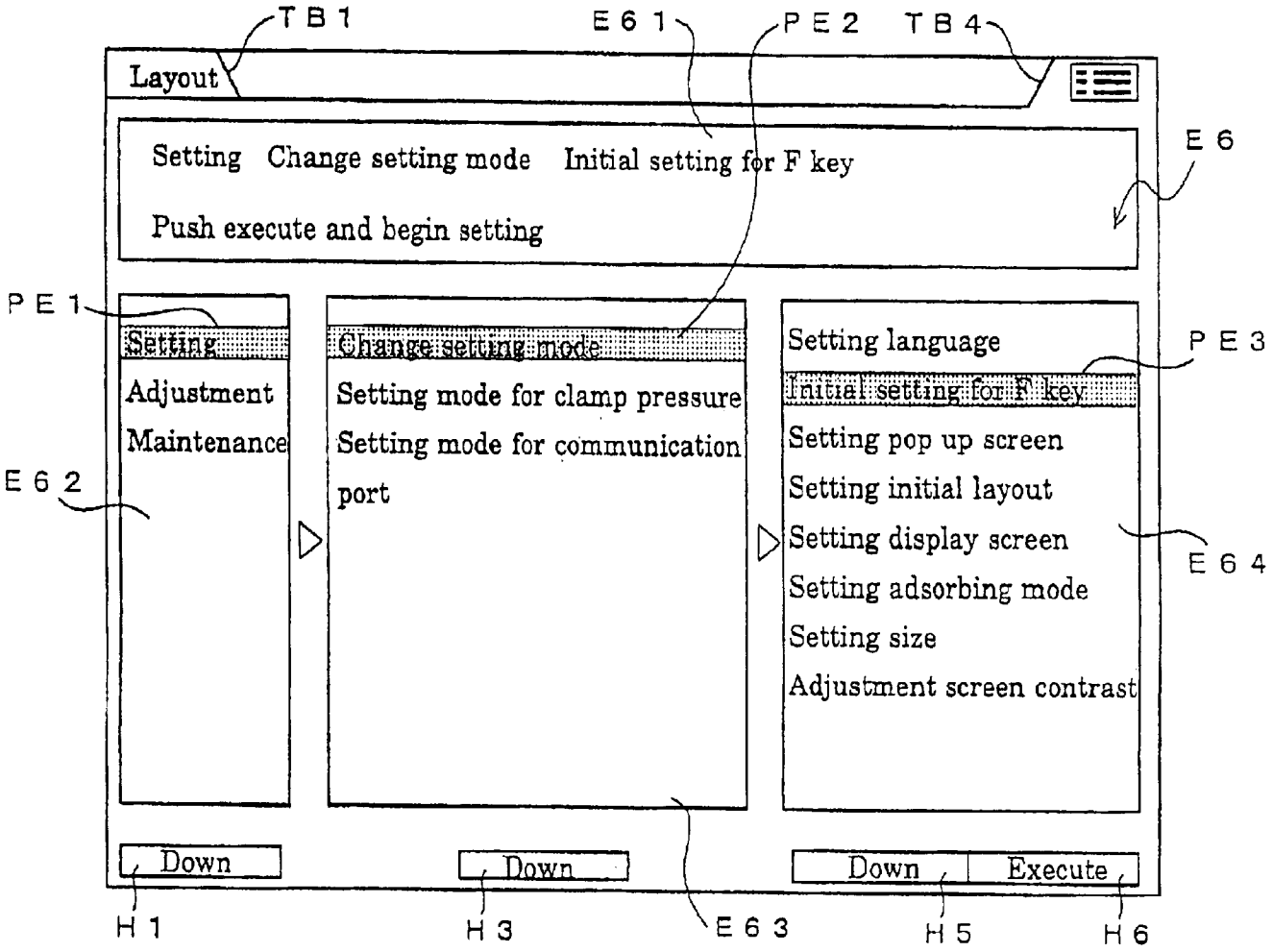
FIG. 17 is a front view of the liquid crystal display device displaying the detailed menu area in a state in which a F key default mode is selected.
Figure 18:
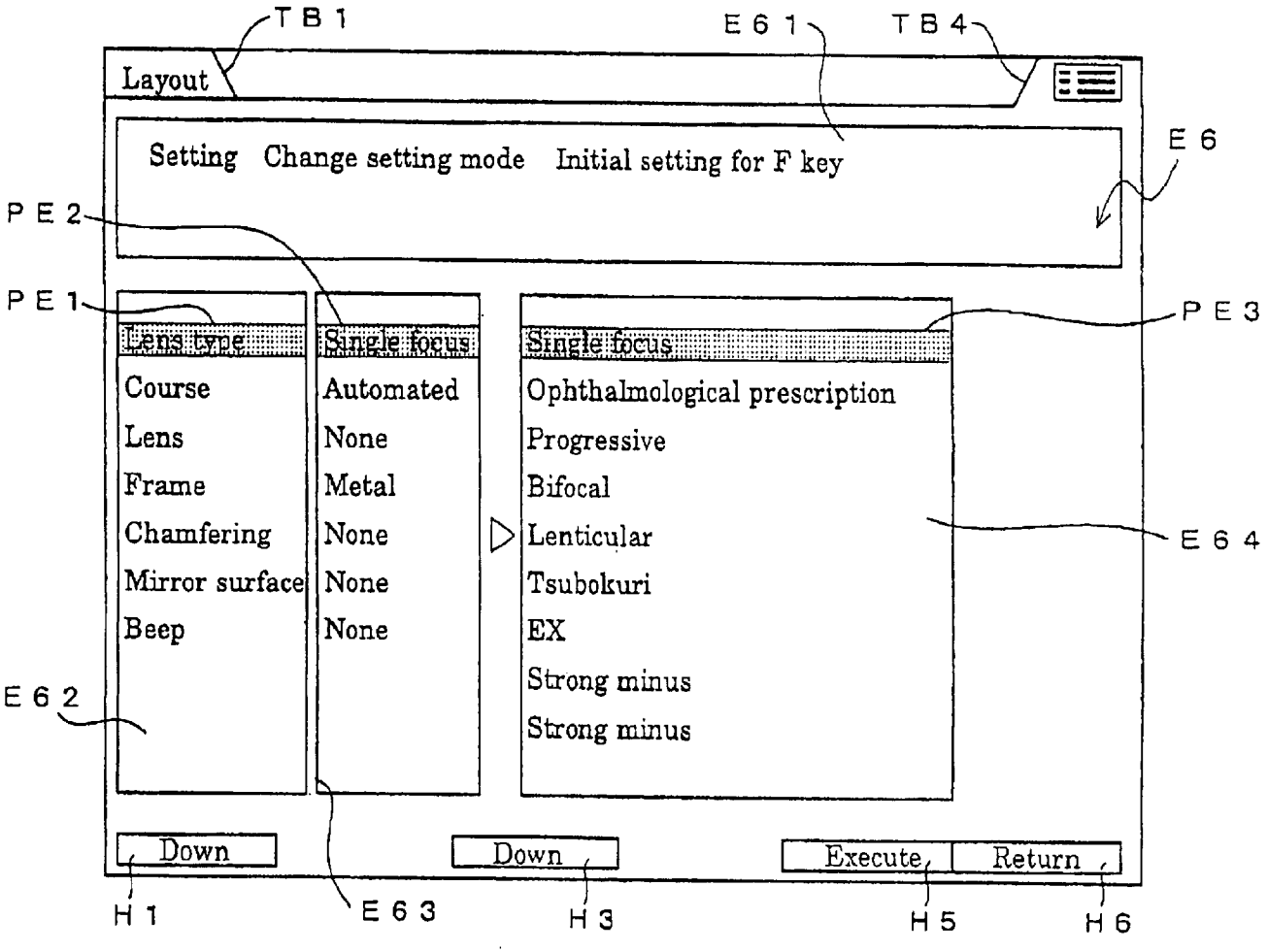
FIG. 18 is a front view of the liquid crystal display device displaying the detailed menu area in a detailed F key default mode.
Figure 19:
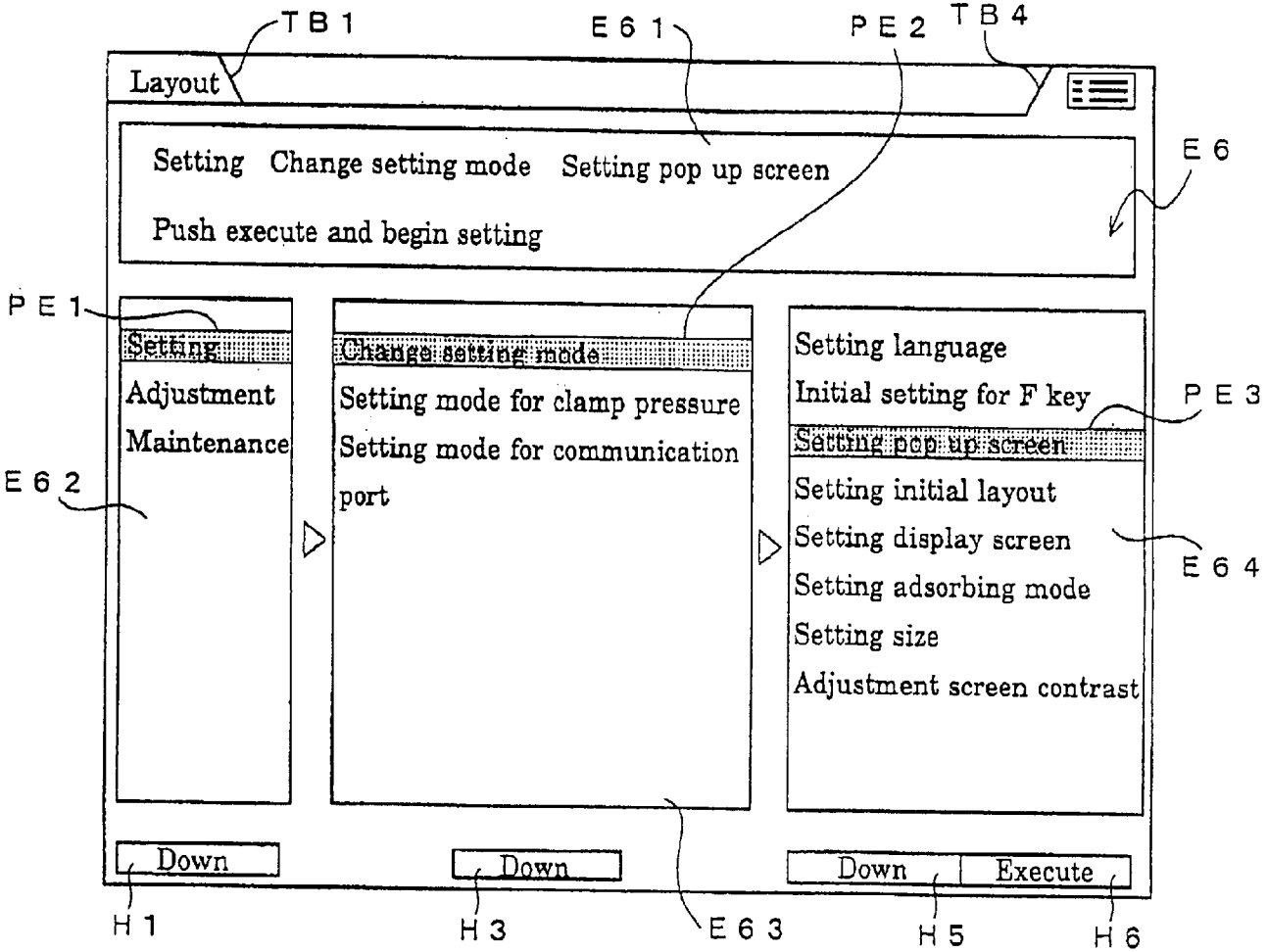
FIG. 19 is a front view of the liquid crystal display device displaying the detailed menu area in a state in which a pop-up menu display setting mode is selected.
Figure 20:
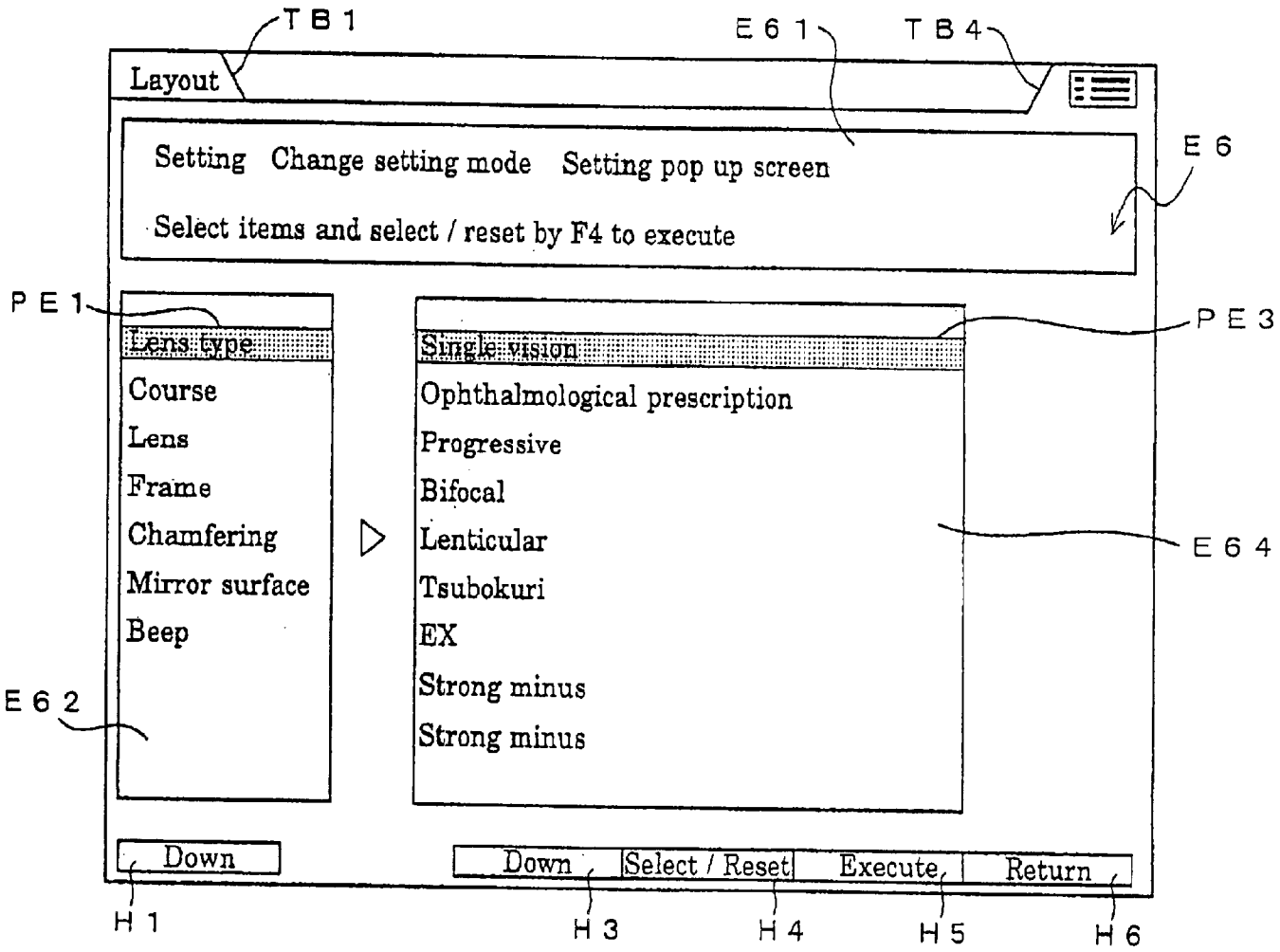
FIG. 20 is a front view of the liquid crystal display device showing a display screen of the detailed menu area in a detailed pop-up menu display setting mode.
Figure 21:
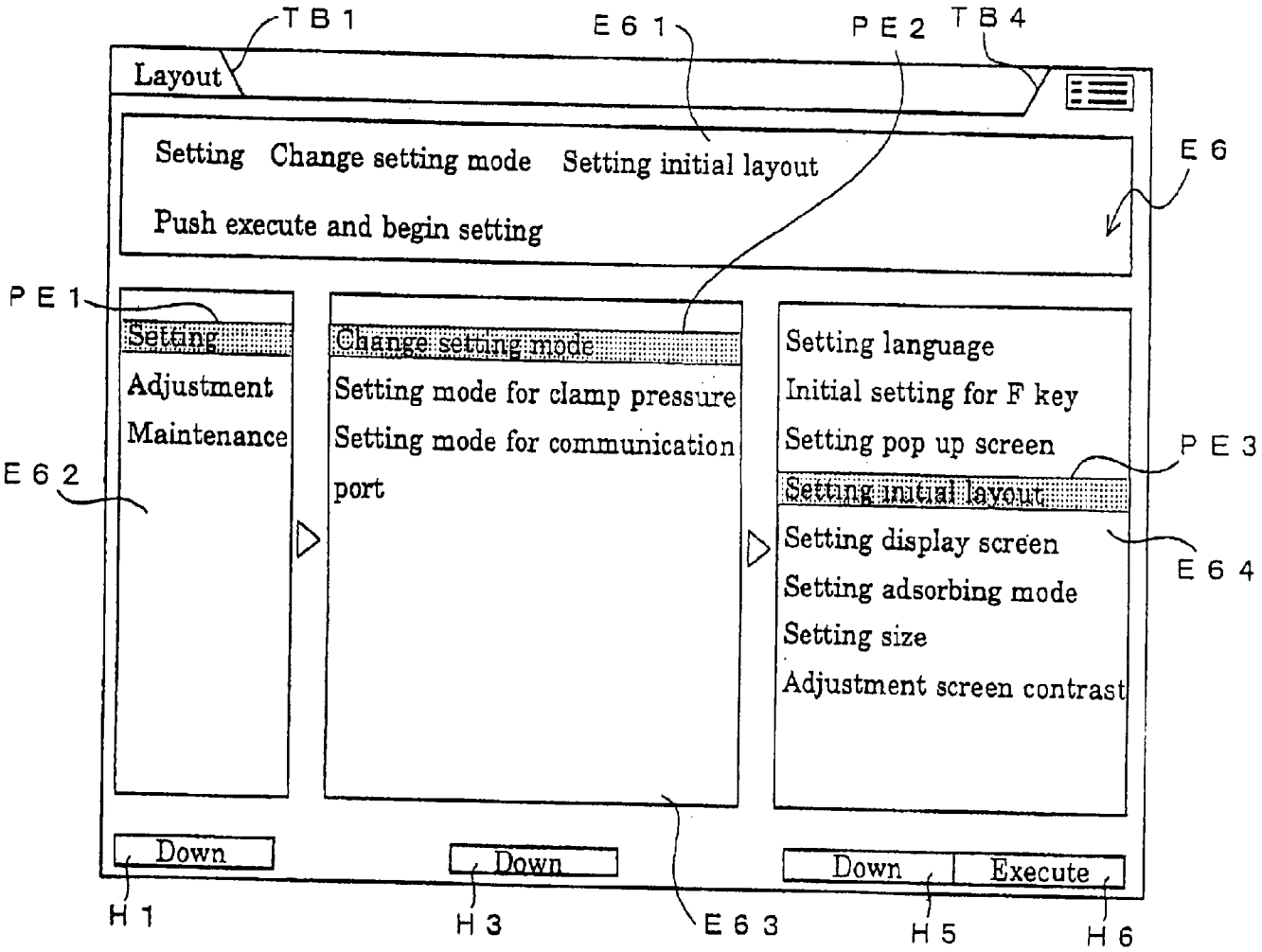
FIG. 21 is a front view of the liquid crystal display device displaying the detailed menu area in a state in which a layout default mode is selected.

In FIGS. 17, 19, and 21, a letter of "Down" is displayed on the function display part H5 similar to FIG. 15, and In FIGS. 17, 19, 21, 23 and 25, a letter of "Execution" is displayed on the function display part H6 similar to FIG. 15. Further, a letter of "Execution" is displayed on the function display part H5 in FIGS. 18, 20, 22, 24 and 26, and a letter of "Return" is displayed on the function display part H6.

Further, the operation for selecting the cursor-type pointers PE1–PE3 by operation of the function keys F1, F3 and F5 to execute them by the function key F6 or the like is similar thereafter and is sometimes omitted.

<Setting of Language>

Figure 16:
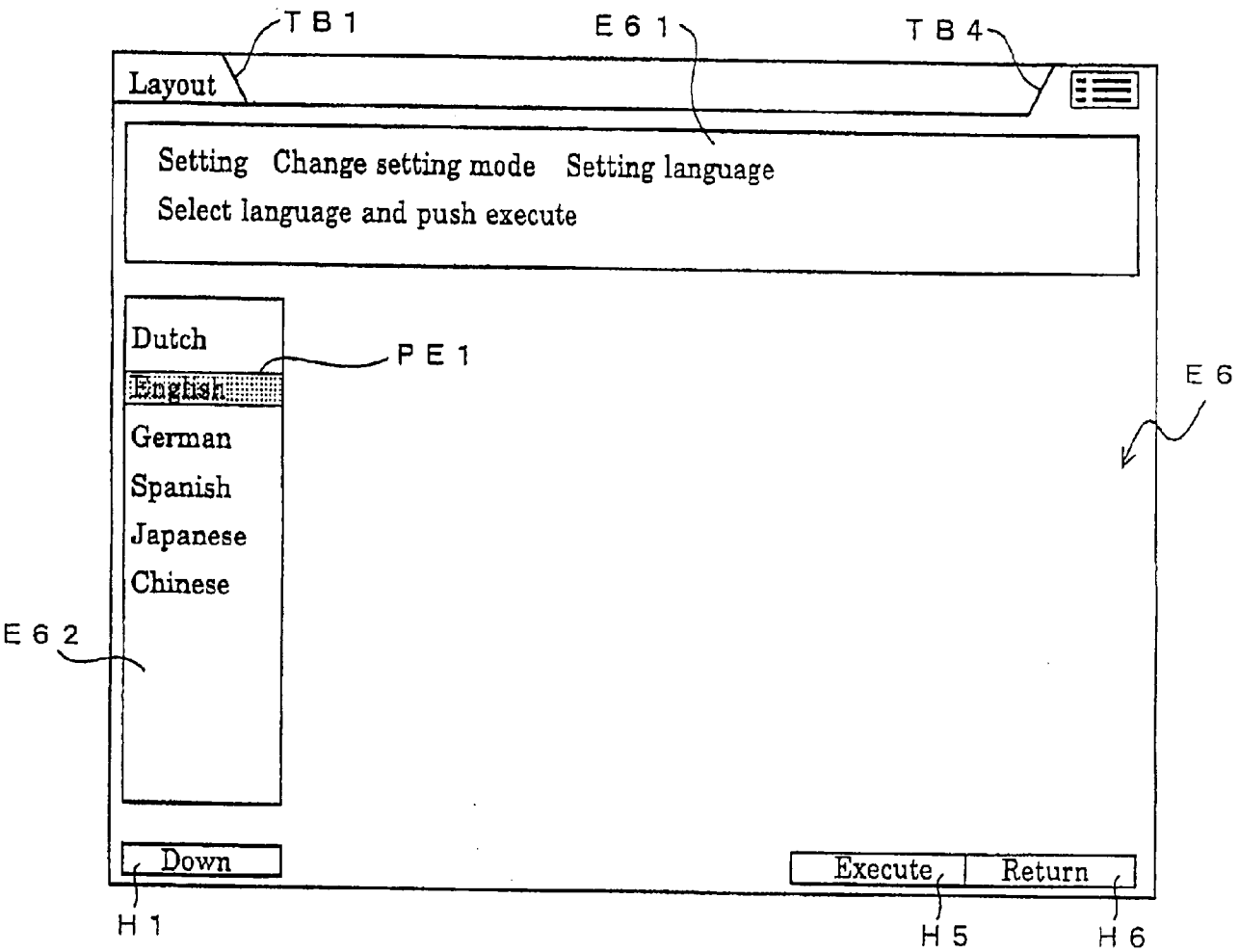
FIG. 16 is a front view of the liquid crystal display device displaying the detailed menu area in a language specification mode.

The cursor-type pointer PE3 of the third detail display area E64 shown in FIG. 15 is adjusted to "Setting of language" and selected (designated), and afterwards the function key F6 is depressed for execution, then a display of the detail menu display area E6 is switched as shown in FIG. 16. On the first detail display area E62 are displayed items with regard to languages (or country names) such as "Dutch", "English", "German", "Spanish", "Japanese", and "Chinese". Further, in FIG. 16, a letter of "Execution" is displayed on the function display part H5, and a letter of "Return" is displayed on the function display part H6.

For example, in a case where the present setting of FIG. 16 is "Japanese", when the cursor-type pointer PE3 is adjusted to "English" and selected (designated) of the first detail display area E62 and the function key F5 is depressed for execution (decision), switching of a message language is carried out so that languages displayed after next starting are switched to English. Country language messages are prepared by languages in accordance with a predetermined format. A user message such as an alarm message out of messages necessary corresponding to country messages is described, as a unit of one message, using characters such as a symbol, a letter, a Figure or the like that can be identified individually ever message. Thereby, in setting languages in the conventional lens grinding processing apparatus, work for switching corresponding to country languages is simplified to improve the working efficiency.

<Initial Setting of F Key>

The initial setting of F key is for the function keys F1–F6 in the control of lens grinding processing. By the initial setting of F key, a display of the function display parts H1–H6 is made as shown in FIGS. 34–43, FIGS. 48, 53, and 57.

The initial setting of F key is started by adjusting the cursor-type pointer PE3 of the third detail display area E64 shown in FIG. 15 to "Initial setting of F key" to select (designate), after which the function key F6 is depressed to execute (decide) "Initial setting of F key". Thereby, items of "Lens type", "Course", "Lens", "Frame", "Chamfer", "Mirror face", and "Beep sound" are displayed on the first detail display area E62 as shown in FIG. 18.

With this, on the second detail display area E63 are displayed set contents such as "Lens type", "Course", "Lens", "Frame", "Chamfer", "Mirror face", and "Beep sound" before setting changing as shown in FIG. 18. That is, in a case where as the set contents before setting changing, for example, "Lens type", "Course", "Lens", "Frame", "Chamfer", "Mirror face", and "Beep sound" are set to "Single vision", "Auto", "Nothing", "Metal", "Nothing", "Nothing", and "Nothing", respectively, "Single vision", "Auto", "Nothing", "Metal", "Nothing", "Nothing", and "Nothing" are displayed in that order on the second-detail display area E63.

Here, for example, in a case where in the second detail display area E63, "Single vision" is changed in setting to "Progressive", the indicator PE2 is adjusted to "Single vision". Thereby, the third detail display area E64 shown in FIG. 18 is displayed right next to the second detail display area E63. Moreover, on the third detail display area E64 are displayed items such as "Eye prescription", "Progressive", "Bifocar", "Lenticular", "Tsubokuri", "EX", "Strong minus", and "Strong minus".

Accordingly, "Lens type" is changed insetting to "Progressive" lens by the cursor-type pointer PE3 is adjusted to the item of "Progressive" that desired to be selected out of the items displayed in the third detail display area E64 to select "Progressive" after which the function key F5 is depressed for execution.

Here, the "EX" lens is a lens which is different in thickness of a lens edge (for example, a lens edge thickness of a lower half of an eye-lens is thin) in a predetermined area of a refractive surface; the "Strong minus" is a lens, which is one kind of Tsubokuri, in which a lens edge end of a rear refractive surface of a minus lens whose refractive degree is large (thick in an edge surface) is chamfered obliquely; and the "Strong minus" is a lens, which is one kind of Tsubokuri, in which a lens edge end of a rear refractive surface of a minus lens whose refractive degree is large (thick in an edge surface) is chamfered flatly, which are terms used generally in the field of spectacles.

Further, although not shown in the drawing, also in a case where "Course", "Lens", "Frame", "Chamfer", "Mirror face", and "Beep sound" other than "Lens type" are set, the indicator PE2 is adjusted to "Course", "Lens", "Frame", "Chamfer", "Mirror face", and "Beep sound" sequentially to perform execution whereby the following selection items are displayed on the third detail display area E64.

That is, when the indicator PE2 is adjusted to "Course" in the second detail display area E63, items such as "Auto", "Try", "Monitor", and the like are displayed on the third detail display area E64. Further, when the indicator PE2 is adjusted to "Lens" in the second detail display area E63, items such as "High-index", "Glass", "Polycarbonate", "Acrylic", "Nothing" and the like are displayed on the third detail display area E64.

Further, when the indicator PE2 is adjusted to "Frame" in the second detail display area E63, items such as "Metal", "Cell", "Plastic", "Optil", "Flat", "Grooving (small)", "Grooving (medium)", "Grooving (large)" and the like are displayed on the third detail display area E64. Here, the "Metal" means processing a lens adjusted to a metal frame; "Cell" means processing a lens adjusted to a cell frame, and "Flat" means perform flat processing.

Further, when the indicator PE2 is adjusted to "Chamfer" in the second detail display area E63, items such as "Nothing", "Small", "Medium", "Special", and the like are displayed on the third detail display area E64. Further, when the indicator PE2 is adjusted to "Mirror face" in the second detail display area E63, items such as "Presence", "Nothing", "Chamfer part mirror face", and the like are displayed on the third detail display area E64.

Further, when the indicator PE2 is adjusted to "Beep sound" in the second detail display area E63, items such as "Presence", "Nothing", and the like are displayed on the third detail display area E64.

Accordingly, at the initial setting time, "Lens type" is set to "Single vision" as described above, for example, "Course" is set to "Auto", "Lens" is set to "High-index", "Frame" is set to "Metal", "Chamfer" is set to "Small", and "Mirror face" is set to "Chamber part mirror face" whereby "Single vision" is displayed on the function display part H1 corresponding to a display of "Lens type", "Auto" is displayed on the function display part H2 corresponding to a display of "Course", "High-index" is displayed on the function display part H3 corresponding to a display of "Lens", "Metal" is displayed on the function display part H4 corresponding to a display of "Frame", "Small" is displayed on the function display part H5 corresponding to a display of "Chamfer", and "Chamfer part mirror face" is displayed on the function display part H6 corresponding to a display of "Mirror face".

<Setting of Pop-up Display>

When the cursor-type pointer PE3 of the third detail display area E64 shown in FIG. 15 is adjusted to "Setting of pop-up display" shown in FIG. 19 to select (designate), after which the function key F6 is depressed for execution, items of "Lens type", "Course", "Lens", "Frame", "Chamfer", "Mirror face", and "Beep sound" are displayed on the first detail display area E62 as shown in FIG. 20.

When the cursor-type pointer PE1 of the first detail display area E62 shown in FIG. 20 is adjusted to "Lens type" shown in FIG. 19 to select (designate), after which the function key F5 is depressed for execution, items of "Single vision", "Eye prescription", "Progressive", "Bifocal", "Lenticular", "Tsubokuri", "EX", "Strong minus", and "Strong minus"(before setting changing) set at present are displayed on the second detail display area E64 (displayed rightward of the second detail display area E63). With this display, a letter of "Selection/Release" is displayed on the function display part H4 corresponding to the function key F4.

In this state, in a case where a spectacles lens that is not often used out of spectacles lenses of "Bifocal", "Lenticular", "Tsubokuri", "EX", "Strong minus", and "Strong minus" is present, a worker can delete this spectacles lens by operation of the cursor-type pointer PE3 and the function key F4. For example, in a case where "EX", "Strong minus", and "Strong minus" out of "Bifocal", "Lenticular", "Tsubokuri", "EX", "Strong minus", and "Strong minus" are spectacles lenses that are not used often, the indicator pointer PE3 is adjusted to items of "EX", "Strong minus", and "Strong minus" sequentially and selected (designated) after which a command "Selection/Release" of the function display part H4 is executed by operation of the function key F4 whereby the "EX", "Strong minus", and "Strong minus" selected by the cursor-type pointer PE3 can be deleted sequentially. Thereby, in the pop-up display when the function key F1 is clicked described previously, the selected items of "Single vision", "Eye prescription", "Progressive", "Bifocal", "Lenticular", and "Tsubokuri" as shown in FIG. 12 are displayed.

Further, in a case where "Bifocal", "Lenticular", "Tsubokuri", and the like are not included in the pop-up display as shown in FIG. 12, the worker can add also "Bifocal" or "Tsubokuri". In this case, for example, in a case where the item of "Bifocal" is desired to be added, "Setting"→"Setting changing mode"→"Setting of pop-up display"→"Lens type" on the menu screen are selected sequentially, and the cursor-type pointer PE2 is adjusted to "Bifocal" and executed by the function key F5 whereby that is added, and the "Bifocal" can be also displayed in the pop-up display.

Thereby, the worker can add or delete the items displayed in the pop-up display according to his taste, leading to improve the efficiency of work often carried out normally. Further, in a case where out of items displayed according to the taste of the worker, the using frequency of an item used often, for example, an item of "Progressive" is many as compared with other items, the item of "Progressive" can be rearranged for display so that it can be displayed at the head in the pop-up display. Further, a learning function can be also provided so as to make the display at the head and the rearranging display according to the using frequency.

<Setting of Layout Initial Value>

Figure 22:
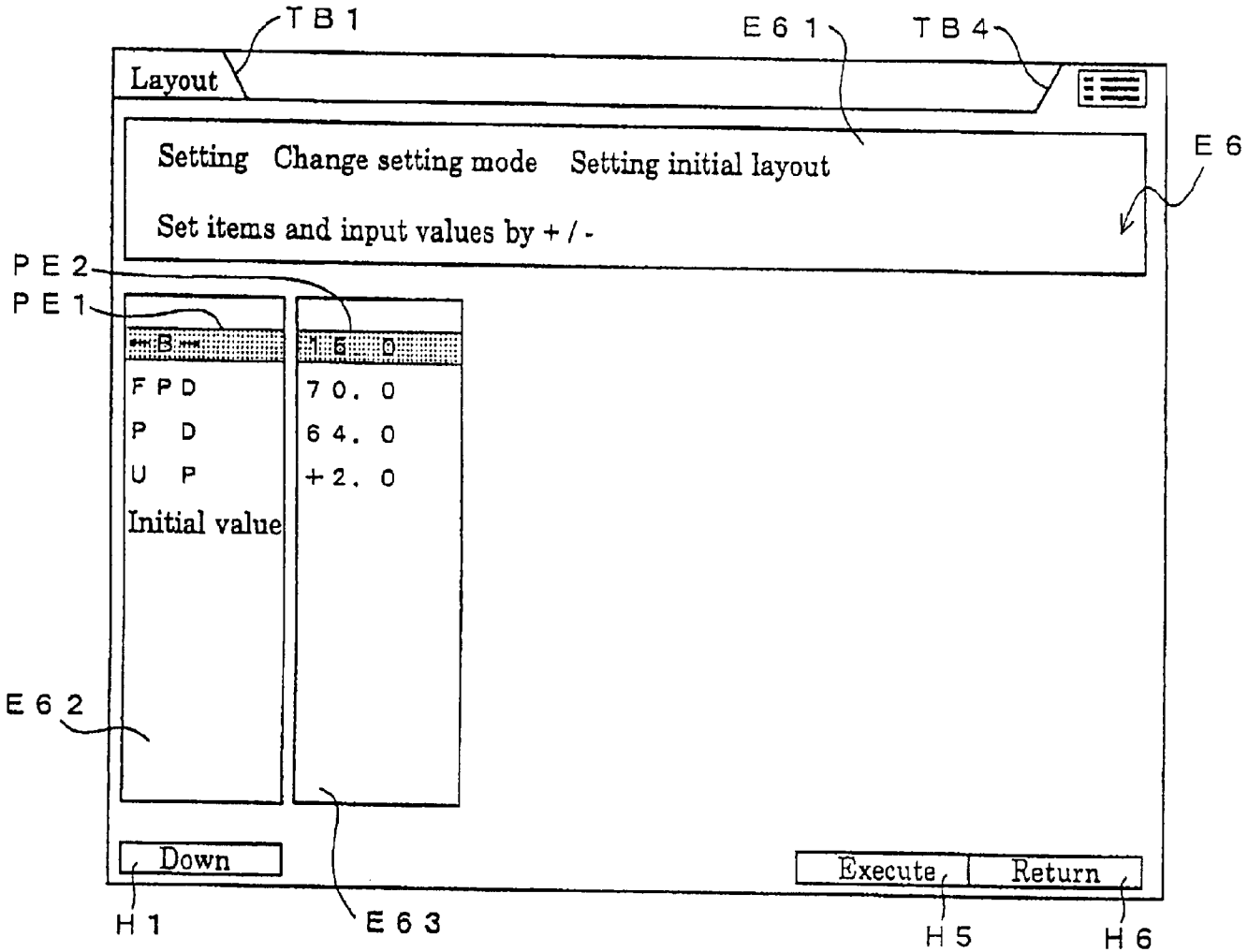
FIG. 22 is a front view of the liquid crystal display device displaying the detailed menu area in a detailed layout default mode.

When the cursor-type pointer PE3 of the third detail display area E64 of FIG. 15 is adjusted to "Setting of layout initial value" and selected (designated) after which the function key F6 is depressed for execution, items of "←B→", "FPD", "PD", "UP" and "Initial value" are displayed on the first detail display area E62 as shown in FIG. 22. At this time, numerical values of set contents "15.0", "70.0", "64.0", and "+2.0" before setting changing are displayed corresponding to "←B→", "FPD", "PD", "UP" and "Initial value" on the second detail display area E63. These numerical values can be changed in setting according to the taste of the worker with respect to the respective items.

For example, it is possible when layout data in the spectacles processing that an input of bridge width (B) of spectacles frame is changed in setting from an initial value of 15.0 mm to an initial value of 13.0, an input of geometrical center distance (FPD) of spectacles frame is changed in setting from an initial value of 70.0 mm to an initial value of 65.0, an input of pupil distance (PD) of a wearer of spectacles frame is changed in setting from an initial value of 64.0 mm to an initial value of 65.0, and an input of upper drawing value (UP) in a case where a position of a pupil of a wearer of spectacles is located upward from that of normal position is changed in setting from an initial value of +2.0 mm to an initial value of +1.0. This changing operation can be carried out by adjusting the indicator PE1 to the items of "←B→", "FPD", "FD", "UP" and "Initial value". Moving the indicator PE2 together with the indicator PE1, and operating, for example, the switch 7*d* of the operating panel 7 at the moved position.

When all the input of the initial value are finished, "Execution" is clicked whereby the setting changing of the initial value is completed.

It is noted that "Setting changing mode" includes, in addition thereto, "Setting of a display screen", "Setting of an adsorption mode", "Setting of size", and "Contrast adjustment of a screen", and the respective setting can be changed according to the taste of the worker.

The "Setting of a display screen" is an item for carrying out setting with regard to the screen display.

The "Setting of an adsorption mode" is enabled three types of setting, though, in a case of grinding spectacles lens, chucking the front and rear refractive surfaces of the lens by a lens rotating shaft, if the chucking position is a geometrical center position (a box center or a form core) of the spectacles frame, or if it is a pupil center (an optical core) of eyes of a spectacles wearer, or if two kinds of chucking positions are set to be changeable according to the lens kind.

Further, the "Setting of size" is an item for setting processing size in lens processing according to material of spectacles frame, cell, metal, optil (a soft frame out of cell frames), and flat (for example, a two-point frame).

The "Contrast adjustment of a screen" is an item for carrying out contrast adjustment of liquid crystal monitor.

<Adjustment>

Figure 23:
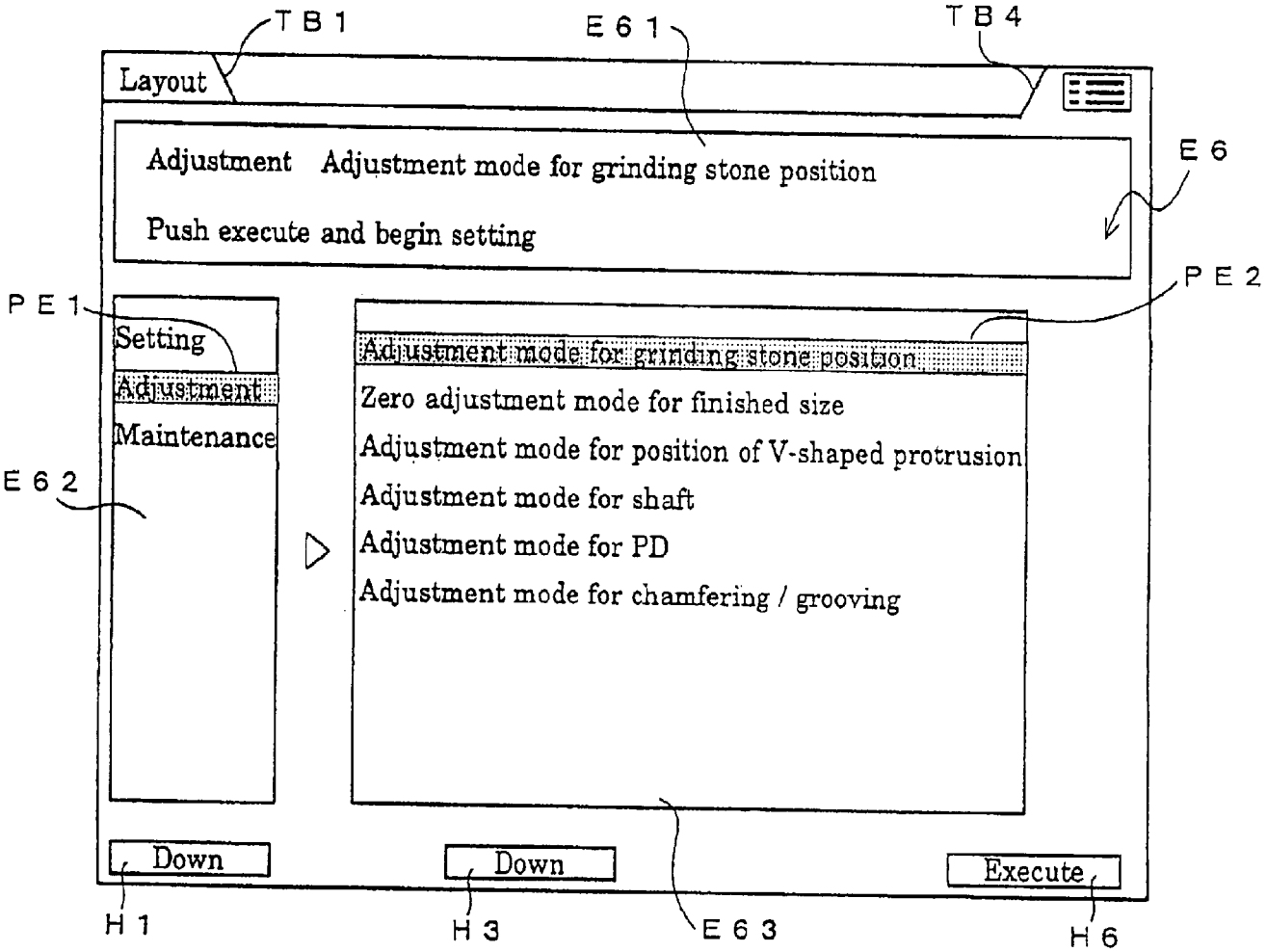
FIG. 23 is a front view of the liquid crystal display device displaying the detailed menu area in an adjustment mode.

When the cursor-type pointer PE1 is adjusted to "Setting of size" to select (decide) as shown in FIG. 23 from the first detail display area E62 shown in FIG. 15 after which the function key F6 is depressed to execute (decide), items of "Grindstone position correcting mode", "Zero adjustment mode of finish size", "Yagen position adjustment mode", "Shaft adjustment mode", "PD adjustment mode", and "Chamfer/grooving adjustment mode" are displayed on the second detail display area E63.

The "Grindstone position correcting mode" is an item for correcting and adjusting the center distance between the lens rotating shaft and the grindstone rotating shaft. The "Zero adjustment mode of finish size" is an item in which when a spectacles lens is processed in finish, for example, an error in processed size caused by an error or the like of a chucking position of the spectacles lens is adjusted. The "Yagen position adjustment mode" is an item for adjusting a Yagen crest position, for example. The "Shaft adjustment mode" is an item for shaft adjustment necessary for processing a spectacles lens so that for example, an astigmatism shaft of an eye of a spectacles wearer. The "PD adjustment mode" is an item for adjusting a PD error caused by a chucking error (adsorption error) of a spectacles lens. The "Chamfer/grooving adjustment mode" is an item for adjusting an error caused by the chamfer process/grooving process.

The setting or setting changing is similar to the setting of layout initial value described above, explanation of which is therefore omitted.

<Maintenance>

Figure 24:
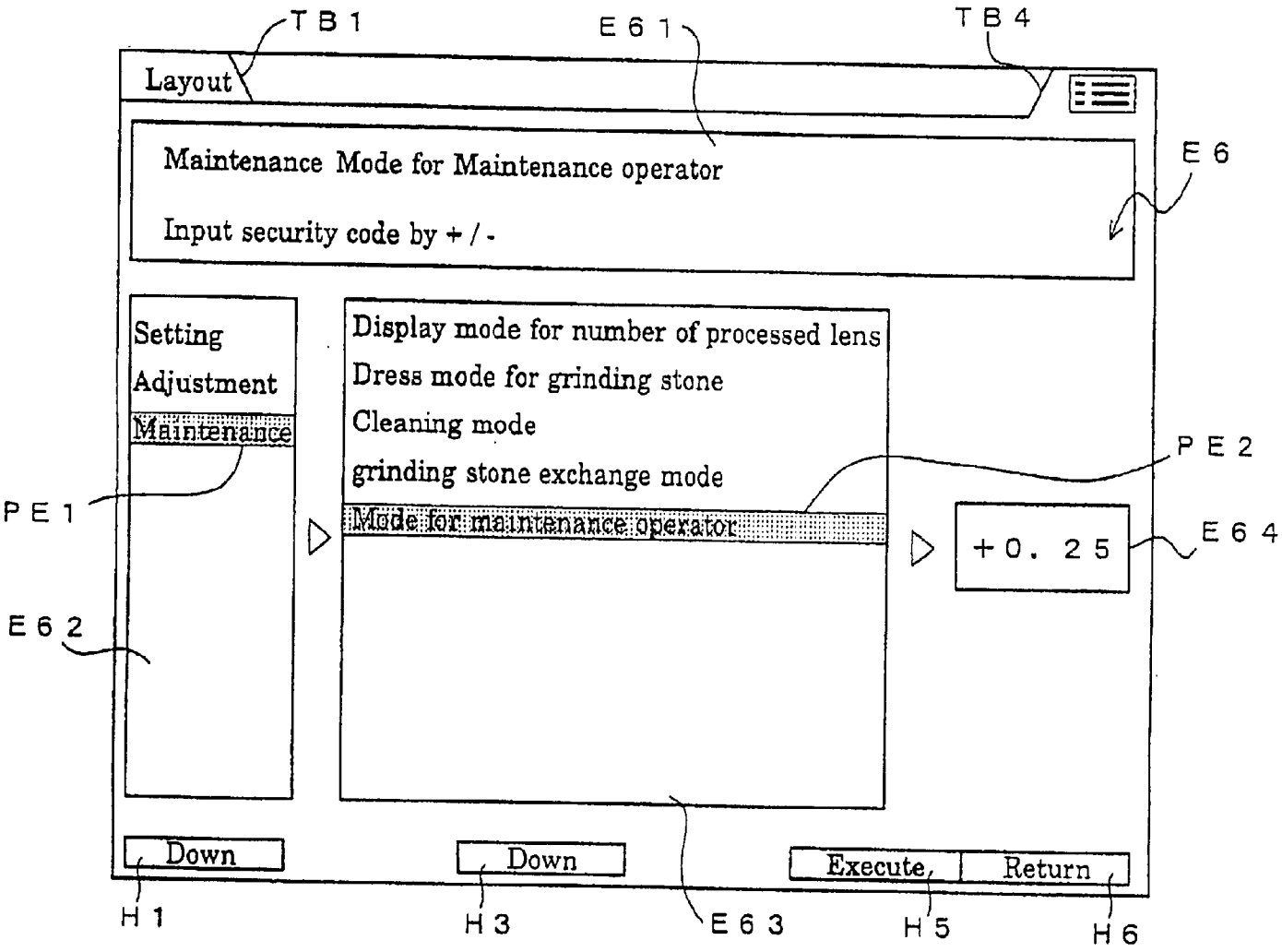
FIG. 24 is a front view of the liquid crystal display device displaying the detailed menu area in a maintaining mode.
Figure 25:
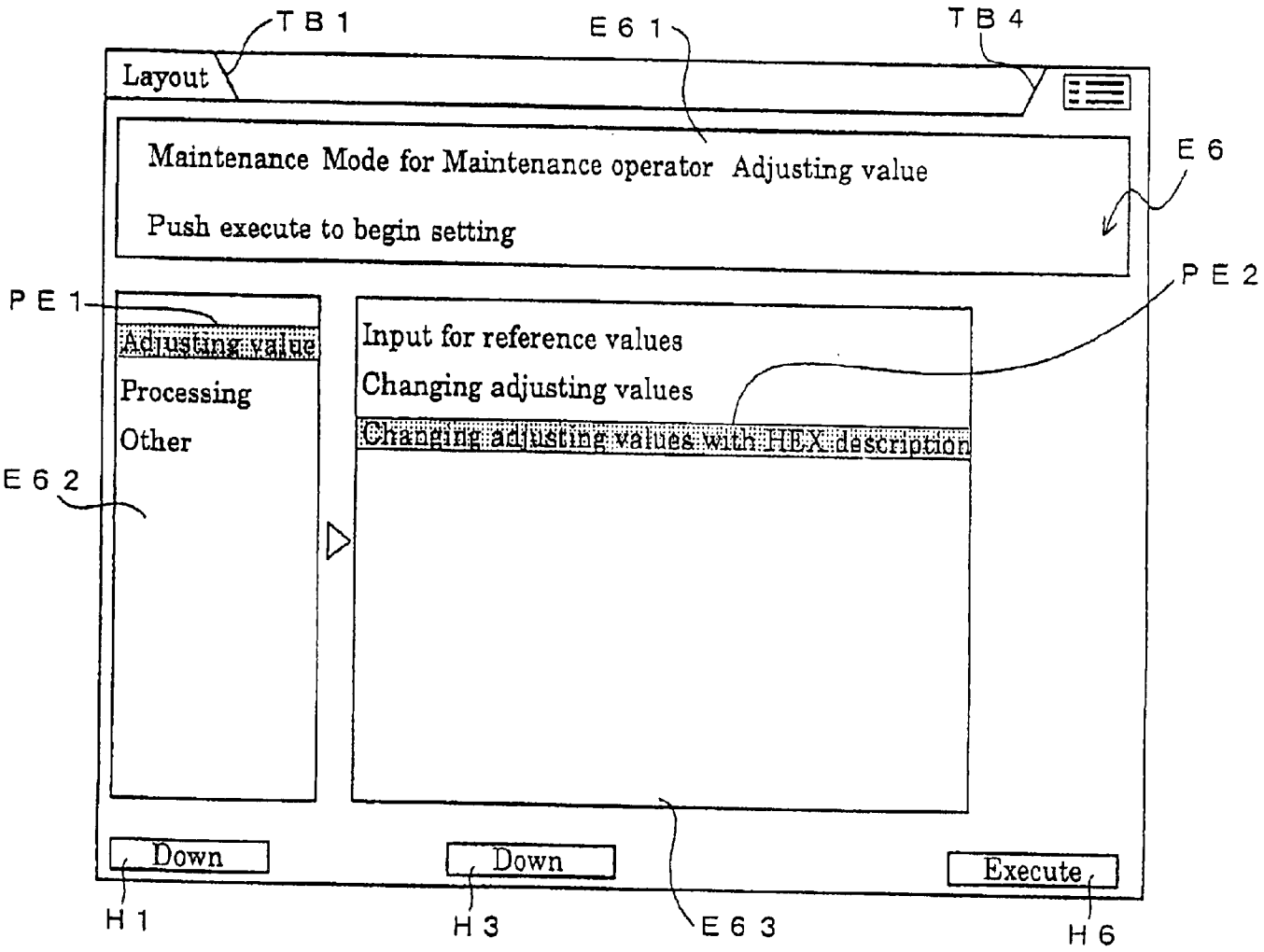
FIG. 25 is a front view of the liquid crystal display device displaying the detailed menu area in a maintenance operation mode.
Figure 26:
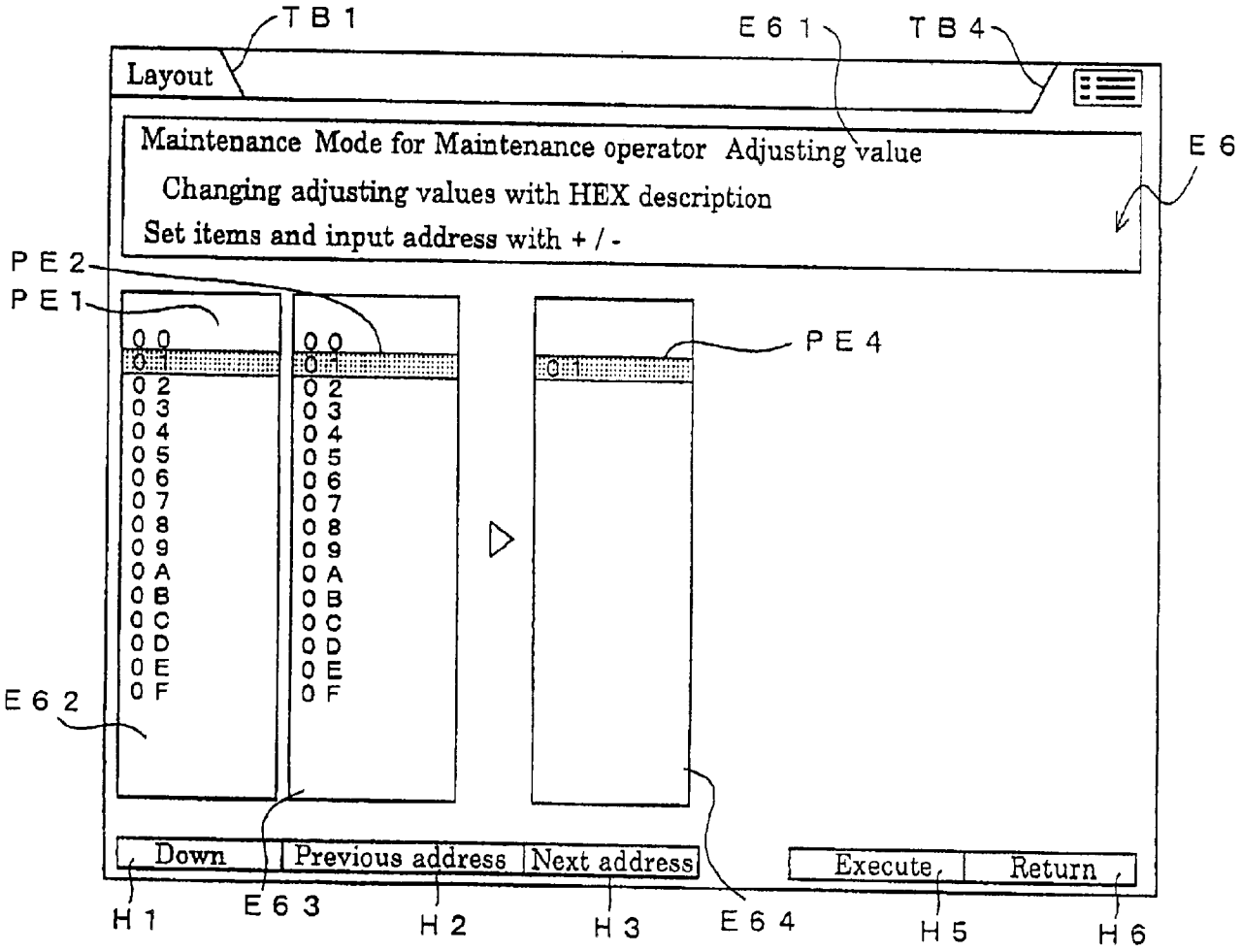
FIG. 26 is a front view of the liquid crystal display device displaying the detailed menu area in a detailed maintenance operation mode.

When the cursor-type pointer PE1 is adjusted to "Maintenance" to select (decide) as shown in FIG. 24 from the first detail display area E62 shown in FIG. 15 after which the function key F5 is depressed to execute (decide), items of "Process number display mode", "Grindstone dressing mode", "Cleaning mode", "Grindstone exchanging mode", and "Serviceman mode" are displayed on the second detail display area E63.

When for example, the cursor-type pointer PE2 is adjusted to the item of "Serviceman mode" to select (designate) after which the function key F5 is depressed to execute (decide), the third detail display area E64 displaying a code number is displayed. And, when a code number "+0.25" is input in the third detail display area E64 by a "−+" switch 7*d*, items of "Correction value", "Process" and "Other" are displayed on the first detail display area E62.

When from that state, for example, the cursor-type pointer PE1 is adjusted to the item of "Correction value" to select (designate) after which the function key F6 is depressed to execute (decide), items of "Reference value write", "Corrected value change", and "Corrected value change (HEX display)" are displayed on the second detail display area E63.

Further, for example, when the cursor-type pointer PE2 is adjusted to the item of "Corrected value change (HEX display)" of the second detail display area E63 to select (designate) after which the function key F6 is depressed to execute, '00-0F' is displayed on the second detail display area E63, and the third detail display area E64 is displayed.

And, when the function key F1 is operated to move the cursor-type pointer PE1, and the cursor-type pointer PE1 is adjusted to one of '00-0F' of the first detail display area E62, the cursor-type pointer PE2 is also moved together with the cursor-type pointer PE1 and adjusted to one of '00-0F' of the second detail display area E63, and the cursor-type pointer PE3 of the third detail display area E6 is also moved together with the cursor-type pointers PE1 and PE2. At this time, the cursor-type pointers PE1 and PE2 select the same one out of '00-0F', and the cursor-type pointer PE3 moves to the same position as the cursor-type pointers PE1 and PE2. The corrected value selected out of '00-0F' is displayed on the third detail display area E64 and can be changed by operation of the "−+" switch 7*d*. Thereby, smooth maintenance displaying the work in the serviceman mode in blanket can be carried out.

[Icon, Indicator (Indicator) and Display Area or the Like]

On the upper edge of the liquid crystal display device 8 are provided display parts of "Layout" tab TB1, "Processing" tab TB2, "Processed" tab TB3, and "Menu" tab TB4 as mentioned above, and on the lower edge of the liquid crystal display device 8 are provided the function display parts H1–H6 corresponding to the function keys F1–F6. On the portion of "Processing" of the tab TB2 are provided a plurality of indicators (indicators) C1–C12 for right use, and a plurality of indicators (indicators) C1–C12 for left use vertically corresponding to each other. The indicators C1–C12 are used as level display means for displaying a level according to the progressive circumstances of lens grinding work from the step for measuring a lens edge shape of a spectacles lens to the step for terminating the grinding process of a spectacles lens on the basis of the ball shape data.

Further, the liquid crystal display device 8 is provided with an icon display area E1 positioned downward of the indicators (indicators) C1–C12, juxtaposed to left and right a message display area (input type display means) E2 and a numerical value display area (input type display means) E3 positioned downward of the icon display area E1, and provided with a state display area (input type display means) E4 positioned downward of the display areas E2, E3. These display areas E1–E4 are designed as follows.

(i) Icon Display Area E1

Figure 27A:
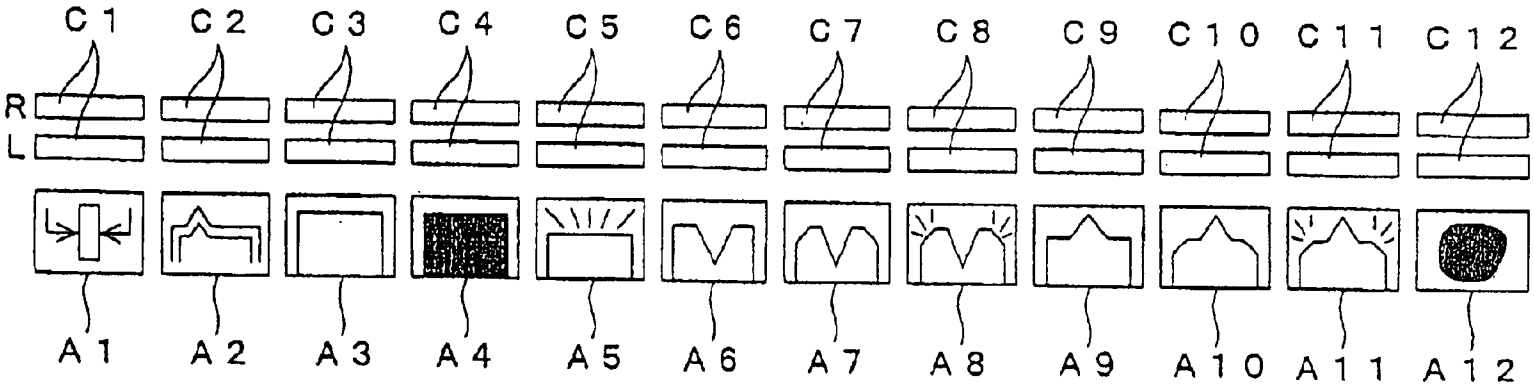
FIG. 27A is an enlarged explanatory view showing a relationship between icons and indicators.

Icon display area E1 is provided with icons A1–A12 as shown in FIG. 27A corresponding to the indicators C1–C12 of "Processing".

The icon A1 represents a state for measuring a lens edge shape of a spectacles lens on the basis of lens shape information (θi, ρi) as ball shape data. The icon A2 represents a state that a Yagen shape formed in a lens edge end of a spectacles lens. The icon A3 represents a state that a lens edge end is subjected to rough processing. The icon A4 represents a state that a lens edge end is subjected to finish processing. The icon A5 represents a state that a lens edge end is subjected to mirror face processing. The icon A6 represents a state that a lens edge end is subjected to Yagen grooving processing. The icon A7 represents a state that a lens edge end is subjected to Yagen grooving/chamfering processing. The icon A8 represents a state that a lens edge end is subjected to Yagen grooving/chamfering/mirror face processing. The icon A9 represents a state that a lens edge end is subjected to Yagen processing. The icon A10 represents a state that a lens edge end is subjected to Yagen grooving/chamfering processing. The icon A11 represents a state that a lens edge end is subjected to Yagen grooving/chamfering/mirror face processing. The icon A12 represents that grinding processing of a spectacles lens has finished.

It is noted that the icons A3–A11 comprises an icon group representative of a state for processing a lens edge end, and suitable icons can be used according to the function or the like of apparatus body (for example, such as an apparatus without mirror face processing means)

Further, patterns of the icons A1–A12 are not particularly limited as long as they are those by which an operator is able to easily recognize work contents such as processing kinds. Similarly, the work contents may be displayed in the form of a letter, and the work contents may be displayed in letter attaching to the icons A1–A12 displayed with patterns.

Incidentally, these icons A1–A12 are provided every lens grinding work. Moreover, The icons A1–A12 correspond by one to one to a plurality of indicators (indicators) C1–C12 provided on the "Processing" tab TB2 and lighted and displayed according to a series of progressive circumstances of the lens grinding work so that an operator is able to identify a series of progressive circumstances of lens grinding work.

Figure 29:
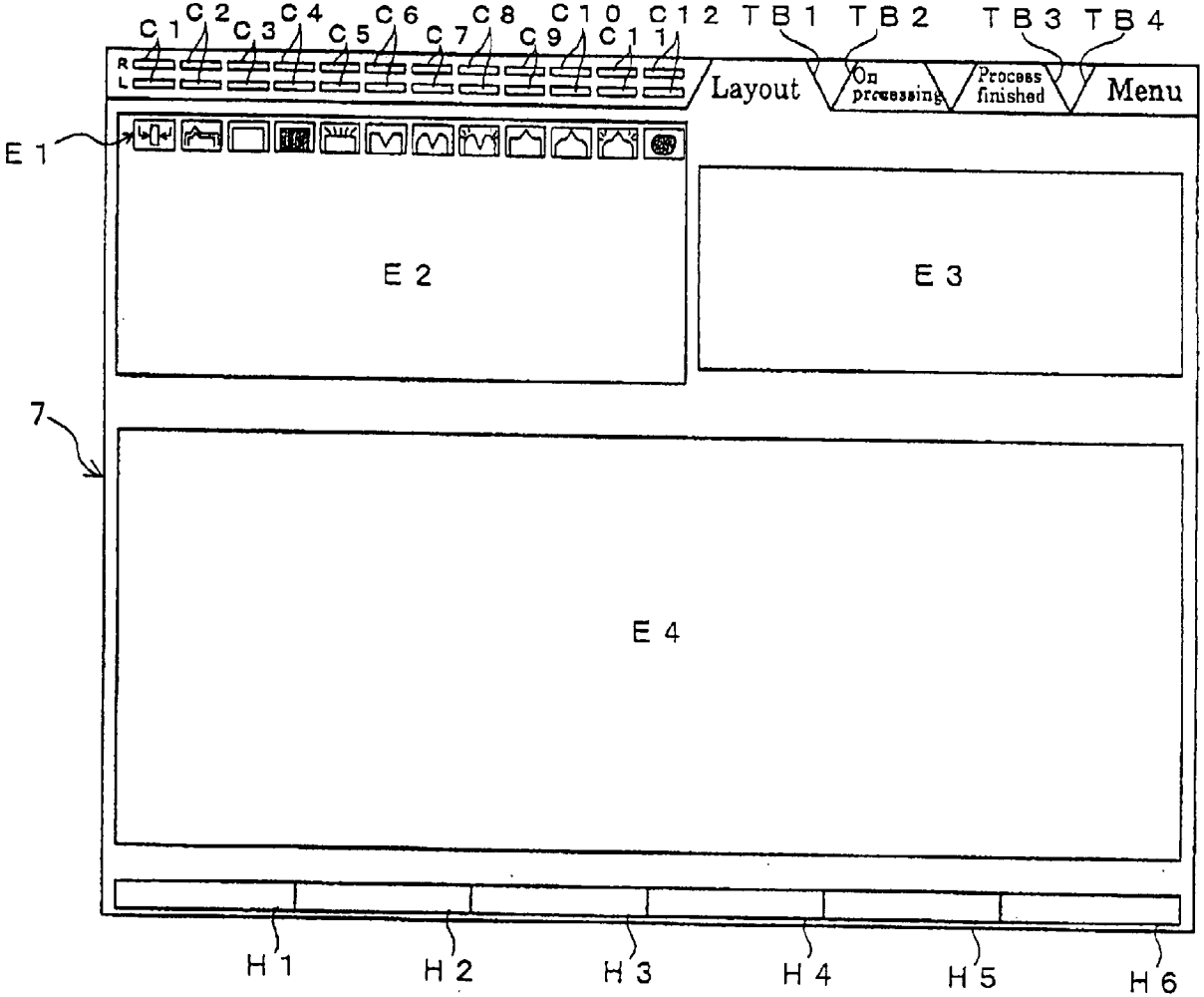
FIG. 29 is a front view of the liquid crystal display device showing a variation of icon position on the screen.

The indicators C1–C12 are provided separately in two upper and lower stages for a display of a right eye-lens progressive circumstances and a display of a left eye-lens progressive circumstances. However, only one stage may be provided, and a display for identifying the right eye-lens processing or the left eye-lens processing may be done separately. Further, The indicators C1–C12 may display always or as necessary in an area other than the "Processing" tab TB2, for example, a space portion where the tabs TB1–TB4 is moved to one side, or may display adjacently vertically. Likewise, as shown in FIG. 29, the icons A1–A12 may be displayed upwardly of the message display area E2.

With respect to the processing not set by a worker, it is possible that the icons for expressing the processing visually and symbolically and the indicators (indicators) C1–C12 juxtaposed to the icons A1–A12 may not be displayed.

Figure 27B:
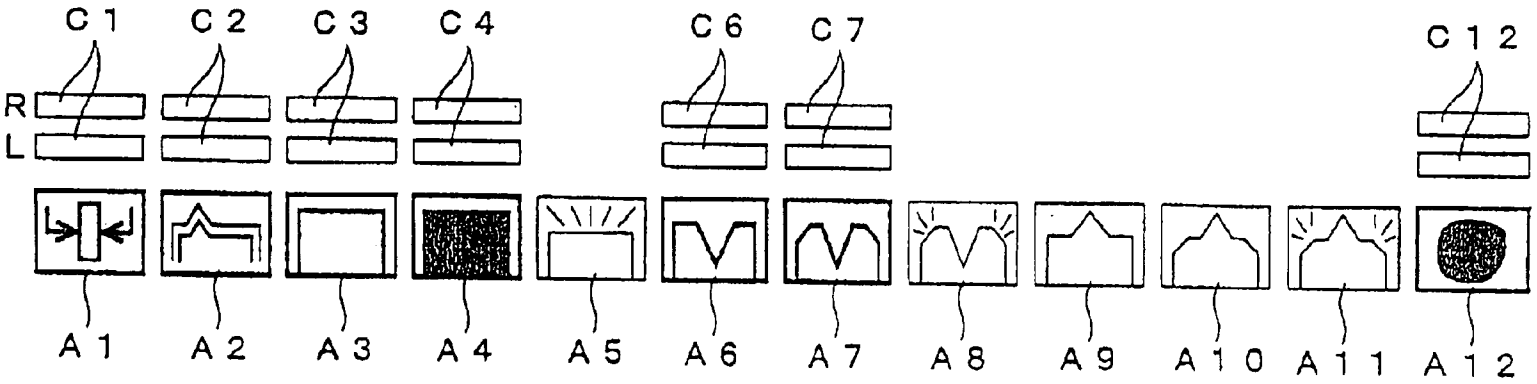
FIG. 27B is an enlarged explanatory view showing a relationship between icons and indicators in accordance with a processing steps.
Figure 28:
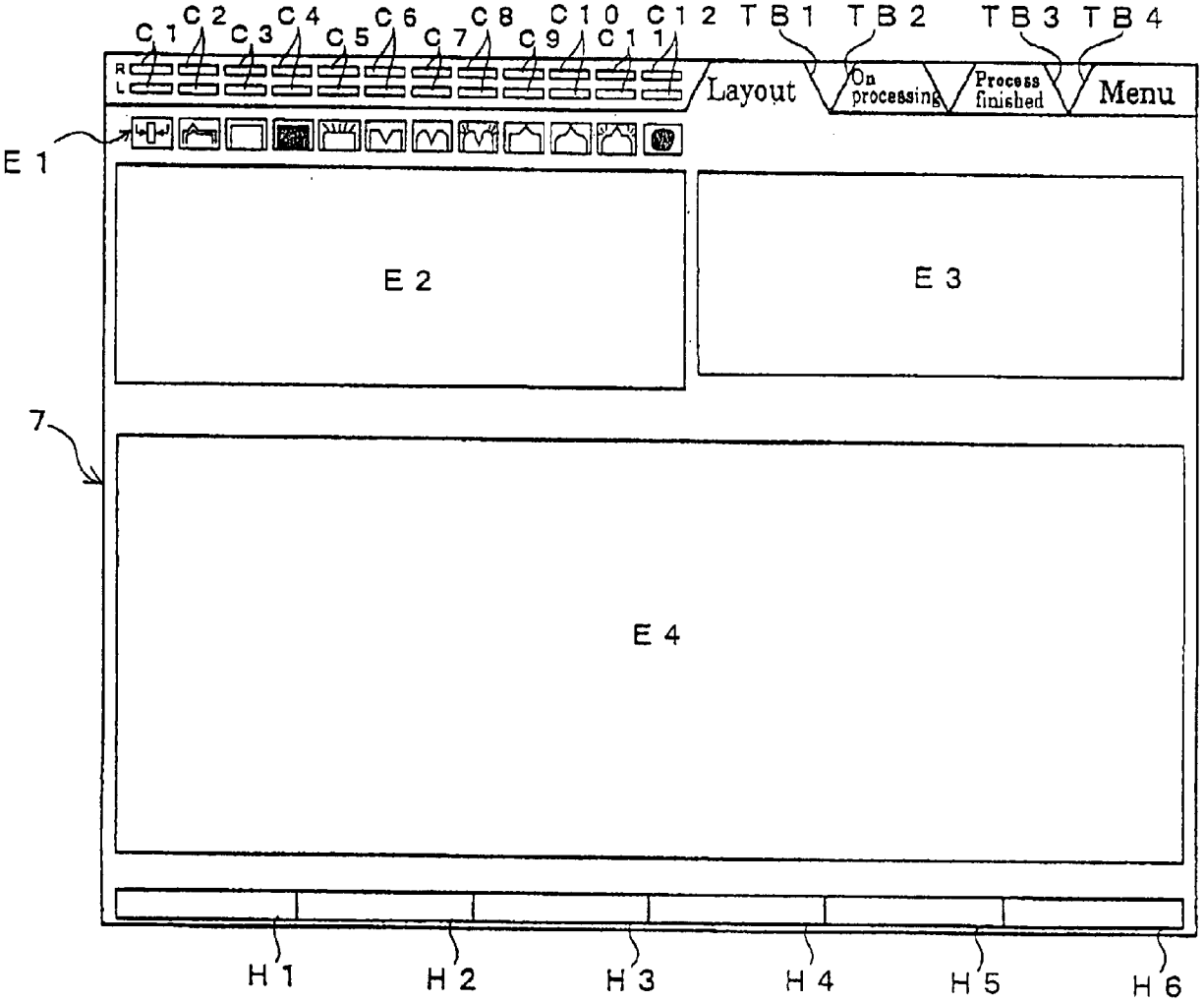
FIG. 28 is a front view of the liquid crystal display device showing a variation of indicator position on the screen.

For example, as shown in FIG. 27(B), in a case where the processing of the lens edge end of the spectacles lens is replaced by the Yagen grooving/chamfer processing, and the mirror processing is not carried out, the display state of the icons A1–A12 is set whereby facilitating confirmation of the setting circumstances.

That is, in a case where the processing of the lens edge end of the spectacles lens is replaced by the Yagen grooving/chamfer processing, and the mirror processing is not carried out, display color of the icon A5 for mirror processing and the icons A8–A11 in connection with the Yagen (crest) processing is made to be gray or color which is relatively hard to recognize such as void or size (in the Figure, displayed by a fine line). At this time, display color of other icons A1–A4 and the icons A6, A7 and A12 actually subjected to processing is made to be the same color as layout background color or other bright color that can be recognized relatively easily or size (in the Figure, displayed by thick line). By doing so, confirmation of setting circumstances becomes easy.

Likewise, the indicator C5 corresponding to the icons A8–A11 not subjected to processing and the indicators C8–C11 are not displayed to improve recognizing properties. It is noted that similarly to the icon display, size of frames of the indicators C5, C8–C11 can be displayed to be thinner than that of frames of other indicators C1–C4 and indicators C6, C7 and C12. It is noted that more detailed display examples in the setting environments and using environments of these icons A1–A12 and indicators (indicators) C1–C12 will be described later (see FIGS. 60–63).

(ii) Message Display Area E2

Figure 30:
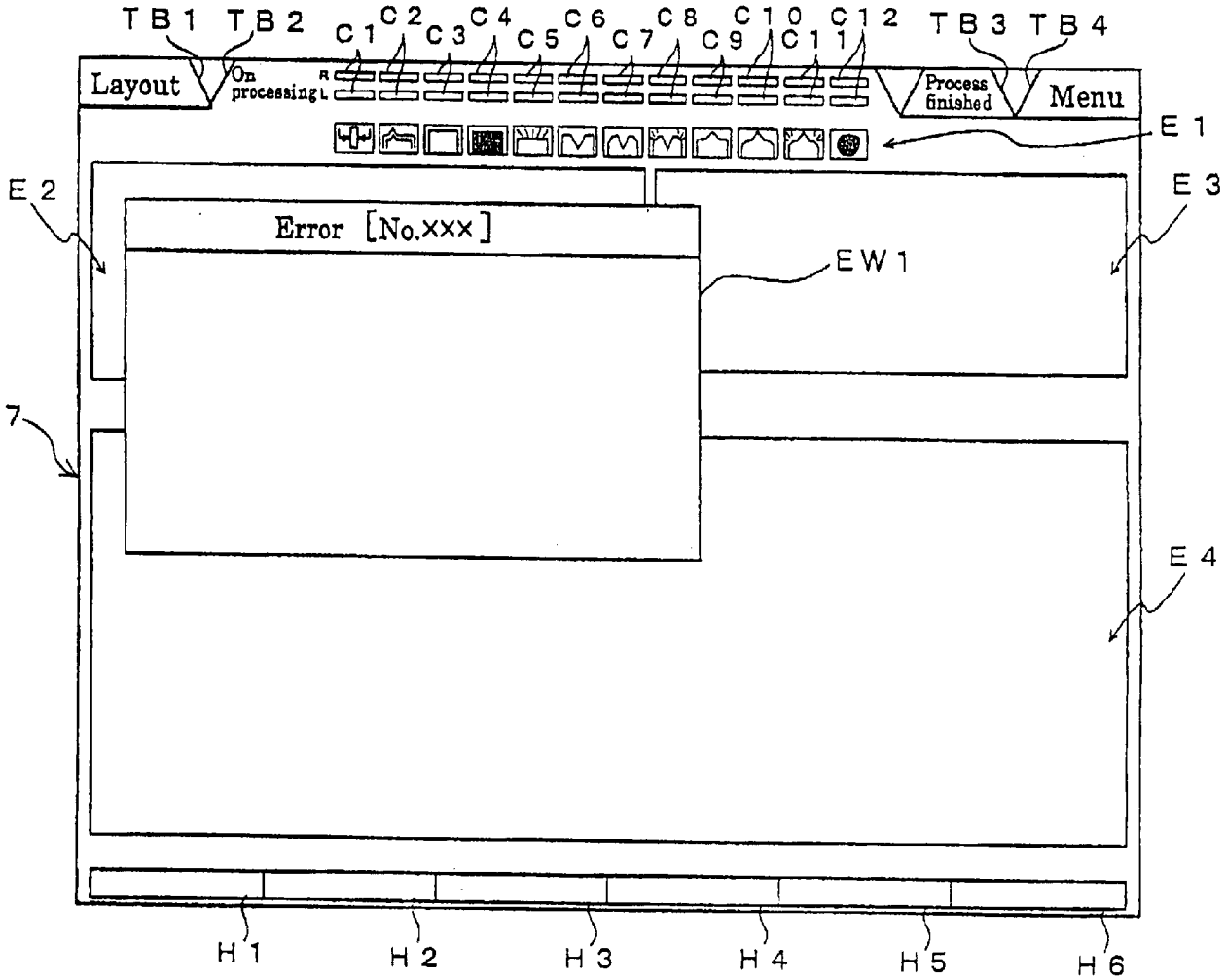
FIG. 30 is a front view of the liquid crystal display device showing a variation of an error indication.
Figure 34:
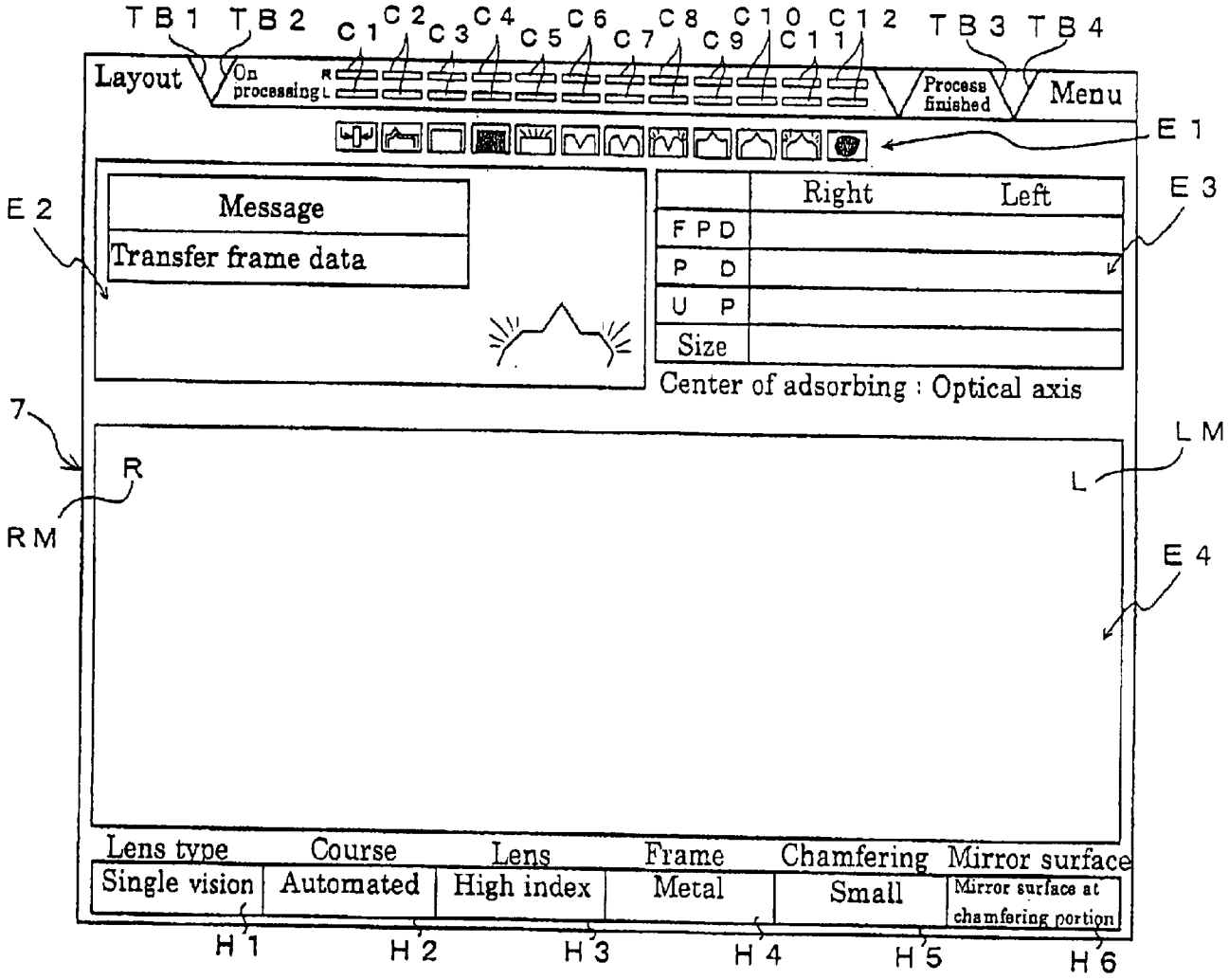
FIG. 34 is a front view of the liquid crystal display device displaying an initial state of the layout setting mode.

In the message display area E2 are displayed various error messages and alarm messages according to states. In a case of alarm messages where a breakage of parts in apparatus or a breakage of a lens to be processed is possibly present, a message can be also displayed beyond an area other than the message display area E2 so that an operator may easily recognize an error display part EW1, as shown in FIG. 30.

(iii) Numerical Value Display Area E3

In the numerical value display area (input type display means) E3 are displayed different contents at the time of inputting layout data, at the time of initial setting and at the time of inputting monitor data.

In the numerical value display area E3 are displayed, at the time of Inputting layout data, geometrical center distance (FPD value) of left and right lens frames of a spectacles frame as shown in FIG. 31, pupil distance (PD value) of eyes of a spectacles wearer, vertical direction component UP value (or H1p value) of a drawing amount which is a difference between FPD value and PD value, and items of processing size adjustment.

Further, in the numerical value display area E3 are displayed, at the time of initial setting, an adsorption center of processed lens in addition to FPD, PD, UP and size as shown in FIG. 32.

Further, in the numerical value display area E3 are displayed, at the time of inputting monitor data, values in connection with dimensions concerning chamfer processing or mirror face processing as secondary processing of spectacles lens, as shown in FIG. 33.

In a case where in the lens type, a kind of "Single vision", "Eye prescription", "Lenticular", "Tsubokuri", "Progressive", and "Bifocal" is selected, and numerical values are input in accordance with the input systems after which the Yagen top locus (Yagen top position) is obtained according to the spectacles lenses, the Yagen top locus has been heretofore obtained over the whole lens edge using a ratio Yagen system (a system for dividing the lens edge surface at a predetermined rate to obtain a Yagen top position) in the same way.

Therefore, in a case of a spectacles lens such that the size of a lens edge thickness differs according to the radius vector direction such as an EX lens, since the Yagen top position is changed on the basis of the lens edge thickness in the radius vector direction such that the lens edge thickness becomes small, there is a problem that the Yagen top locus cannot be depicted smoothly. Therefore, the worker repeats trial and error how the Yagen top locus is smoothly depicted adequately while suitably selecting if the Yagen top locus is provided by the ratio Yagen system according to the kind of lenses, or if the Yagen top locus is provided by a spherical Yagen system (a system for obtaining the Yagen top position by calculation in consideration that the Yagen top locus is on a spherical surface.

So, in the present apparatus, the conventional method for calculating the Yagen top locus, in which the Yagen top locus is obtained by the ratio Yagen system in the same way, or the spherical Yagen system is suitably employed, or the trial and error is repeated, as described above, is revised whereby the Yagen top locus is obtained.

That is, in the present apparatus, a computing method is divided in advance according to the lens type and the lens edge data so as to relieve labor of the worker repeating the trial and error. To this end, the present apparatus employs:

(1) In case of "Single vision" lens, a calculation method of the spherical Yagen system
(2) In case of "Eye prescription", "Lenticular", and "Tsubokuri" lenses, a calculation method of the spherical Yagen system
(3) In case of "Progressive" lens, a calculation method of the ratio Yagen system, and in case of "Bifocal" lens, a calculation method of the spherical Yagen system
(4) In case of EX lens, a Yagen top locus calculation method for obtaining the Yagen top locus by a calculation method of the spherical Yagen system (note that a part includes a Yagen tilt (a method for tilting the Yagen top locus about a predetermined radius vector information position or a shaft))

(iv) State Display Area E4

In the state display area E4 are displayed a layout image of spectacles lenses for a right eye and a left eye, a Yagen shape formed in the intermediate (suitable) lens peripheral edge other than maximum, minimum, maximum and minimum of spectacles lens, a lens side shape with the peripheral edge viewed from the side, or a schematic view according to actual processing state.

[Display State of a Liquid Crystal Display Device 8 at the Time of Layout]

<Immediately After Start of System>

When a main power supply (not shown) provided in the lens grinding processing apparatus 2 is turned on to start the system, there assumes a state that the "Layout" tab TB1 is selected, and "Processing" tab TB2 and "Processing" tab TB3 are not displayed but "Menu" tab TB4 is displayed.

Further, in the starting state that selects "Layout" tab TB1, the icon display area E1 is not displayed, but the message display area E2, the numerical value display area E3 and the state display area E4 are displayed. In the message display area E2 is displayed a message such as "Please transfer data of the frame". This message is a message for requesting a transfer of lens shape information (θi, ρi) of the spectacles frame F read by he frame shape measuring apparatus 1, that is, a message for urging operation of "Data request" switch 7*c*.

Accordingly, in the starting state that the transfer of data is not effected, those relating to concrete processing such as numerical values are not displayed in the numerical display area E3 and the state display area E4.

Further, in he function display parts H1–H6, a default state (or a detail mode stored in a data memory 42 described later in the previously using state) is displayed, and thereabove, "Lens type", "Course", "Lens", "Frame", "Chamfer" and "Mirror face" such as modes are displayed.

<Immediately After Requesting Data>

Figure 35:
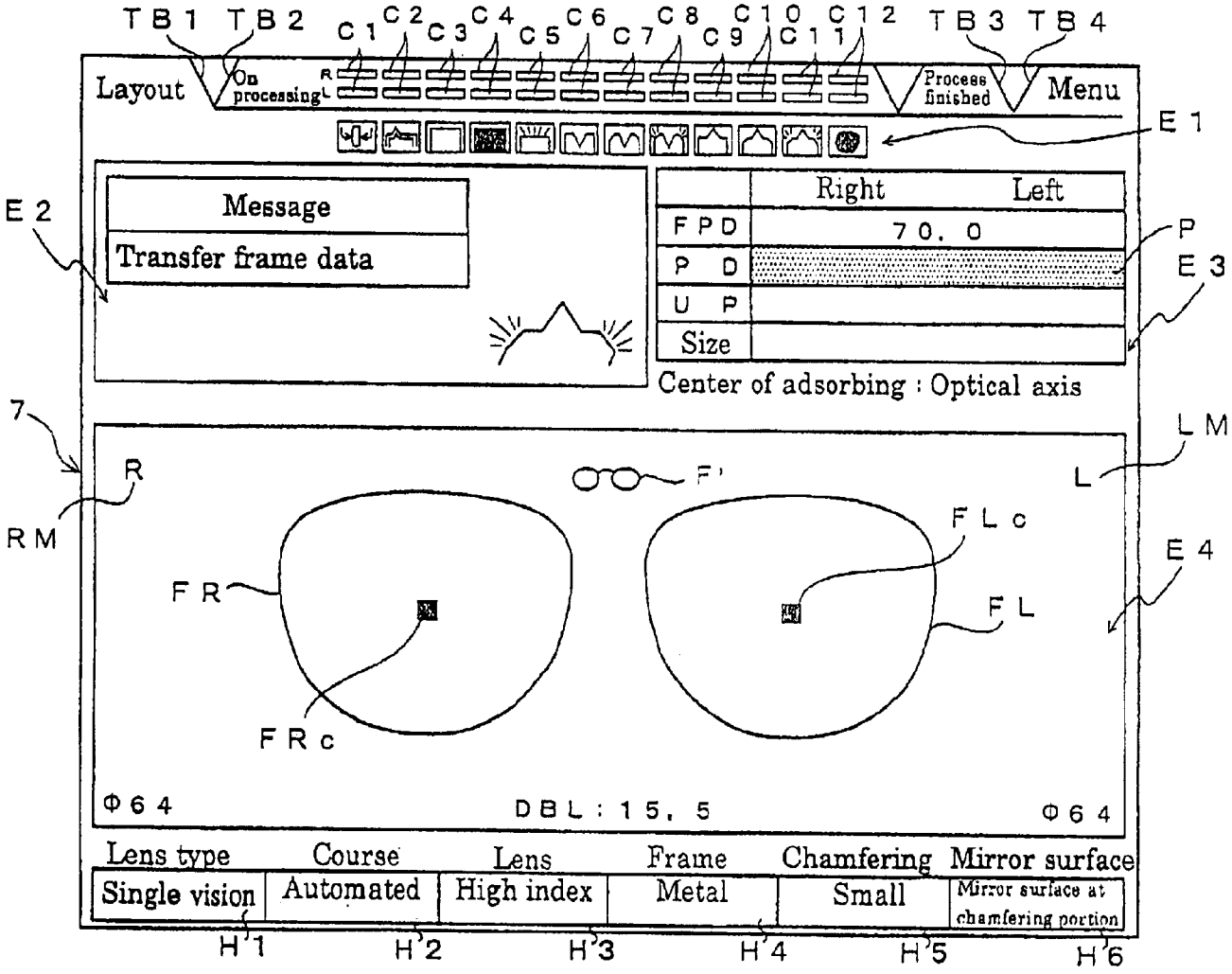
FIG. 35 is a front view of the liquid crystal display device showing a display screen after measurement data has been received from the lens frame shape measuring apparatus.

Next, when the "Data request" switch 7*c* is operated to transfer data from the frame shape measuring apparatus 1 to the lens grinding processing apparatus 2, the following are displayed in the display areas E2, E3, and E4 as shown in FIG. 35.

That is, in the message display area E2 is displayed a layout setting message such as "Please set layout data". Further, a numerical value (for example, "70.0") transferred to the column of "FPD" of the numerical value display area E3, and a cursor-type pointer P is displayed in the column of "PD".

Further, in the state display area E4 are displayed a right eye mark RM and a left eye mark LM, a frame shape FR for a right eye and a frame shape FL for a left eye, geometrical center marks FRc and FLc, the whole shape F' of spectacles frame F, diameters of left and right green lenses (for example, "ϕ64"), "DBL" which is a bridge width (clearance between left and right frames) and its numerical value (for example, "ϕ15.5"). The numerical value of "FPD" is calculated from DBL and the ball width.

<Completion of Layout Setting>

Here, in the column of "PD" of the numerical value display area E3 is positioned the cursor-type pointer P as described above. By pressing a "▽" switch from that state, an initial value set in the column of "PD" where the cursor-type pointer P is positioned is displayed. This numerical value is changed by operating the "−+" switch 7*d*, and after the change (or in the state of the initial value without change), by pressing the "▽" switch, the cursor-type pointer P is moved to the column of "UP". Similarly, by operating the "▽" switch 7*e* and the "−+" switch 7*d*, "UP" value and "Size" value are set.

Figure 36:
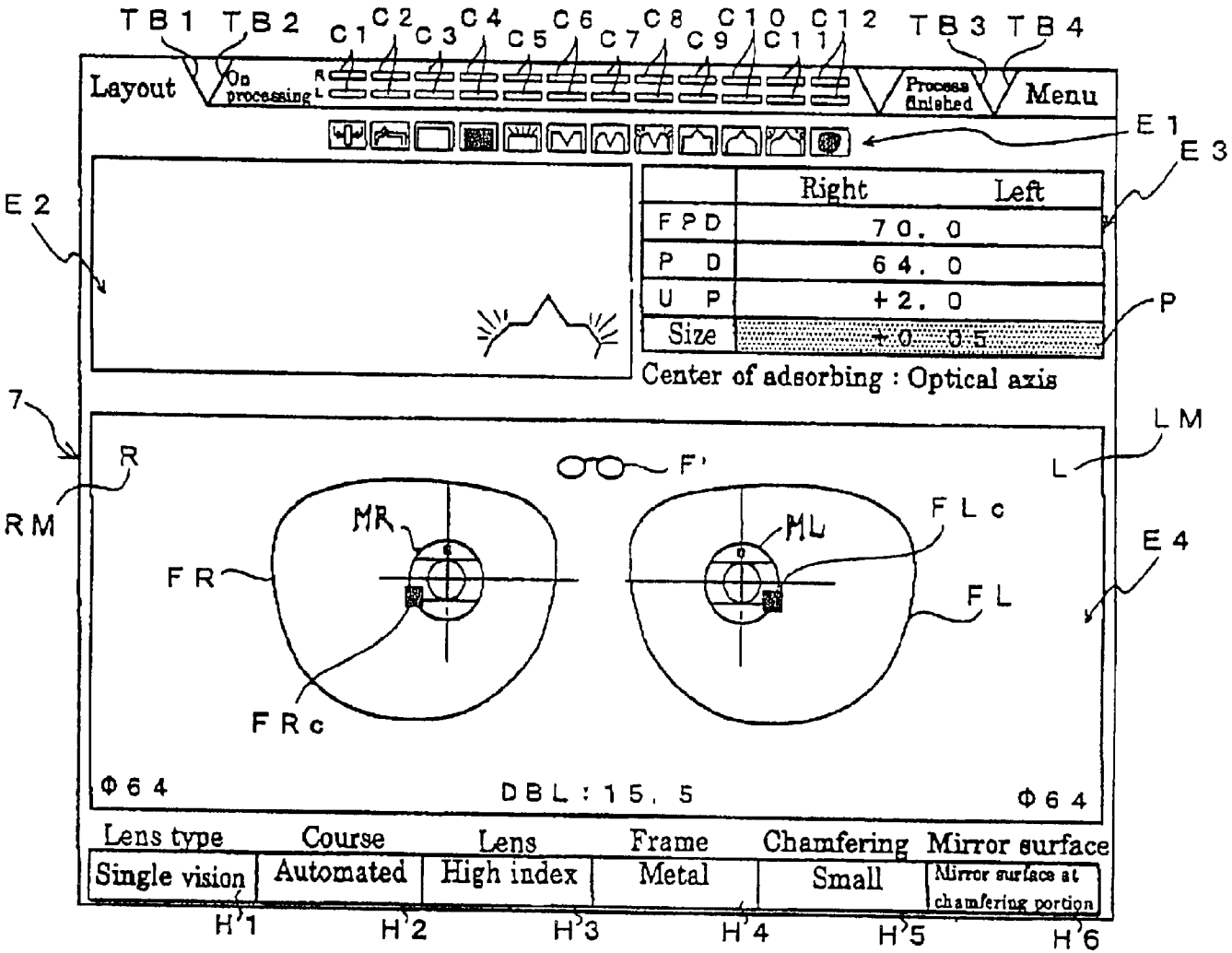
FIG. 36 is a front view of the liquid crystal display device with a screen display for setting/modifying numerical values after the measurement data is received.

When various values of the numerical value display area E3 are input and displayed in a manner as described, the following display is made in the state display area E4 as shown in FIG. 36. That is, in the state display area E4 are displayed adsorption cup marks MR, ML for holding a green lens for grinding processing positioned internally of a right eye mark RM and a left eye mark LM, a frame shape FR for a right eye and a frame shape FL for a left eye, geometrical center marks FRc and FLc, and the frame shape FR for a right eye and the frame shape FL for a left eye. The icons A1–A12 for processing course portion according to the detail mode setting with the operation of the function keys F1–F6 are displayed downward of the state display area E4. For example, in a case where the chamfer processing is not carried out, the icons A7–A10 are not displayed, and in a case where even if the chamfer processing is carried out, the mirror face processing of the chamfer part is not carried out, the icons A9 and A10 are not displayed.

Further, it may be set so that the indicators (C1–C12) are not displayed corresponding to the icons (A1–A12) not displayed.

For example, in a case where the chamfer processing is not carried out, the icons A7–A10 not displayed, the indicators (indicators) C7–C10 corresponding adjusting thereto are not displayed in both upper and lower stages. Further, in a case where even if the chamfer processing is carried out, the mirror face processing of the chamfer surface is not carried out, the icons A9 and A10 are not displayed, and the indicators (indicators) C9 and C10 corresponding adjusting thereto are not displayed in both upper and lower stages.

Further, when the "▽" switch 7*e* is depressed after setting the numerical value in the "Size" column, the cursor-type pointer P is returned to the column of "FPD" again, and so, resetting of numerical values is enabled.

<Other Displays of Layout>

(Case of One Eye)

Figure 37:
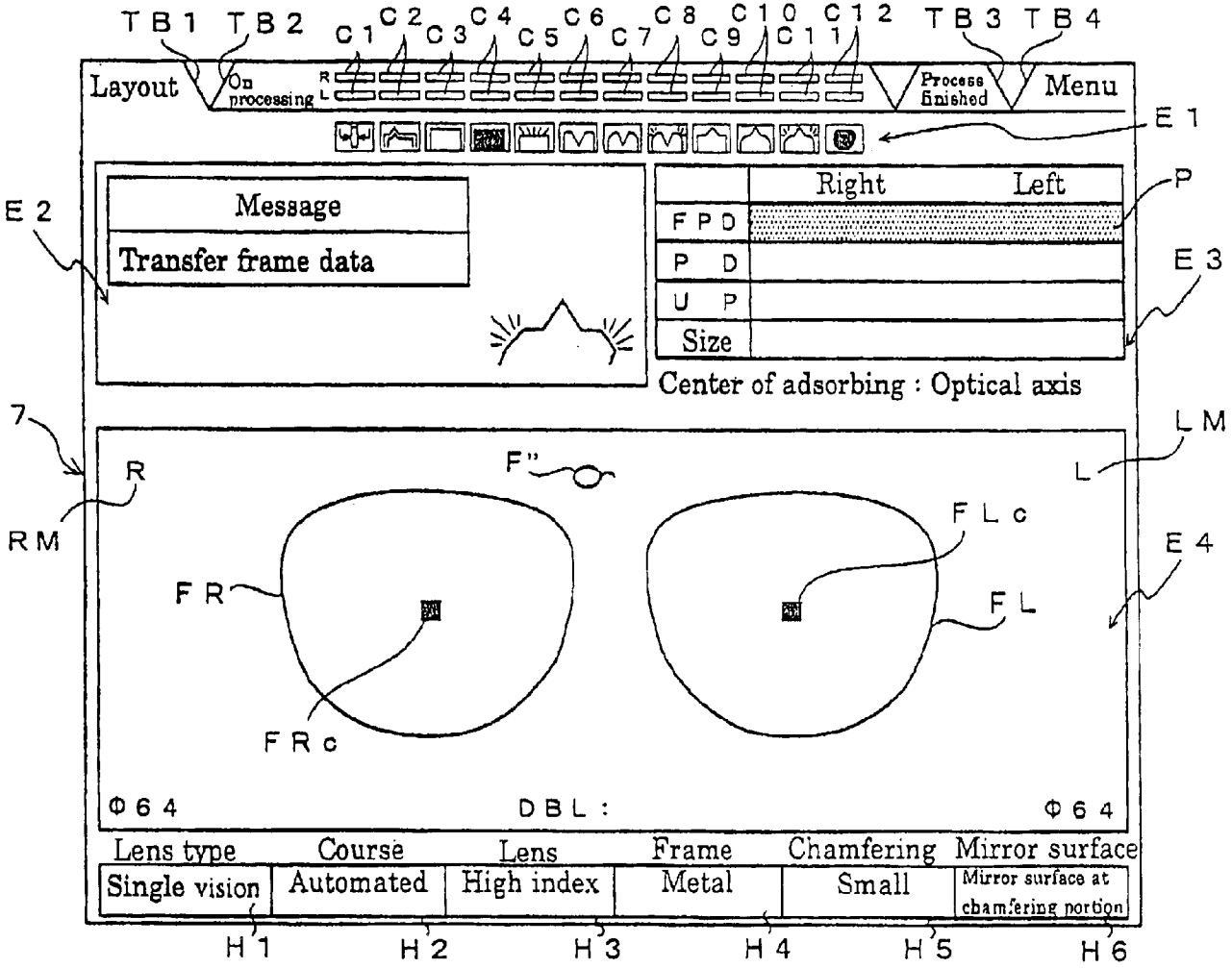
FIG. 37 is a front view of the liquid crystal display device showing a display screen upon reception of data on one of the right and left eyeglass frames is received.

In a case where data transferred from the frame shape measuring apparatus 1 to the lens grinding processing apparatus 2 by the operation of the "Data request" switch 7*c* is data of only one frame, the following display is made in the display areas E2, E3 and E4 as shown in FIG. 37. That is, a layout setting message such as "Please set layout data" is displayed in the message display area E2, and the cursor-type pointer P is displayed on the column of "FPD" of the numerical value display area E3. Further, in the state display area E4 are displayed a right eye mark RM and a left eye mark LM, a frame shape FR for a right eye and a frame shape FL for a left eye, geometrical center marks FRc and FLc, a one eye shape F of spectacles frame F, diameters of left and right green lenses (for example, "ϕ64"), and "DBL" which is a bridge width (a clearance between left and right frames). The numerical values of "DBL" and "FPD" are not displayed due to the absence of data, but can be input and selected by default.

(Case of Pattern Data)

Figure 38:
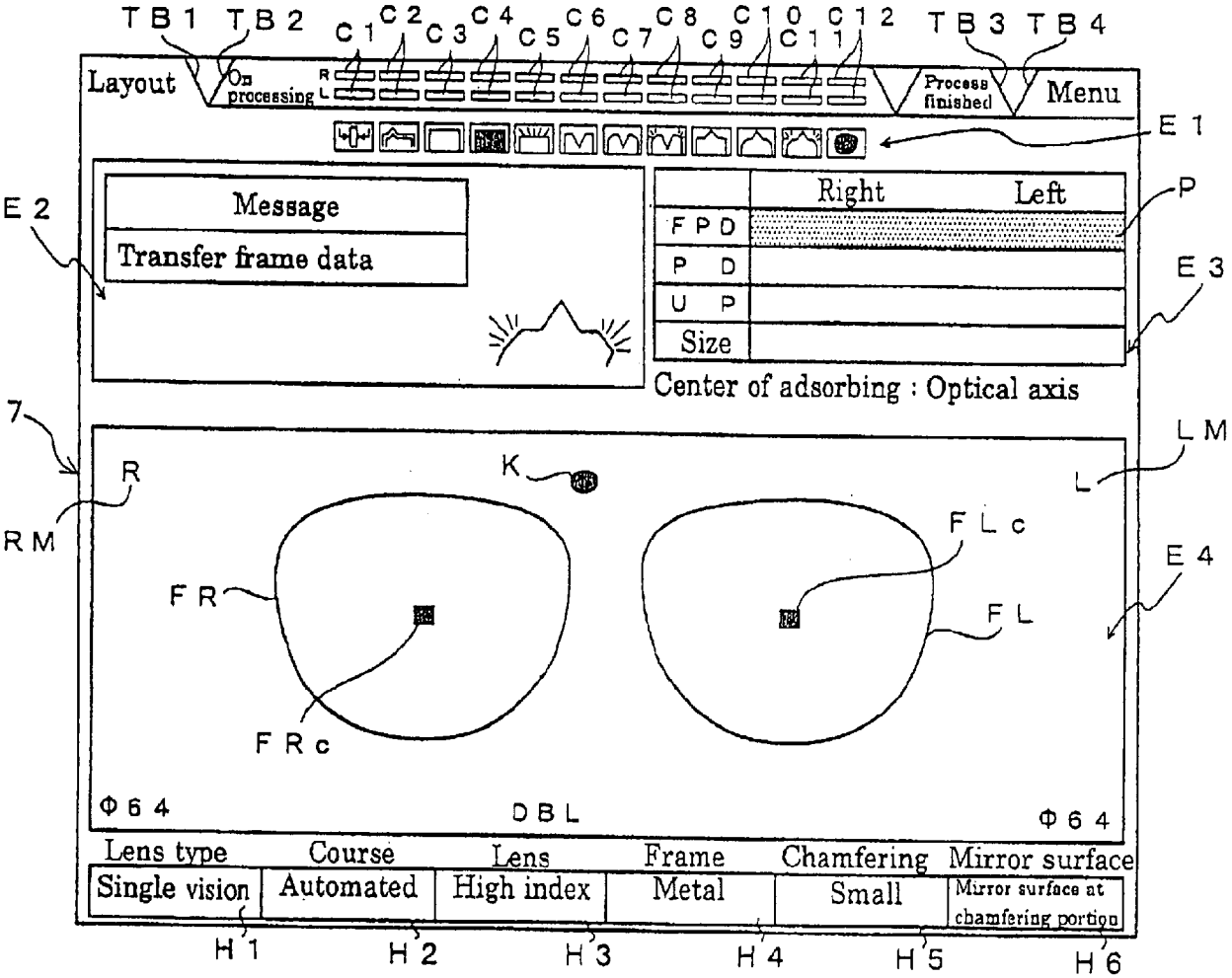
FIG. 38 is a front view of the liquid crystal display device showing a display screen upon reception of lens shape data based on a template or a lens shape model.

In a case where lens shape information (θi, ρi) transmitted from the frame shape measuring apparatus 1 to the grinding processing apparatus 2 by the operation of the "Data Request" switch 7*c* is ball form shape data based on a form plate or a ball form model, the following display is made in the display areas E2, E3 and E4 as shown in FIG. 38.

That is, a layout setting message such as "Please set layout data" is displayed in the message display area E2, and a cursor-type pointer P is displayed on the column of "FPD" of the numerical value display area E3. Further, in the state display area E4 are displayed a ball form shape K, diameters of left and right green lenses (for example, "ϕ64"), and "DBL" which is a bridge width (a clearance between left and right frames) showing that a right eye mark RM and a left eye mark LM, a frame shape FR for a right eye and a frame shape FL for a left eye, geometrical center marks FRc and FLc, and lens shape information (θi, ρi). The numerical values of "DBL" and "FPD" are not displayed due to the absence of data, but can be input and selected by default.

<Case of Bifocal Lens Selection>

Figure 39:
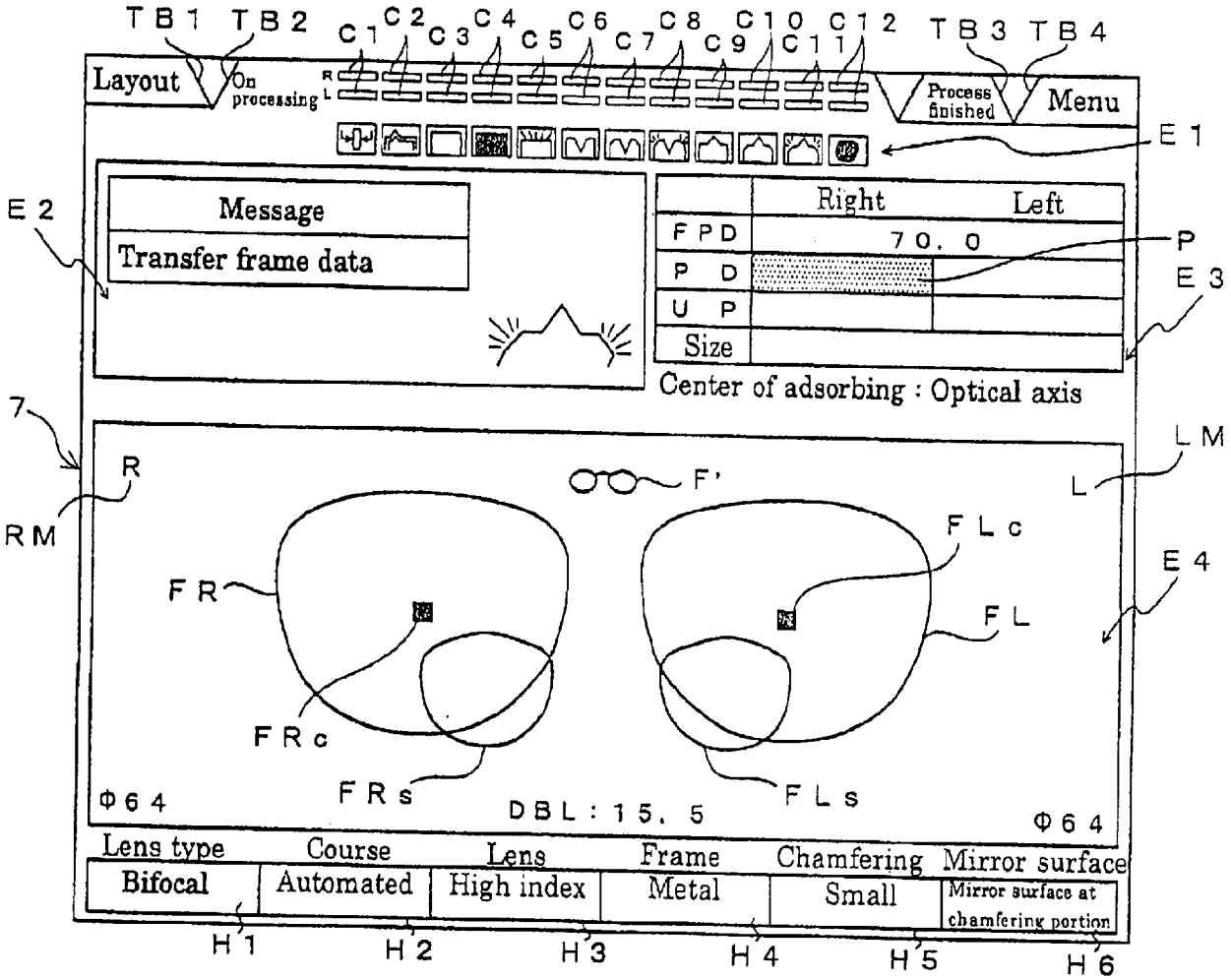
FIG. 39 is a front view of the liquid crystal display with a screen display when a bi-focal lens is selected as the lens type.

In a case where "Bifocal lens" is selected as "Lens type" by the operation of the function key F1, a layout setting message such as "Please set layout data" is displayed in the message display area E2, as shown in FIG. 39. At this time, a numerical value (for example, "70.0") is displayed on the column of "FPD" of the numerical value display area E3, and the cursor-type pointer P is displayed on the column of "HPD" of the numerical value display area E3. The column of "HPD" of the numerical value display area E3 and the column of "H1p" are divided to left and right, and the cursor-type pointer P is displayed on the column for a right eye divided (input part). The left and right divided state is similarly applied to the case where "Progressive" is selected. In the state display area E4 are displayed a right eye mark RM and a left eye mark LM, a frame shape FR for a right eye and a frame shape FL for a left eye, geometrical center marks FRc and FLc, a small ball image FRs for a right eye and a small ball image FLs for a left eye, the whole shape F' of spectacles frame F, diameters of left and right green lenses (for example, "ϕ64"), and "DBL" which is a bridge width (a clearance between left and right frames). In connection with the setting method for "HPD" and "H1p", that is carried out using the "−+switch" and the "▽" switch 7*e* similarly to the above.

<Case of Frame Replacing Course Selection>

Figure 40:
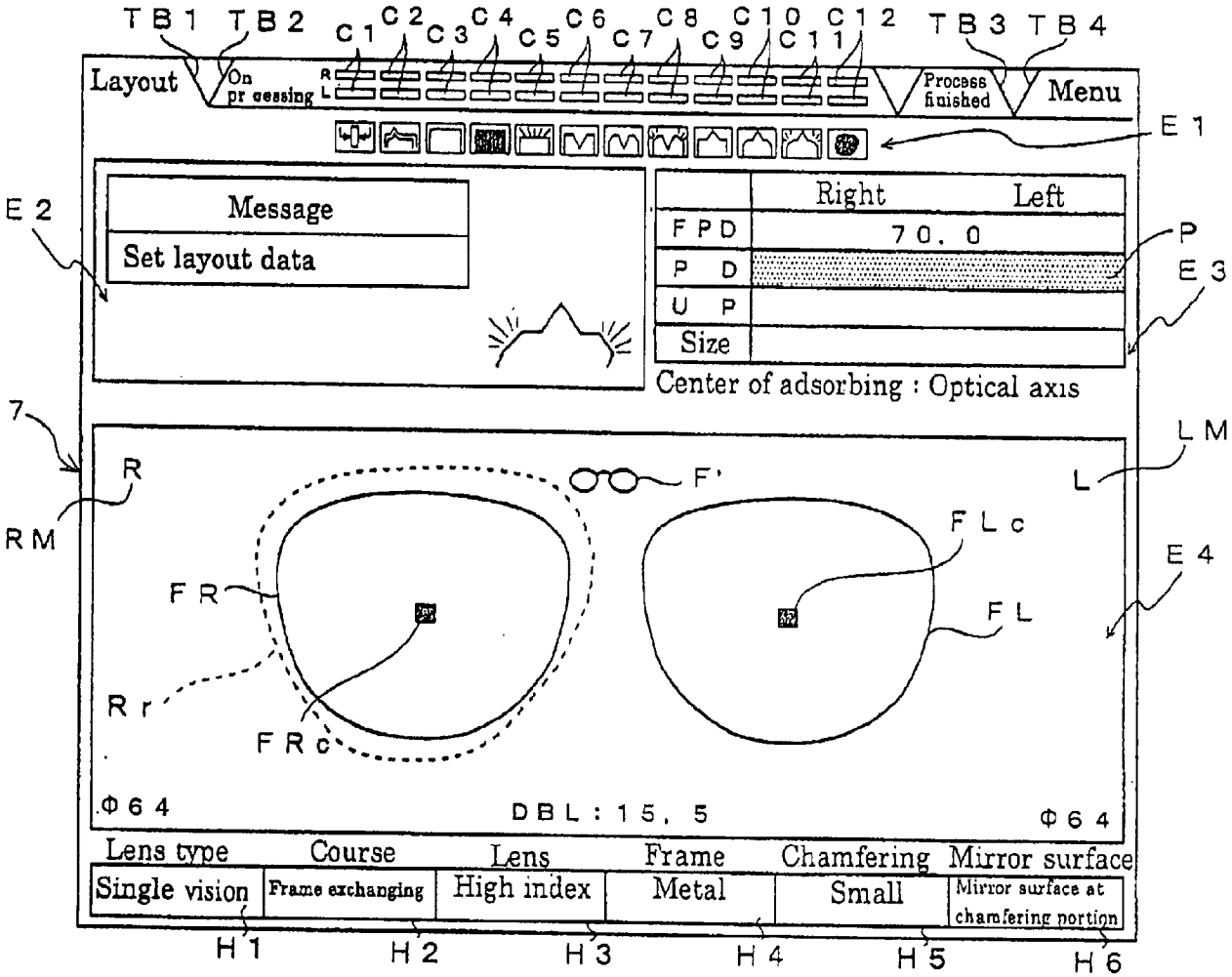
FIG. 40 is a front view of the liquid crystal display device with a screen display when a lens frame exchanging course is selected as a course selection.

In a case where "Frame replacement" is selected in "Course" by operating the function key F2 in order to replace only the spectacles frame F making use of the existing lens used previously, the following is displayed in the display areas E2, E3 and E4 as shown in FIG. 40.

That is, a layout setting message such as "Please set layout data" is displayed in the message display area E2. Since the lens shape information (θi, ρi) has been already received, a numerical value (for example, "70.0") transferred is displayed on the column of "FPD" of the numerical value display area E3, and the cursor-type pointer P is displayed on the column of "PD" of the numerical value display area E3. Further, in the state display area E4 are displayed a right eye mark RM and a left eye mark LM, a frame shape FR for a right eye and a frame shape FL for a left eye, geometrical center marks FRc and FLc, right eye-lens data Rr based on right eye-lens data, and the whole shape F' of an spectacles frame F. Thereby, whether or not the existing lens can be utilized for a new frame-replacing spectacles frame F.

[Display State of the Liquid Crystal Display Device 8 During Machining]

<In Case of Starting the Machining of the Right Eye-lens (Measurement of the Flange Thickness)>

Figure 41:
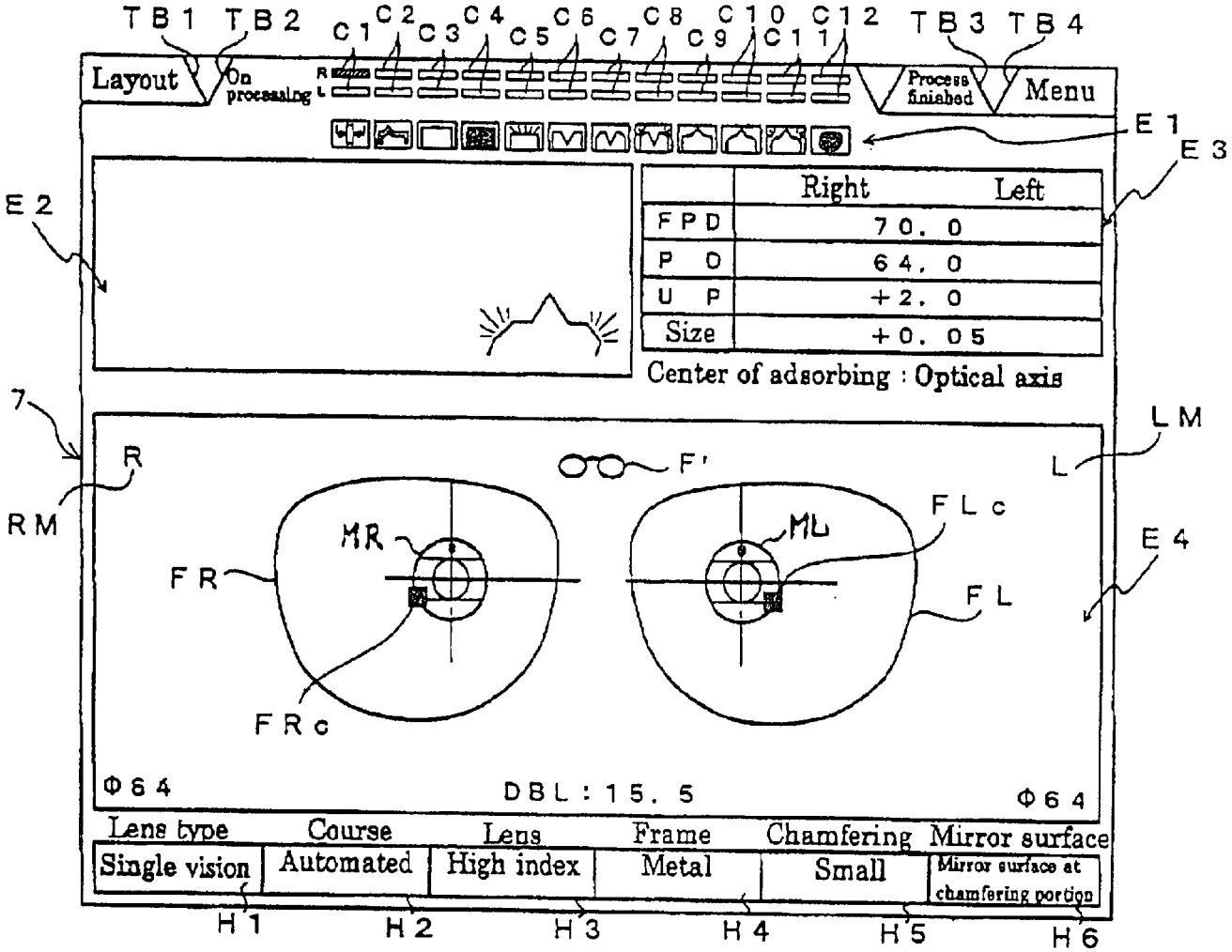
FIG. 41 is a front view of the liquid crystal display device with display when a lens edge thickness of eyeglass frame is being measured.

When various numeric values are set and the "Right" switch 6*c* is operated, the tab "Under machining" TB2 is displayed as shown in FIG. 41, and at the same time the background color changes and the whole display area turns into a "Under machining" sheet. And within the "Under machining" tab TB2 indicators C1–C12 are displayed depending on the machining mode, and in the icon display area E1 under each of the indicators C1–C12, icons A1–A12 are likewise shown depending on the machining mode. In the numerical value display area E3, various numerical values set (determined) are shown. In the state display area E4, the right eye mark RM and the left eye mark LM, the frame shape for the right eye FR and the frame shape for the left eye FL, their geometrical central marks FRc and FLc, the marks of suction cups for holding lens materials for grinding MR and ML, the global shape F of the frame of a pair of glasses F, the diameters of the right and left lens "ϕ64" and "DBL" and their numerical values "15.5" are shown.

At this time, the indicator C1 for the right eye row is lit. The light color of this indicator C1 and the color arrangement of other indicators C2-C12 are differentiated. This enables to recognize easily that the flange thickness of the right eye-lens is now measured ("Under machining" process). And even if the flange thickness of the right eye-lens is now measured ("Under machining" process), it is possible to set the layout of the left eye-lens by specifying the "Layout" tab TB1. However, as the indicator C1 for the right eye row is shown by the background color of the layout sheet frame (for example, green), it is easily recognized that the flange thickness of the right eye-lens is now being measured.

Figure 42:
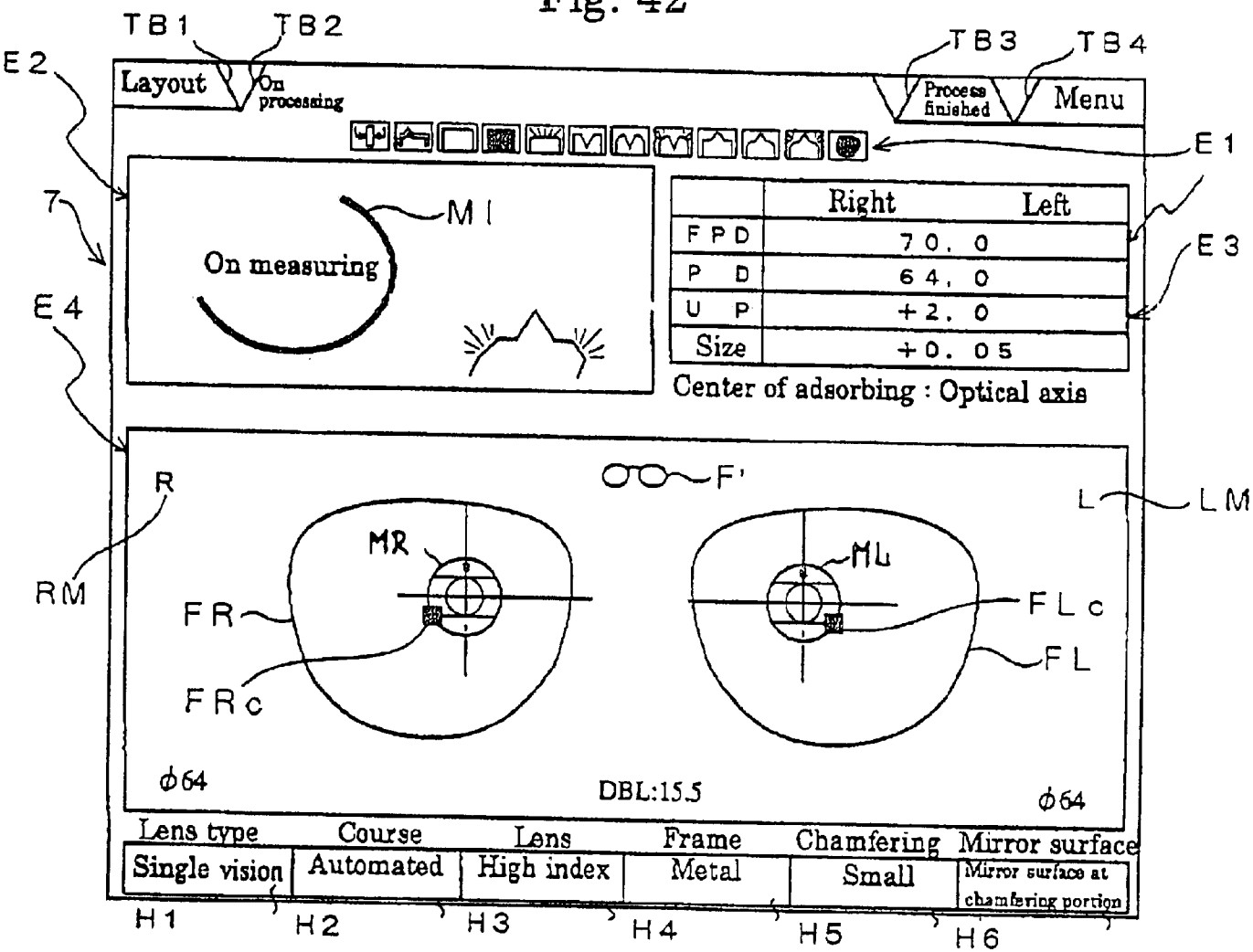
FIG. 42 is a front view of the liquid crystal display device with another example of display screen when a lens edge thickness of eyeglass frame is being measured.
Figure 43:
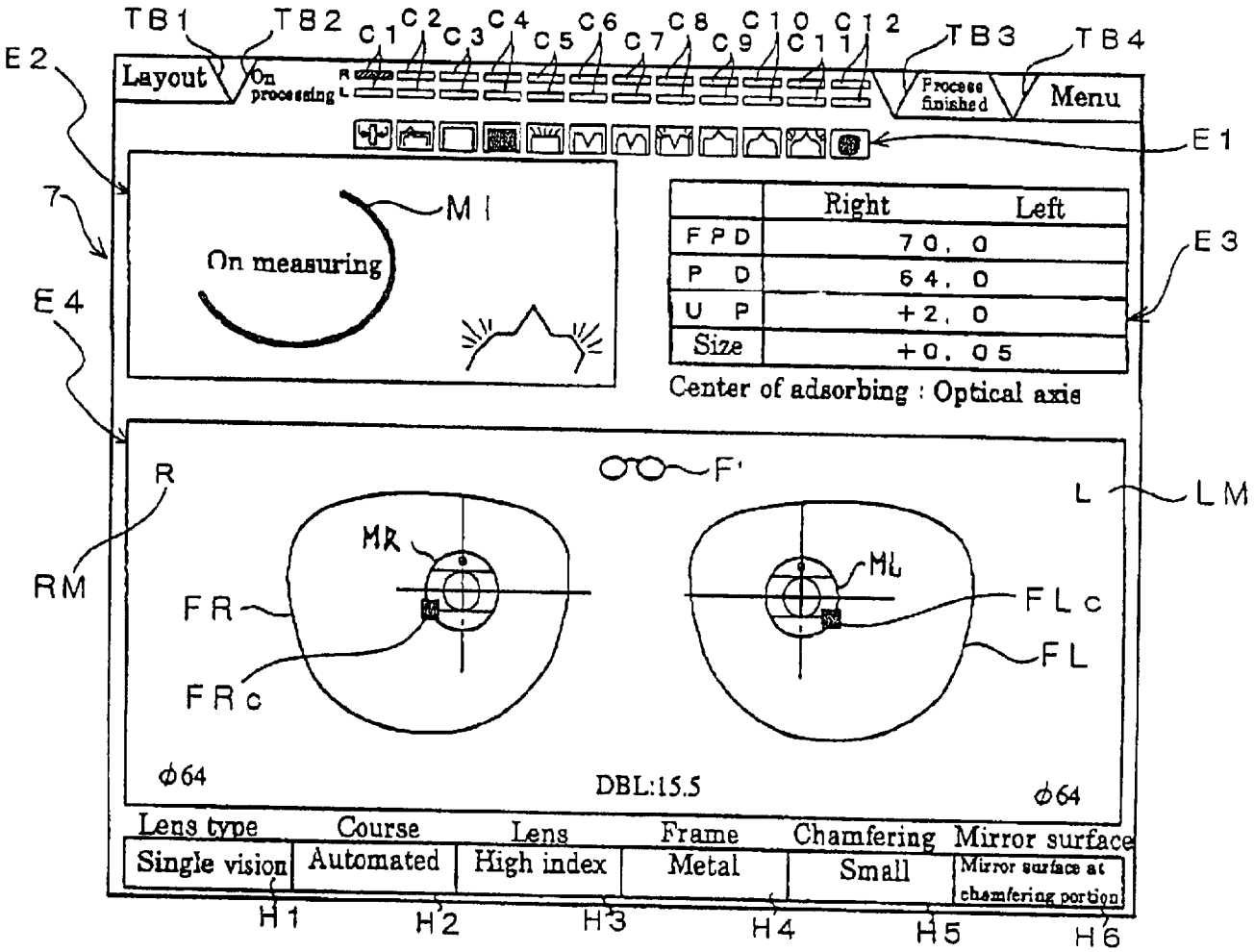
FIG. 43 is a front view of the liquid crystal display device with still another example of display screen when a lens edge thickness of eyeglass frame is being measured.

In the meanwhile, as a means for enabling the machining process to be recognized, it is possible, for example as shown in FIG. 42, to show by words "Under measurement"

meaning that the flange thickness is being measured in the message display area E2, to provide a level indicator MI that successively extends clockwise depending on the state of measurement around the words "Under measurement," to reverse the state of indication (color) of the icon A1, to move the global form F of the frame of a pair of glasses F from the left-side end to the right-side end of the picture frame depending on the state of machining, and other adequate means of level indication may be adopted. And as shown in FIG. 43, the level indication MI and the indicators C1–C12 may be used concurrently.

<In Case of the Recognition of the Flange Thickness>

Figure 44:
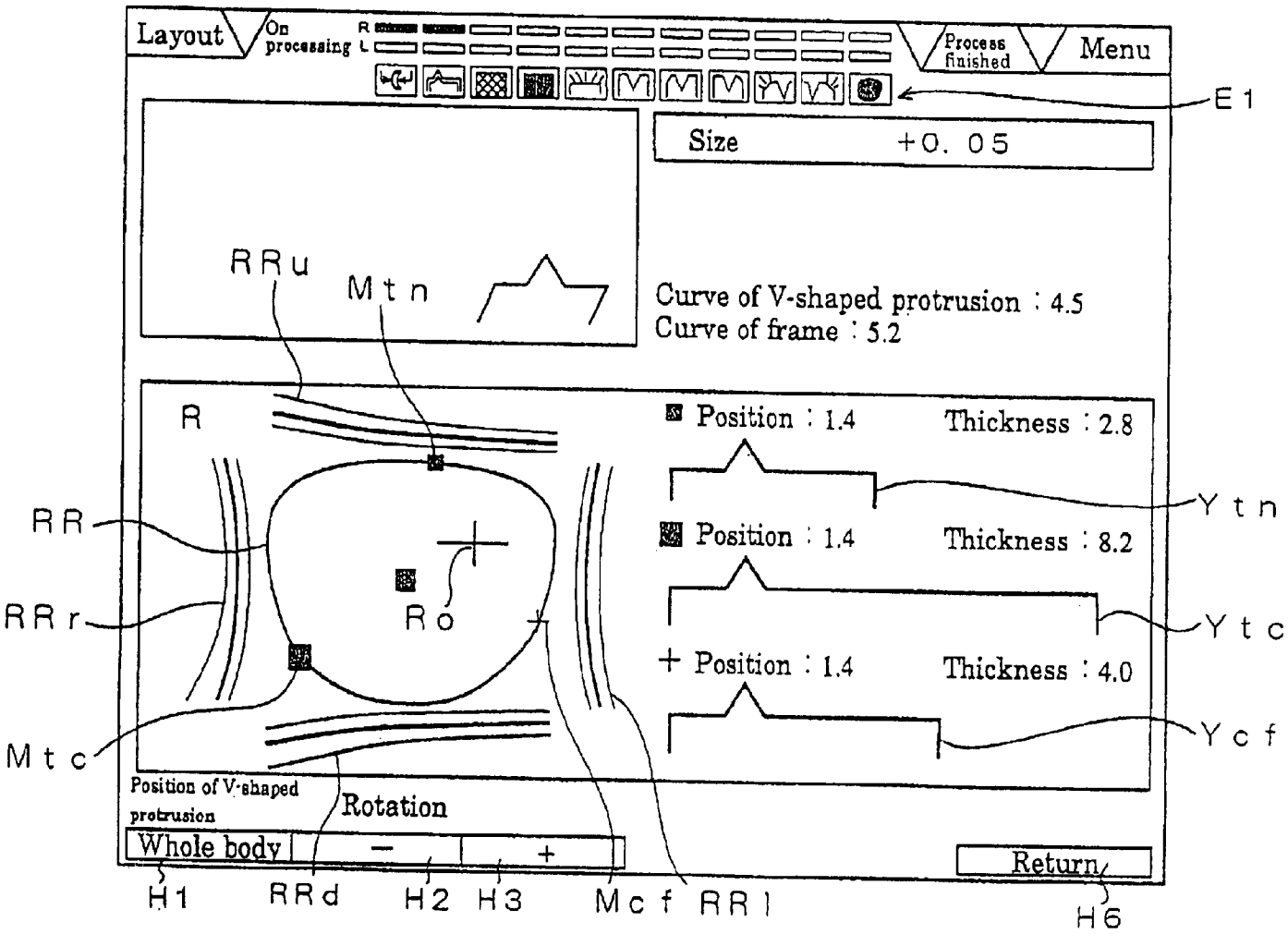
FIG. 44 is a front view of the liquid crystal display device with a display screen after a lens edge thickness of eyeglass frame is measured.

When the measurement of the flange thickness is finished, as shown in FIG. 44, the indicator C2 is lit, the indication of the numerical values indication area E3 shifts to a "Size" column, and "Edging" curve and frame curve values are shown in what was the numerical values display area E3. And in the "Size" column, a numerical value such as "+0.05" for example is shown, while in the "Edging curve" column a numerical value such as "4.5" for example is shown and in the "Frame curve" column a numerical value such as "5.2" for example is shown.

And in the left-side half of the state display area E3, in addition to the right eye mark RM and the left-eye mark LM, in its left-side half the shape of the right-eye-lens RR or the shape of the right-eye frame FR, the geometrical central mark FRc, the optical central mark Ro, the upper lens width RRu, the lower lens width RRd, the right lens width RRr, the left lens width RR1, the minimum flange thickness position mark Mtn, the maximum flange thickness position Mtc, the arbitrary flange thickness recognition position mark Mcf, etc. are shown. And in the right-side half of the state display area E3, the edging shape, its position and the numerical value of its flange thickness at a position corresponding to the minimum flange thickness position Mtn, the edging shape Ycf, its position and the numerical value of its flange thickness at positions corresponding to the maximum flange thickness position Mtc, and the edging shape Ytc, its position and the numerical value of its flange thickness at a position corresponding to the arbitrary flange thickness recognition position Mcf, etc. are shown.

Figure 45:
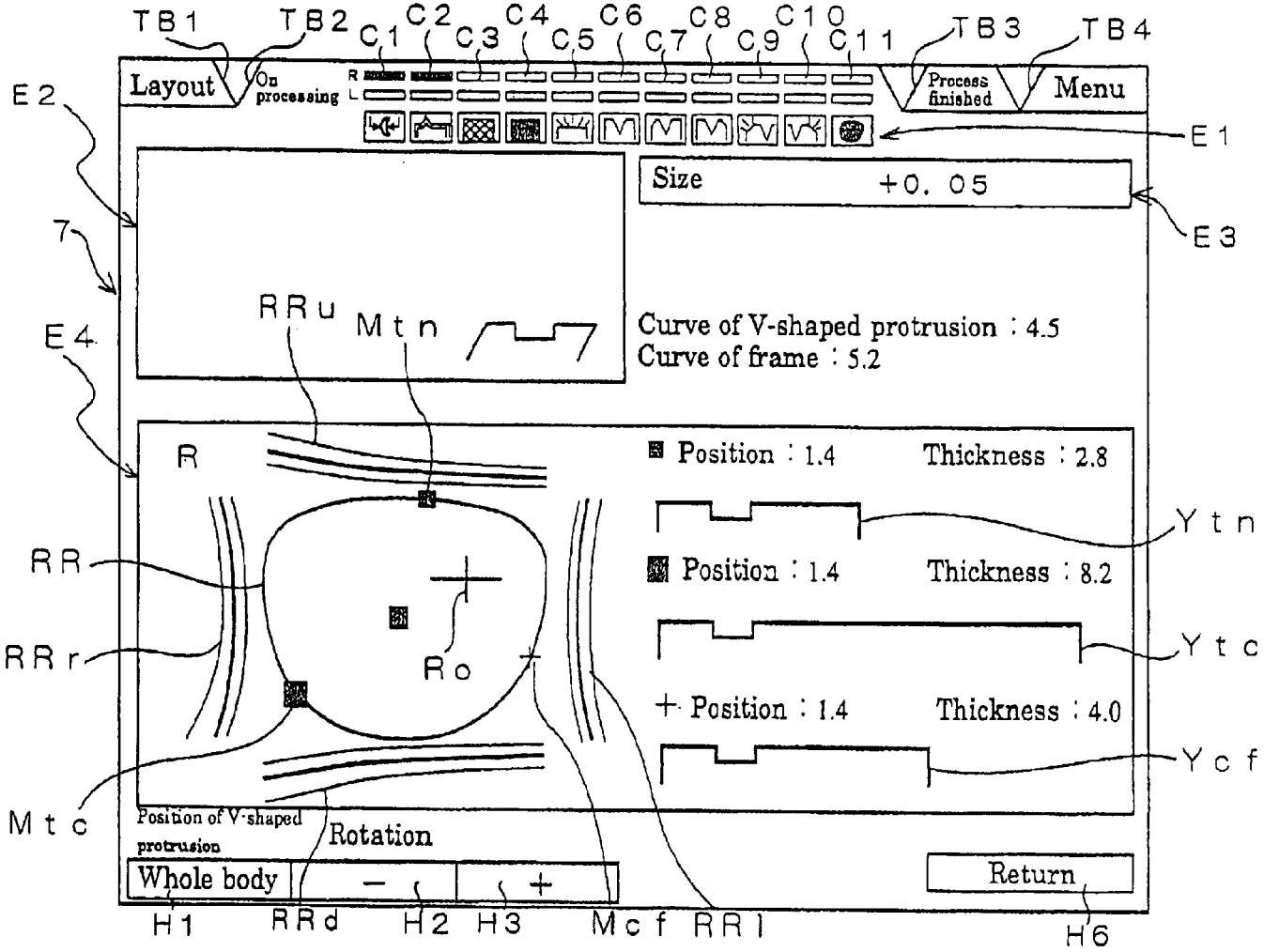
FIG. 45 is a front view of the liquid crystal display device showing a variation 1 of the display screen after a lens edge thickness of eyeglass frame has been measured.

And when some "grooving" is selected by means of the function key F4 for the type of the frame of a pair of glasses F, as shown in FIG. 45, the shape of grooving and its position and the numerical value of the flange thickness (either the flange depth or the flange width will do) at positions respectively corresponding to the minimum flange thickness position mark Mtn, the maximum flange thickness position mark Mtc, and the arbitrary flange thickness recognition position mark Mcf are shown.

It should be noted in the meanwhile that the groove depth and the groove width are shown differently depending on the type of the glass lens (plastic lens or minus lens, etc.) the scope of the round lens shape information (θi, ρi) (for example, the range of radial angle of the supraaural side of the frame of a pair of glasses F to the supranasal side).

Figure 46:
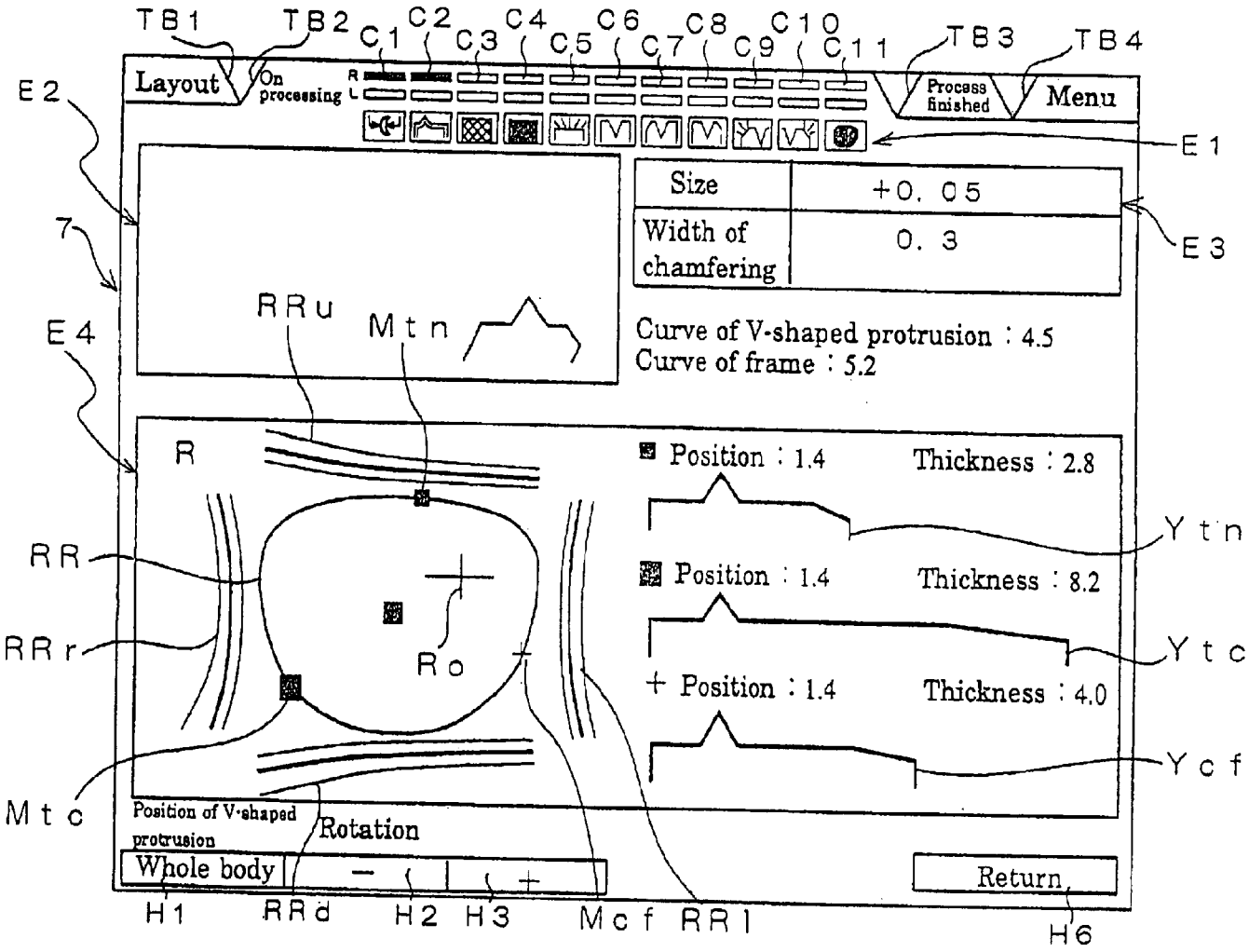
FIG. 46 is a front view of the liquid crystal display device showing a variation 2 of the display screen after a lens edge thickness of eyeglass frame has been measured.

And when a chamfering operation is to be executed by means of the function key F5, as shown in FIG. 46 cross sectional shapes are shown in the shape resulting from the combination of the edging shape and the chamfering shape at a position corresponding to the minimum flange thickness position mart Mtn, a position resulting from the combination of the grooving shape a chamfering shape at a position corresponding to the maximum flange thickness position mark Mtc and the arbitrary flange thickness recognition position mark Mcf and the numerical value of the flange thickness (the groove depth or the groove width will do) are shown.

Figure 47:
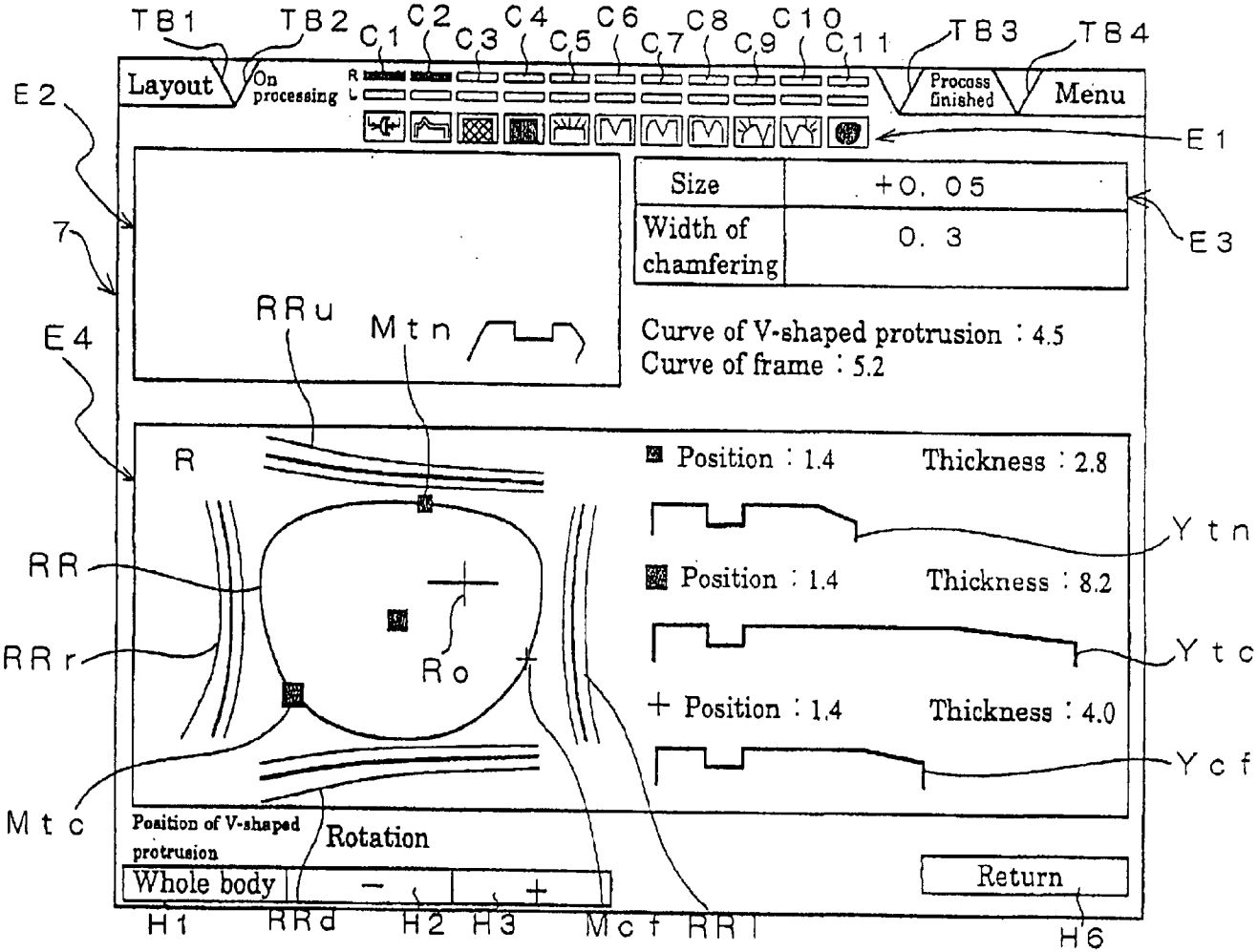
FIG. 47 is a front view of the liquid crystal display device showing a variation 3 of the display screen after a lens edge thickness of eyeglass frame has been measured.

In addition, when both "grooving" and chamfering operations are executed, as shown in FIG. 47, the cross sectional shape resulting from the combination of the edging shape and the chamfering shape at positions corresponding to the minimum flange width position mark Mtn, and positions where the grooving shape and the chamfering shape are combined at positions corresponding the maximum flange width position mark Mtc and the arbitrary flange width recognition position mark Mcf and the numerical value of the flange width (either the groove depth or the groove width will do) will be displayed.

These indications are not limited to those described above as shown for example by the difference of both the edging and the groove depending on the position of the frame and the difference of sectional shape depending on the variation of type of the frame of a pair of glasses F.

At this moment, the chamfering width of the machined lens can be varied by an angle of θi of the lens shape information (θi, ρi) as the round shape data for the frames of a pair of glasses, and therefore the chamfering shape at the minimum flange thickness position mark Mtn, the chamfering shape at the maximum flange thickness position mark Mtc and the chamfering shape at the arbitrary flange thickness recognition position mark Mcf can be easily identified.

And below the state display area E3, the "Entirety" of the "Edging position" display mode, the "−" (anticlockwise) rotation and the "+" (clockwise) rotation in the "Rotation" mode which rotates on the display of the right eye-lens shape RR, and the word "Return" for returning the display state after the rotation back to the former state are respectively shown in the function display sections H1, H2, H3 and H6 so that they may be operated by means of the function keys F1, F2, F3, and F6.

<When the Right Eye-lens Machining is Finished>

Figure 48:
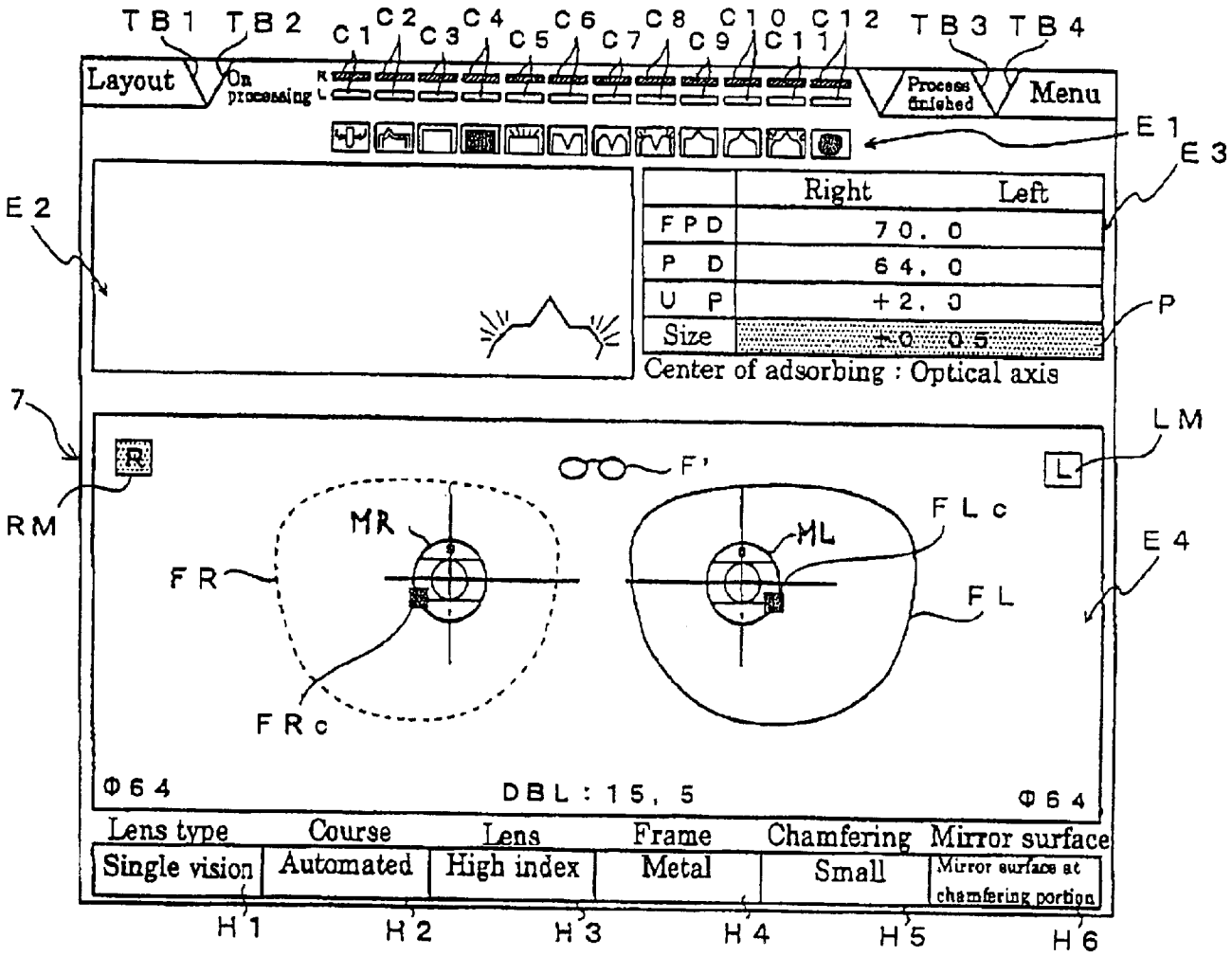
FIG. 48 is a front view of the liquid crystal display device showing the display screen upon completion of grinding of one of eye-lenses for a lens frame has been processed.

When the grinding of lens materials to form the right-eye-lens based on the lens shape information (θi, ρi) is finished, as shown in FIG. 48, all the indicators C1–C12 on the right eye row are lit, and the indicator-type pointer P in the numerical value indication area E3 is in the "Size" column. Then, the display of the right-eye mark RM in the state display area E4 is reversed and at the same time right eye-lens shape RR is displayed by a dotted line.

<When the Left Eye-lens is to be Machined>

Figure 49:
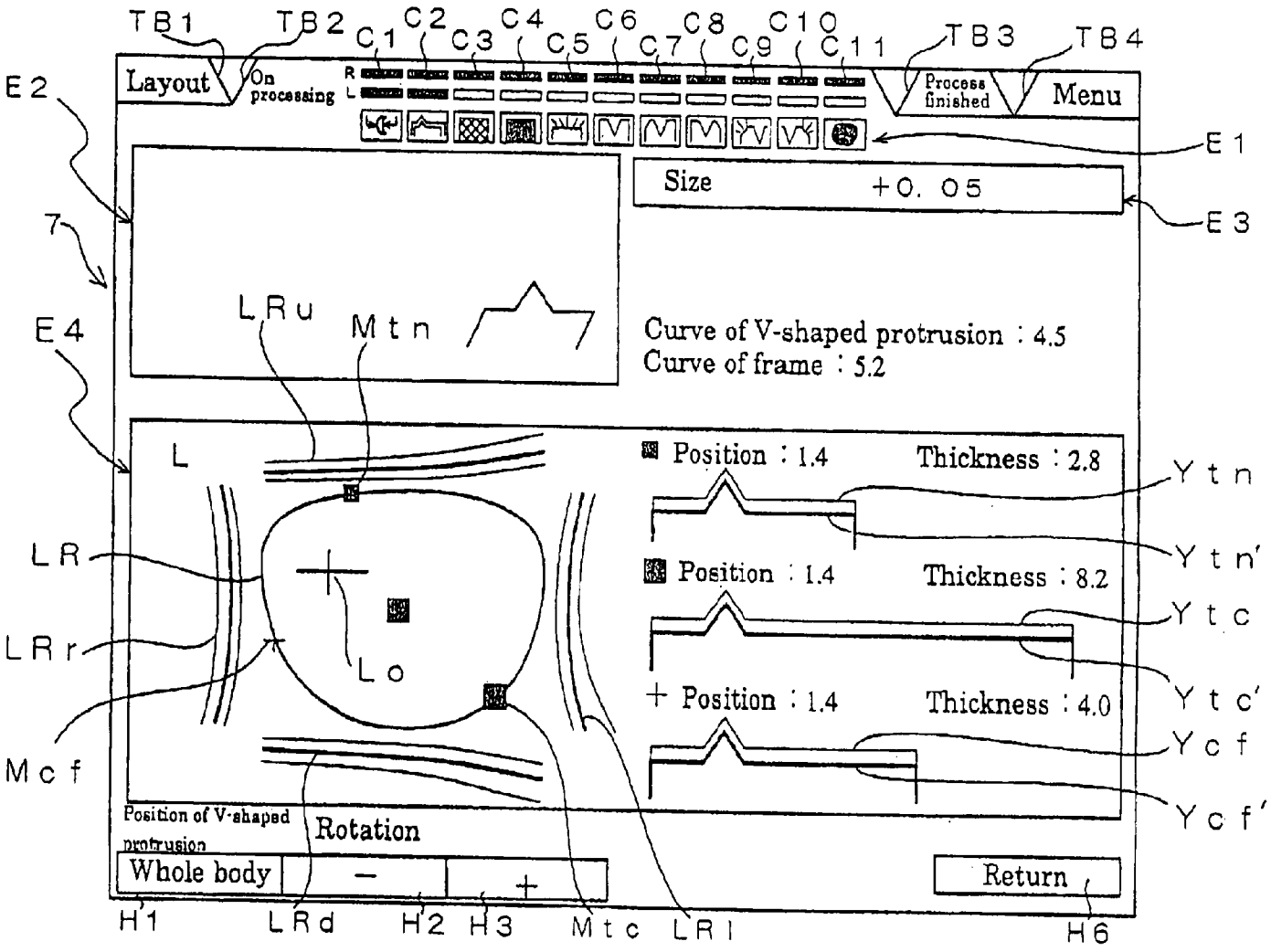
FIG. 49 is a front view of the liquid crystal display device showing the display screen for grinding of the other one of eye-lenses for a lens frame has been processed.

When the machining of the right eye-lens is completed followed by a confirmation of the edging shape, and the "Left" switch 6*b* is operated to finish the frame shape grinding of the left eye-lens, as shown in FIG. 49, the indicator C2 in the left eye row is lit. At this moment, the numerical value display area E3 shifts to the display of the "Size" column, where a numerical value such as for example "+0.05" is shown. And in the "Edging curve" column a numerical value such as for example "4.5" is shown and in the "Frame curve" column a numerical value such as for example "5.2" is shown.

And in the left-side half of the state display area E3, the left eye mark LM, the shape of the left-eye-lens LR or the shape of the left-eye frame FL, the geometrical central mark FLc, the optical central mark Lo, the upper lens width RLu, the lower lens width RLd, the right lens width RLr, the left lens width RLl, the minimum flange thickness position mark Mtn, the maximum flange thickness position Mtc, the arbitrary flange thickness recognition position mark Mcf are shown. And in the right-side half of the state display area E3, the edging shape Ytn', its position and the numerical value of its flange thickness at a position corresponding to the minimum flange thickness position Mtn, the edging shape Ytc', its position and the numerical value of its flange thickness at positions corresponding to the maximum flange thickness position Mtc, and the edging shape Ycf', its position and the numerical value of its flange thickness at a position corresponding to the arbitrary flange thickness recognition position Mcf are shown.

And the edging shapes Ytn, Ytc, Ycf during the machining of the right eye-lens are shown by a different color from those of the edging shapes Ytn', Ytc' and Ycf' during the machining of the left eye-lens so that they may be compared. In this case, by displaying the edging shapes Ytn, Ytc, Ycf during the machining of the right eye-lens for example in a reversed state in terms of data, the edging shapes Ytn, Ytc, Ycf during the machining of the right eye-lens can be displayed with a different color than that of the edging shapes Ytn', Ytc' and Ycf during the machining of the left eye-lens. In FIG. 49, by changing the thickness of lines for the edging shapes Ytn, Ytc, Ycf during the machining of the right eye-lens and the edging shapes Ytn', Ytc', Ycf' during the machining of the left eye-lens, the edging shapes Ytn, Ytc, Ycf and the edging shapes Ytn', Ytc', Ycf' can be displayed distinctly so that they may be compared.

Figure 50:
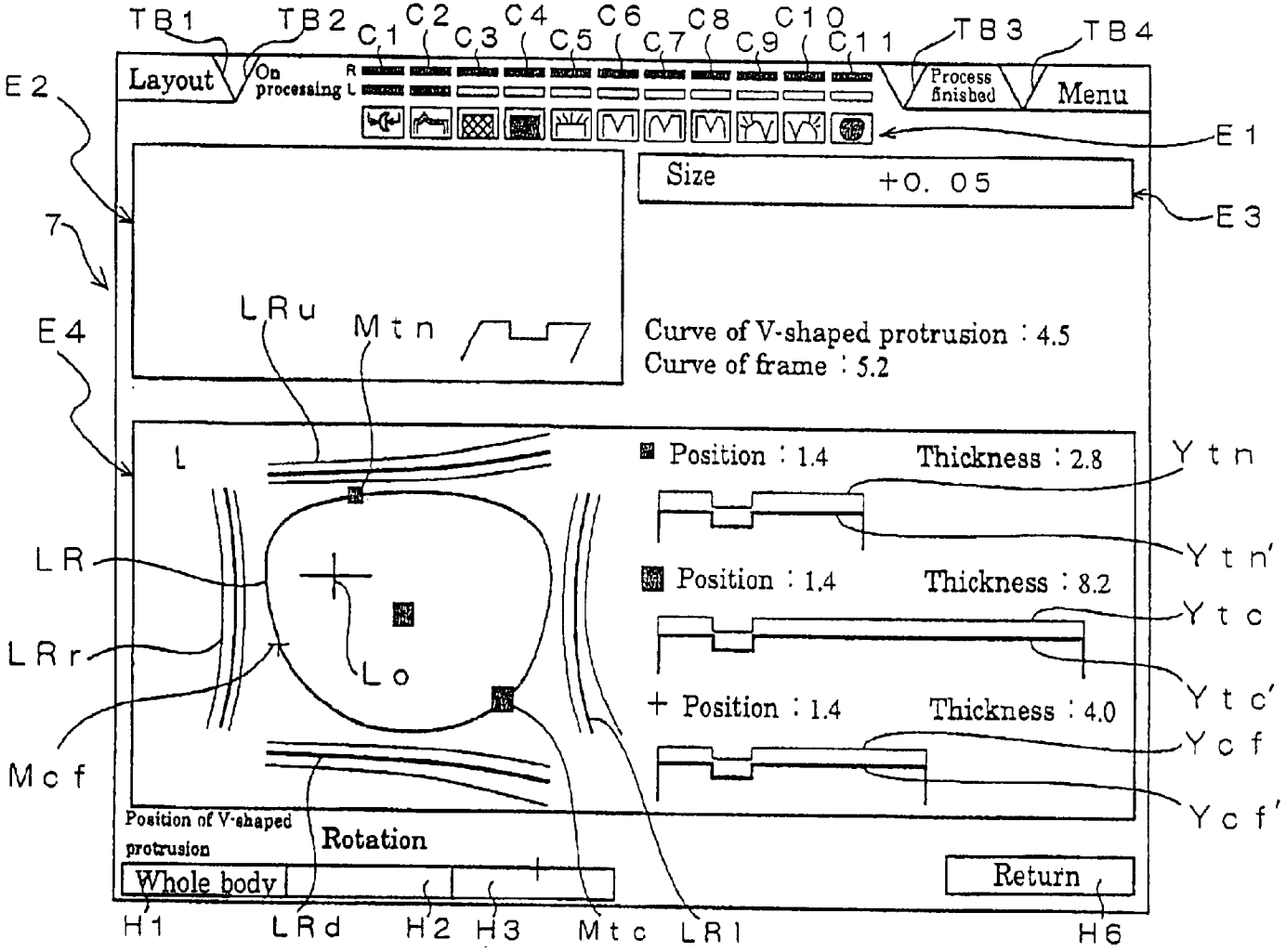
FIG. 50 is a front view of the liquid crystal display device showing variation 1 of the display screen after grinding of another one of eye-lenses for a lens frame has been processed.
Figure 51:
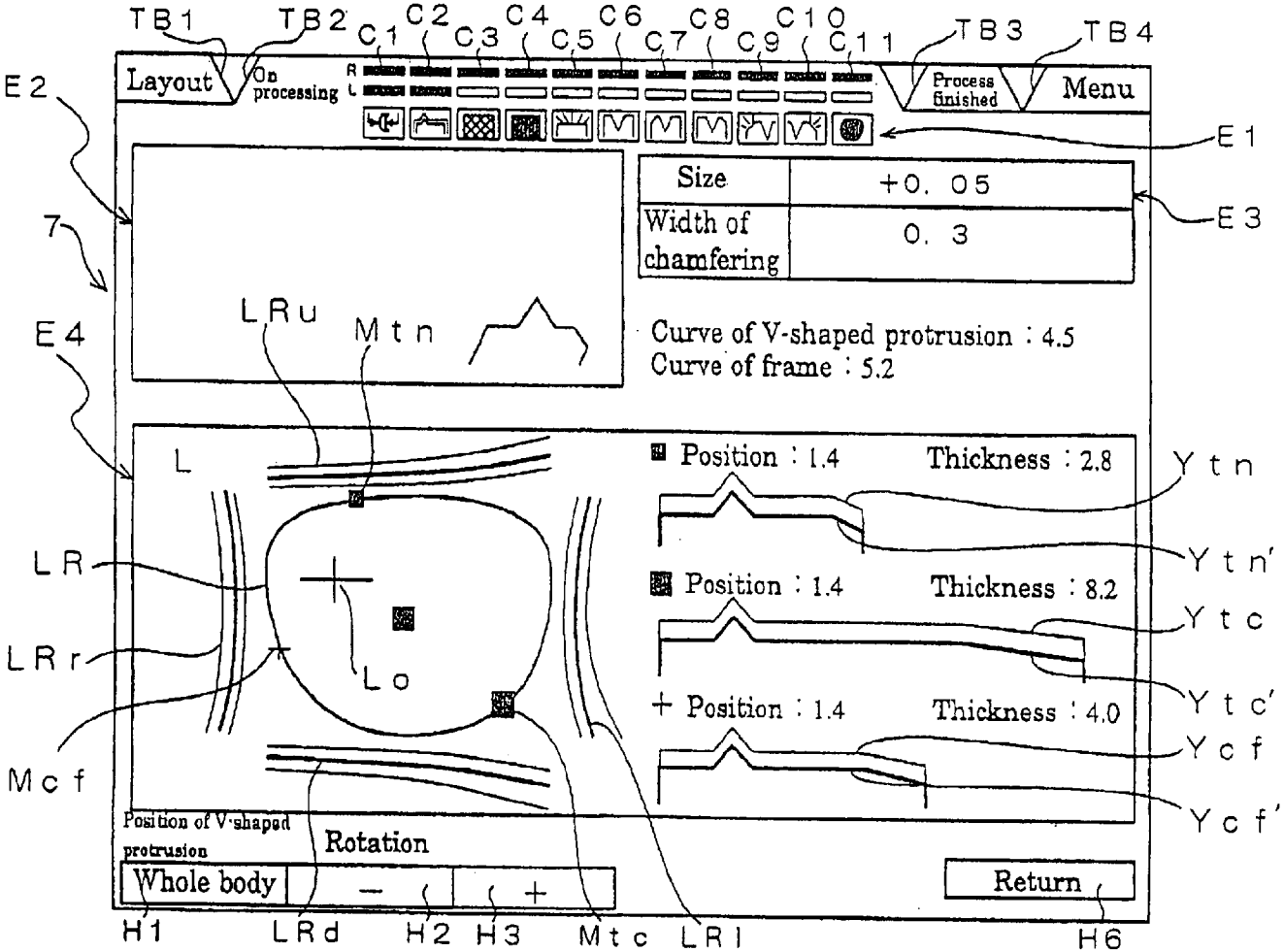
FIG. 51 is a front view of a liquid crystal display device showing variation 2 of the display screen when grinding the other one of eye-lenses for a lens frame has been processed.
Figure 52:
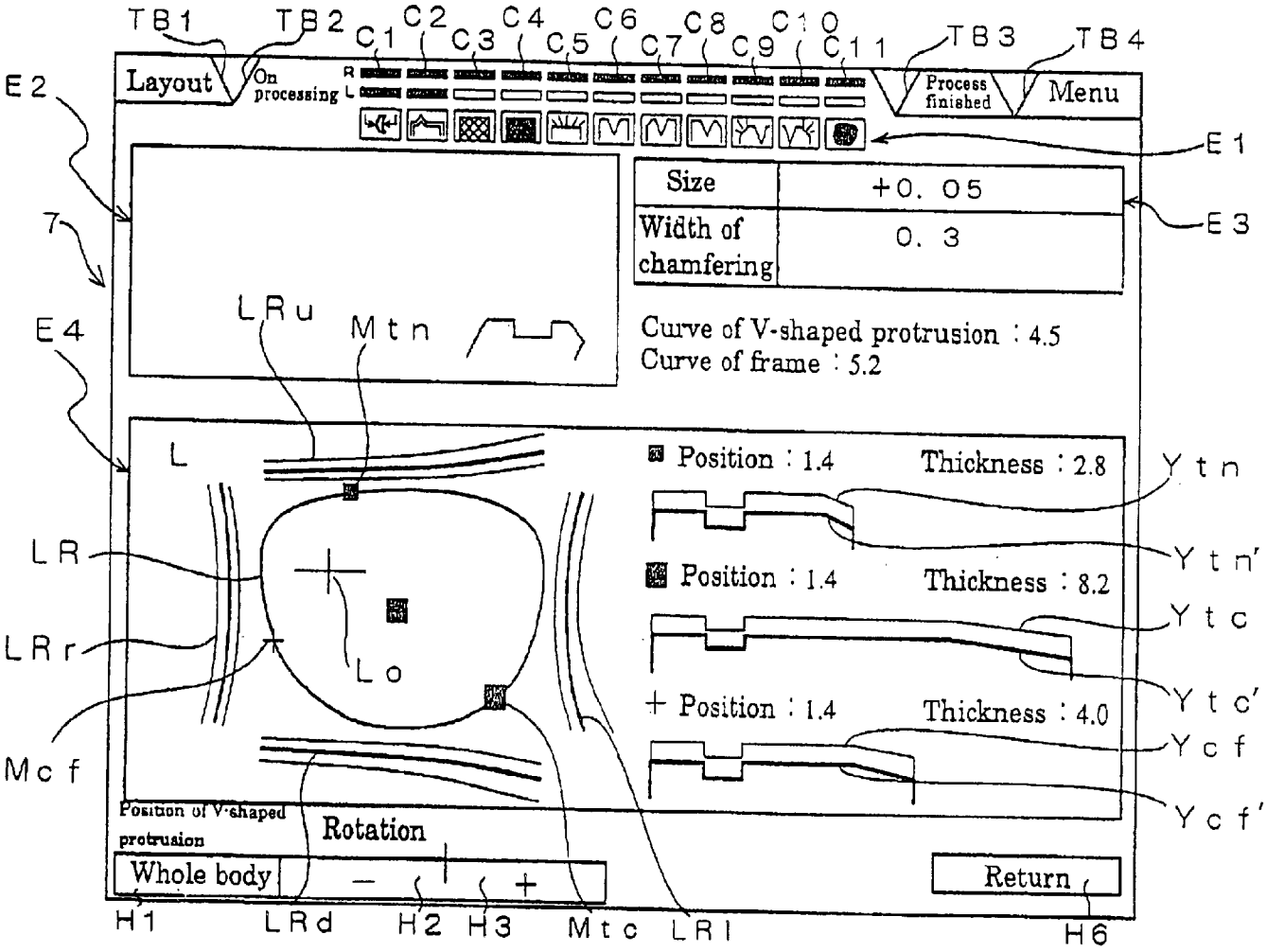
FIG. 52 is a front view of the liquid crystal display device showing variation 3 of the display screen when grinding the other one of eye-lenses for a lens frame has been processed.

At this moment, if it is wished to perform simulations in which the grooving shape, chamfering shape, grooving and chamfering shapes at the flange of both the right and left eye-lens are combined to compare the shape at the flange surface, as shown in FIGS. 50–52, a display similar to that during the machining of the is shown in a manner in which the right and left eye-lens can be compared.

[Display State of the Liquid Crystal Display Device 8 After the Machining is Finished]

<In Case of a Confirmation>

After the machining of both lens are completed, the operation of the "Right" switch 6*c* and the "Left" switch 6*b* and the operation of the "Right" switch 6*c* and the "Left" switch 6*b* when the machining of the subsequent frame of a pair of glasses F begins results in the words "Machining finished" tab TB3 being displayed and its background color being changed and shifting to the state of finished machining sheet.

It should be noted in the meanwhile that the state of display at this moment is the same as that of FIG. 48 except that the display of "Machining completed" tab TB3 and the background is different when the "Right" switch 6*b* is operated.

Figure 53:
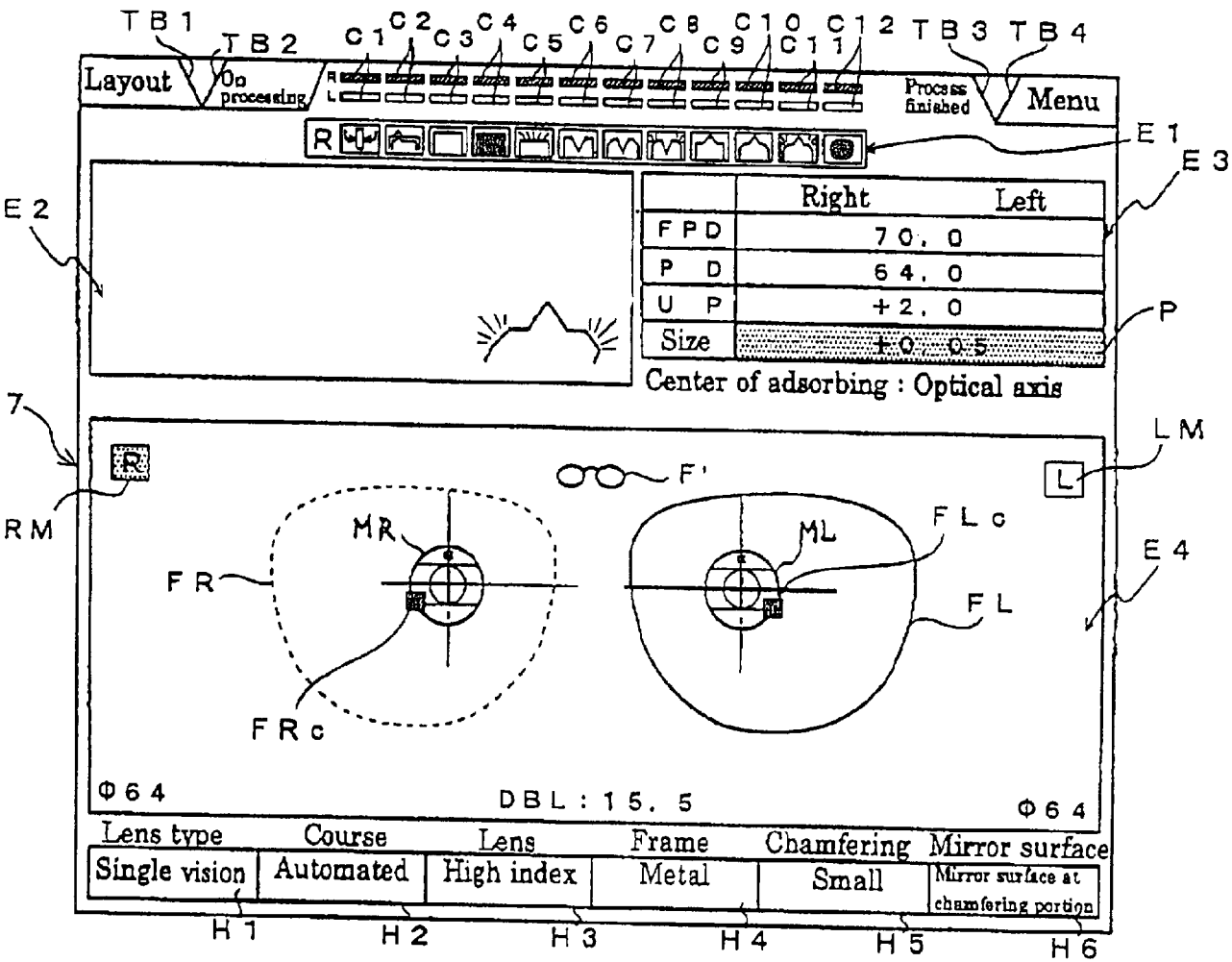
FIG. 53 is a front view of the liquid crystal display device showing the display screen upon completion of grinding of lenses for a lens frame has been completed.

Moreover, even when the "Under machining" tab TB2 shown in FIG. 53 shifts to the "Machining completed" tab TB3, the indicators (indicators) C1–C12 showing the machining state of the right and left eye-lens (R and L) and the icons A1–A12 in the display area E1 showing the shape of glass lens and a whetstone and other characters representing the type of processing continue to be displayed as before. Thus, the indicators C1–C12 and the icons A1–A12 continue to be displayed even if the tabs TB1–TB4 are changed, whatever operations among the "Layout," "Under machining," "Machining completed," or "Menu" may be performed, it is possible to recognize to what step the processing of either one of the right and left glass lens has progressed at present.

[Examples of Error Display]

<At the Time of Setting the Layout>

Figure 54:
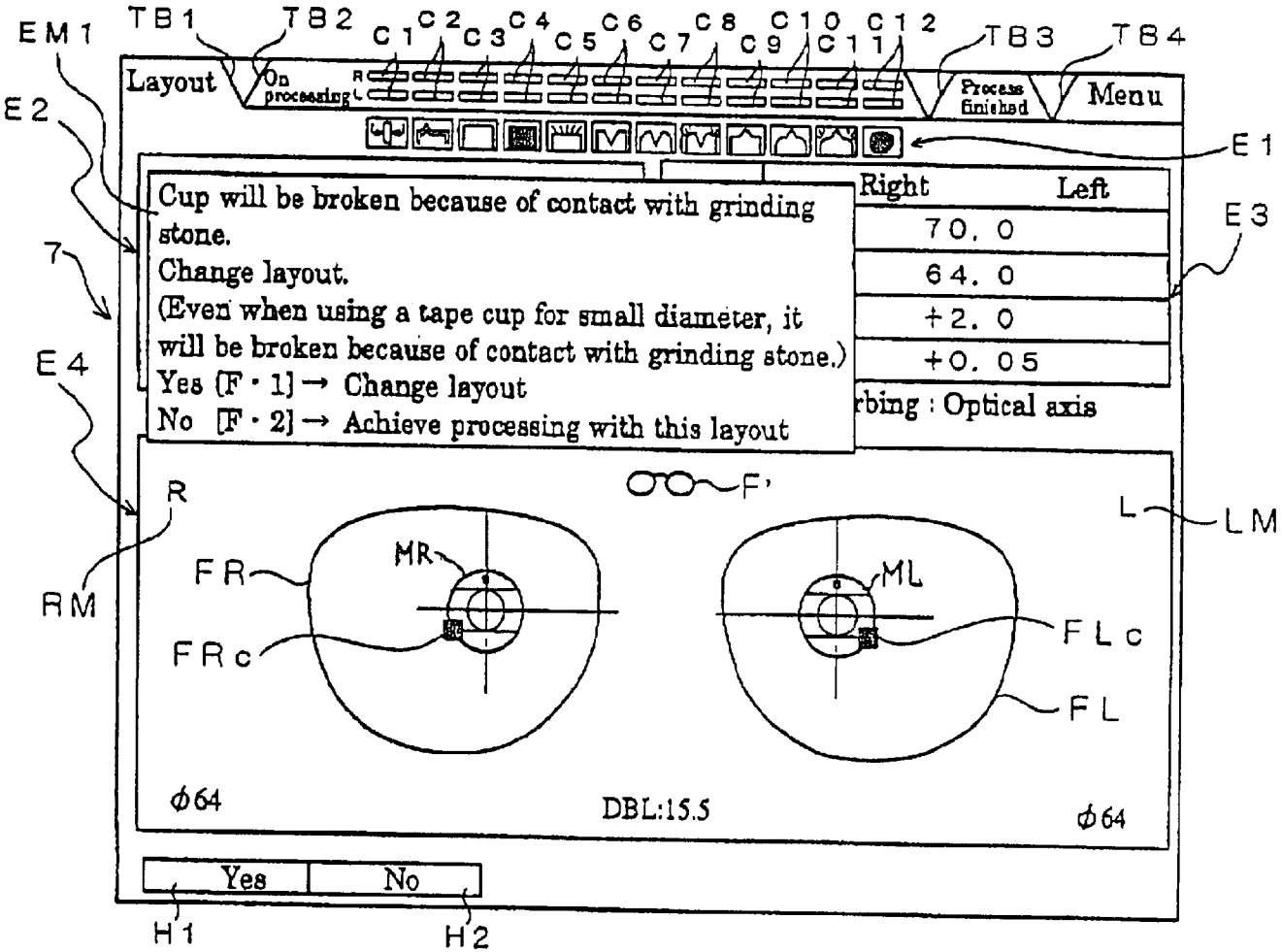
FIG. 54 is a front view of the liquid crystal display device with a display screen showing example 1 of an error status.

As the case of displaying errors during the setting of the layout, a probable case is that of displaying an error display window EM1 to prompt modifications in the layout setting as shown in FIG. 54. And at this moment, depending on the error particular, displays are made in the function display sections H1–H6 for giving instructions to avoid errors (or OK) by operating the function keys F1–F6. In the preferred embodiment of this invention, arrangements are made to have the function display section H1 display "Yes," and the function display section H2 indicate "No." These "Yes" and "No" correspond to the "Yes" and "No" shown in the error display window EM1.

<Under Machining>

Figure 55:
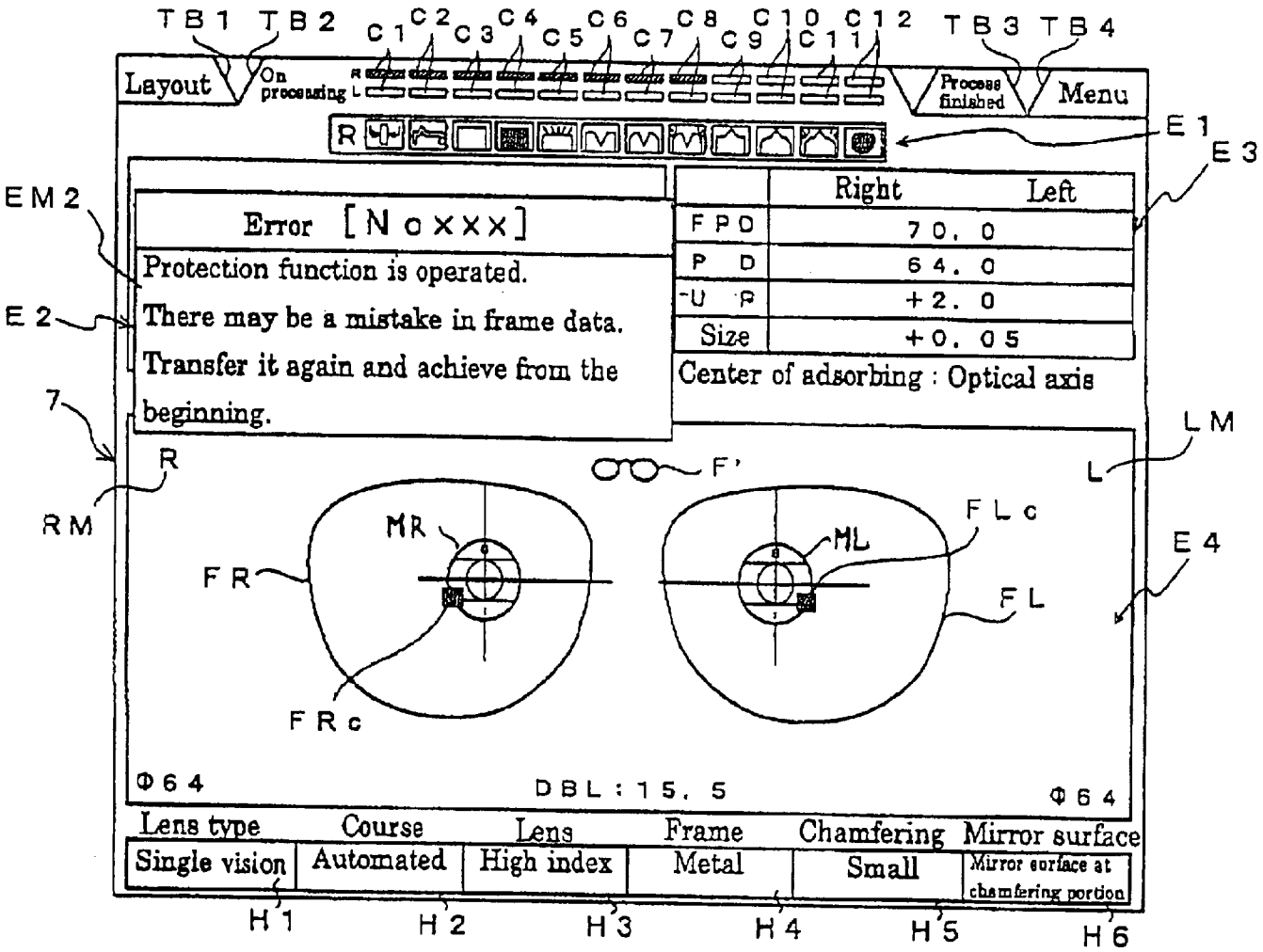
FIG. 55 is a front view of the liquid crystal display device with a display screen showing example 2 of the error status.

As the cases of displaying errors during the control on grinding of lens, there are following cases. When there is a risk of damaging lens to be machined or that of components of a lens grinding apparatus 2, an error display window EM2 showing the particulars of the error is displayed as shown in FIG. 55 before the lens to be machined or the lens grinding apparatus 2 is damaged due to the machining operation to inform the operator of the error that may cause damages and to protect the lens to be machined and the lens grinding apparatus 2.

Figure 56:
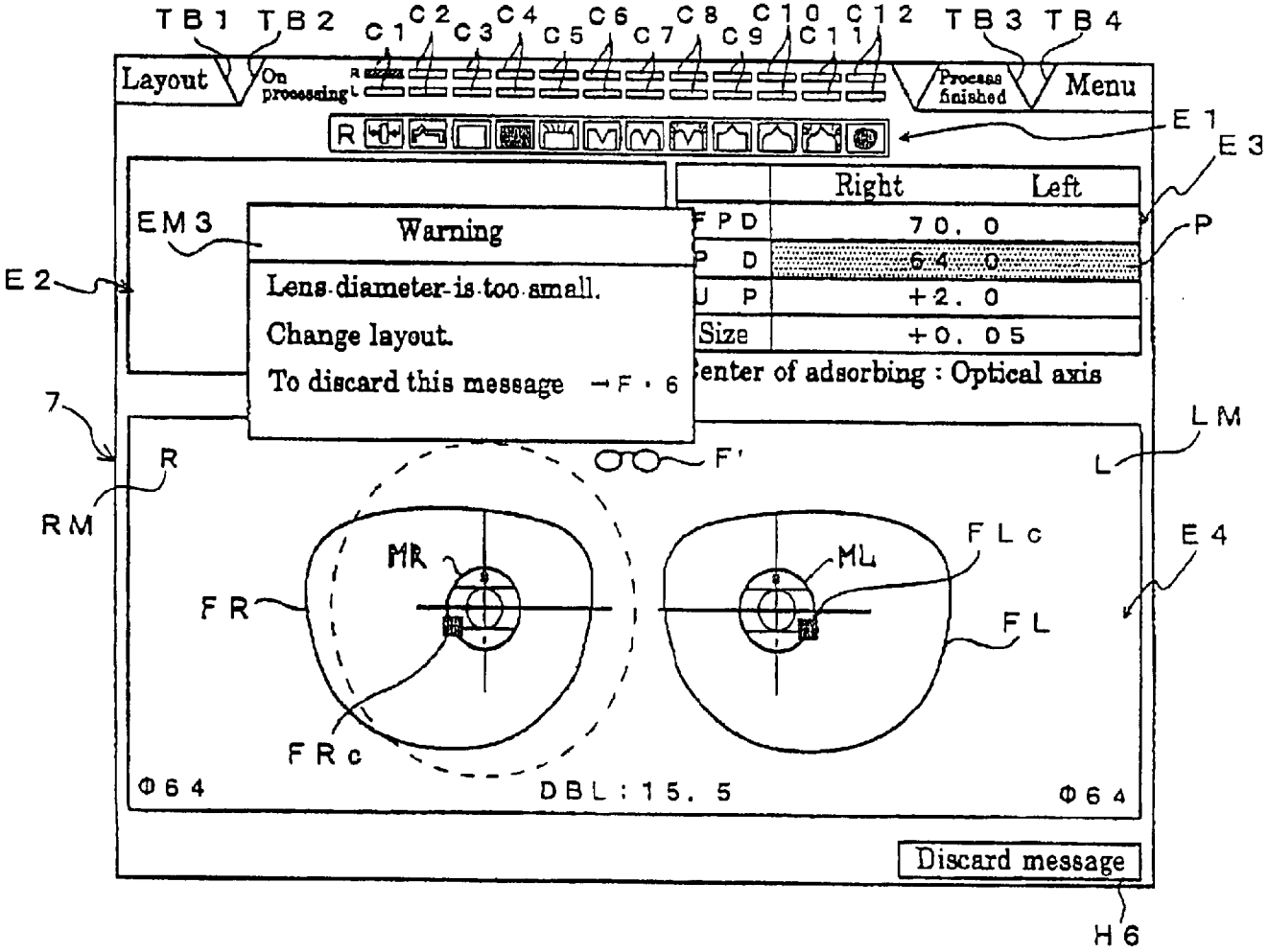
FIG. 56 is a front view of the liquid crystal display device with a display screen showing example 3 of the error status.

And in case where a state of being unable to machine due to a layout error develops (is detected) when machining is to be actually executed according to the layout set as shown in FIG. 56, an error indication window EM3 indicating the fact is displayed to inform the operator of the particulars of the error and to take steps to assure that the layout will be changed.

Figure 57:
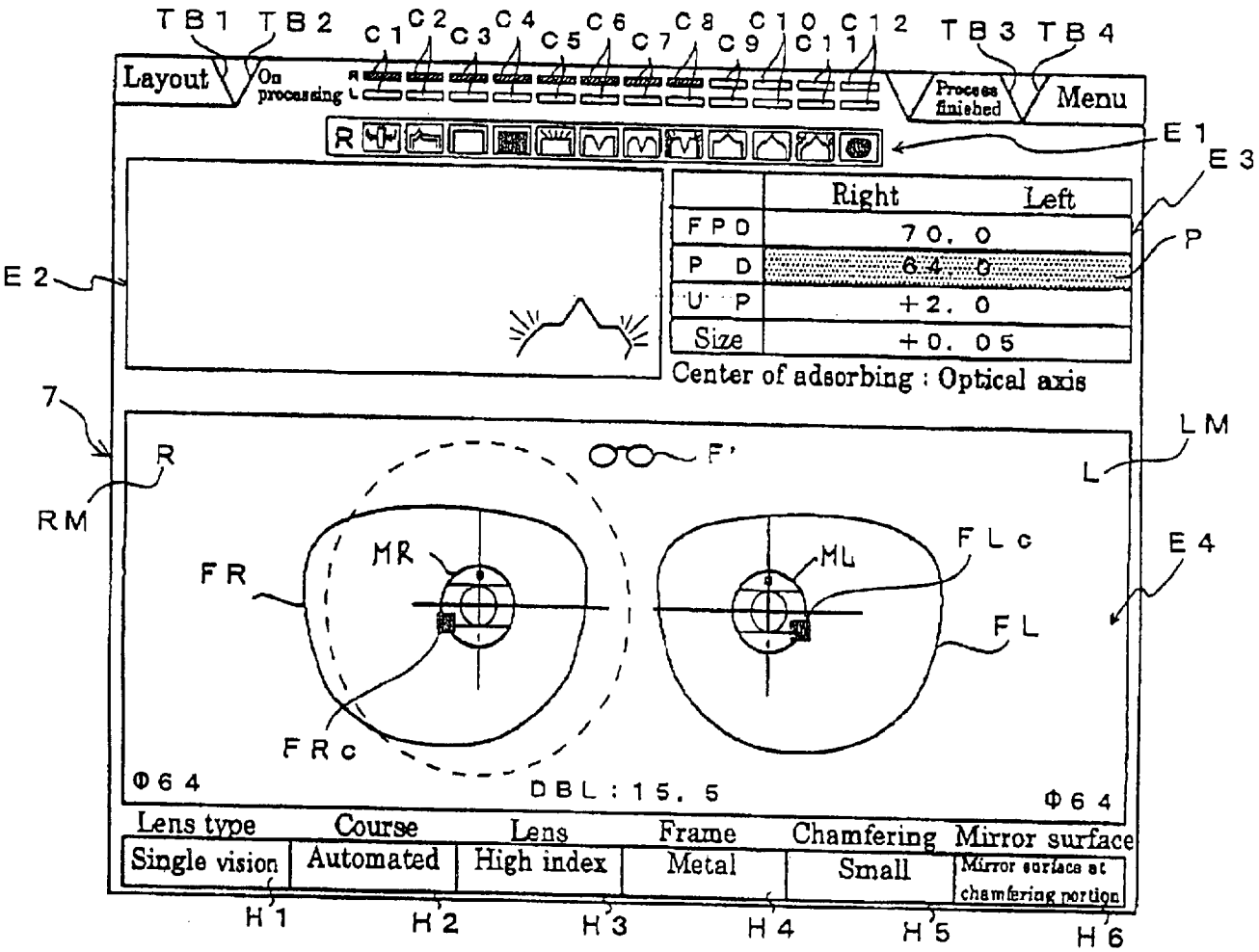
FIG. 57 is a front view of the liquid crystal display device with a display screen after the error status has been cleared.

And when an OK command is given by means of function keys (in this case the function key 1) based on the error shown in FIG. 56, as shown in FIG. 57, the error display alone shifts to the non-display state and at the same time a indicator-type pointer P is displayed.

[A Example of Displaying the Data Storage]

Figure 58:
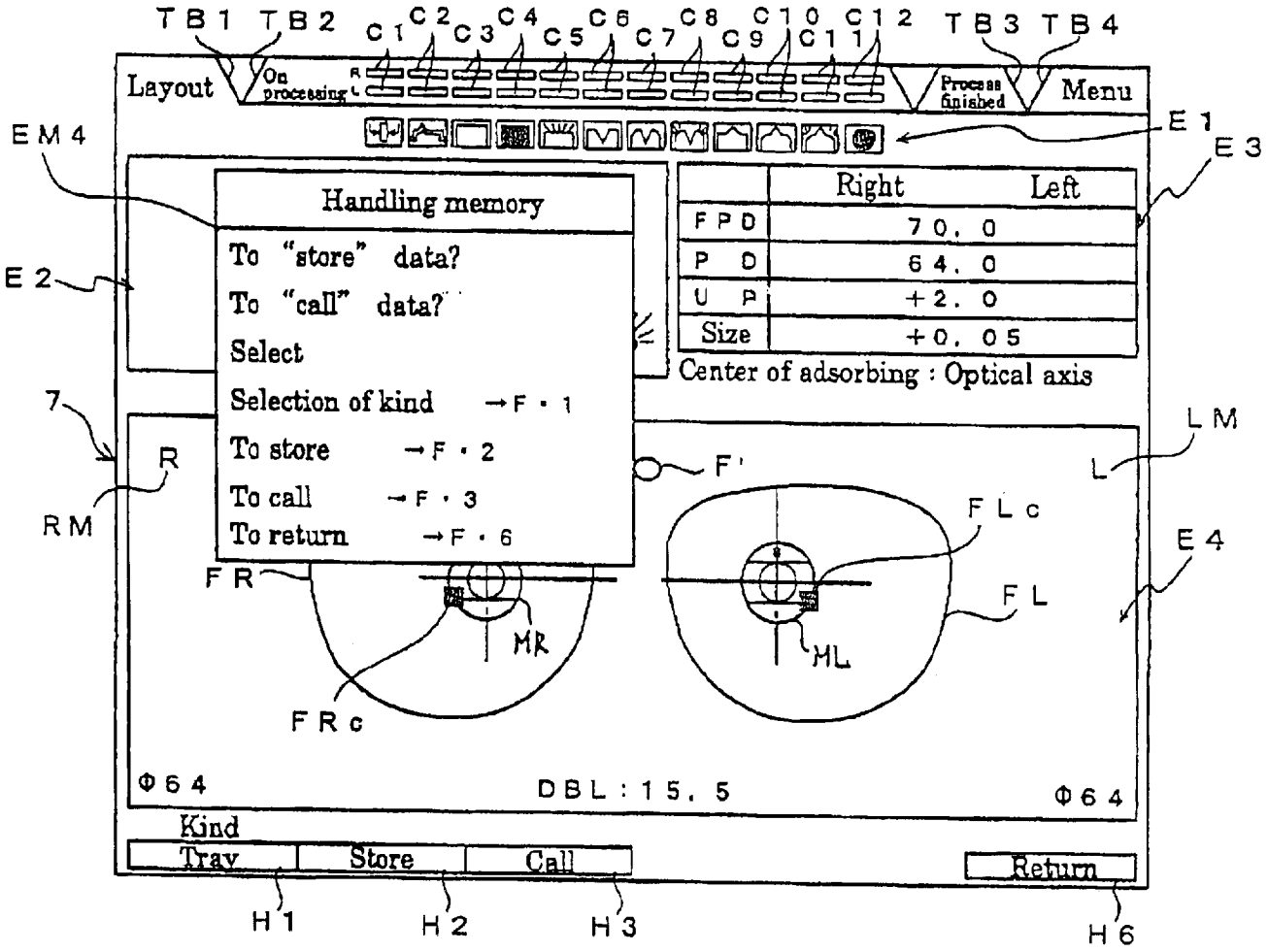
FIG. 58 is a front view of the liquid crystal display device with a display screen in an early stage of a data storing step.

When the machining of the lens of both eyes is completed, as shown in FIG. 58, the "Layout" tab TB1 is displayed again and the background color changes to shift to the state of the layout setting sheet.

In this state, a message display window EM4 is displayed as shown in FIG. 58 for confirming whether "FPD" and other numerical value data and "Lens type" and other processing mode data are stored or not. At this moment, the function display sections H1–H6 display particulars so that response operations based on the message shown in the message display window EM4 may be executed by means of the function keys F1–F6. In this preferred embodiment, the function keys F4 and F5 are not used as shown in FIG. 58, the function display sections H5 and H6 are not displayed. And in the function display section H1 the word "Tray" is displayed, in the function display section H2 the word "Storage" is displayed, in the function display section H3 the word "Call" is displayed, and in the function display section H6 the words "Return to the former state" is displayed.

Figure 59:
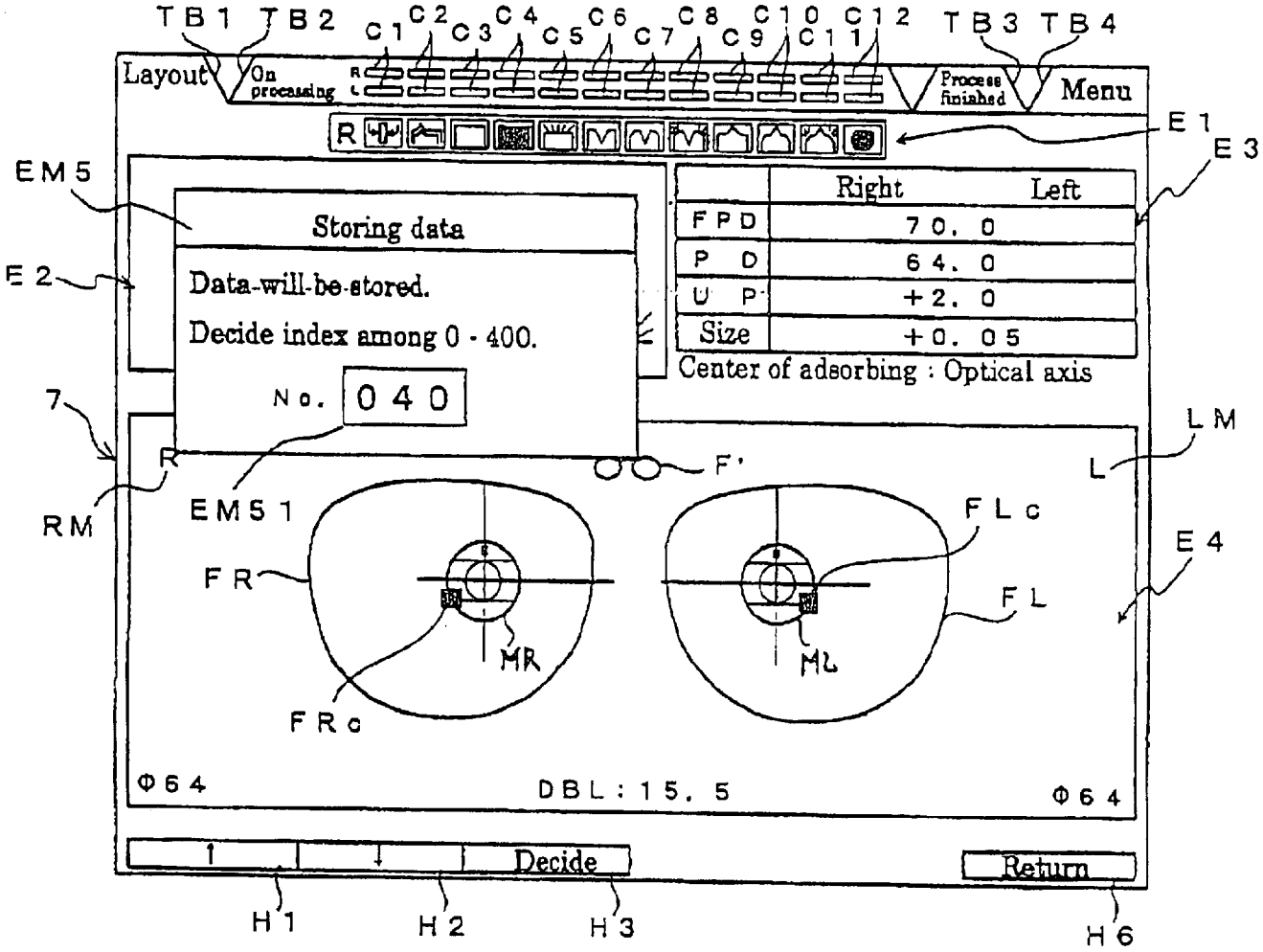
FIG. 59 is a front view of the liquid crystal display device with a display screen when an input of the data storing number is selected.

And when the word "Storage" is selected from this state (when the function key F2 is operated), as shown in FIG. 59, a display window EM5 for storing data is displayed, and an input window EM51 for inputting the storage number (address) for storing data is displayed within the display window EM5. And the guides ("↑" and "↓") for changing the storage number by means of the function keys F1 and F2 are displayed in the function display sections H1 and H2, while the guide ("determine") for instructing the determination of the storage number by means of the function key F3 is displayed in the function display section H3, to complete a series of lens machining routine.

In this way, even if for example "FPD" and other numerical value data and "Lens type" and other processing mode data are changed, the data are stored. It is also possible to review the history of data that have been changed so far, and to prevent the duplication of inputs and input errors in data processing.

[Examples of Applying Machining and the Examples of Displaying Icons and Indicators During the Process]

As for machining not set by the operator, icons A1–A12 and indicators (indicators) C1–C12 can be displayed as follows. For example, icons A1–A12 for machining not set can be displayed visually and symbolically, and indicators (indicators) C1–C12 corresponding to icons A1–A12 for machining not set may not be displayed.

In the meanwhile, the icon A1–A12 corresponding to the machining set may be displayed visually and symbolically and the indicators (indicators) C1–C12 corresponding to these icons A1–A12 for machining set may not be displayed. In this case, those icons corresponding to the machining not set from among the icons A1–A12 may be displayed normally or may be displayed with a fine line.

And in case changes or additions are made in the process of work, the display state may be modified depending on the situation resulting therefrom as shown in FIGS. 60–63. Incidentally, in FIGS. 60–63, in particular with regards to the drawing (B) and thereafter, codes are omitted for the sake of convenience (except those not provided on each drawing (A)).

<In the Case of Grooving and Chamfering>

When only grooving and chamfering works are performed and no other Edging machining and mirror machining works are executed in the process of grinding lens, the displays in the function display sections H1–H6 are selected as follows.

In the initial setting of F key described above, by setting the "Lens type" at "Single vision", the "Course" at "Auto", the "Lens" at "Plastic," the "Frame" at "Metal", the "Chamfering" at "Middle", and the "Specular surface" at "Specular surface chamber", in the function display sections H1–H6 of the screen of the liquid crystal display device 8 during the lens grinding control process shown in FIGS. 34–43, 48, 53 and 57 the following displays are made. In the function display section H1 corresponding to the display of "Lens type" "Single vision" is displayed, in the function display section H2 corresponding to the display of "Course" "Auto" is displayed, in the function display section H3 corresponding to the display of "Lens" "plastic" is displayed, in the function display section H4 corresponding to the display of "Frame" "Metal" is displayed, in the function display section H5 corresponding to the display of "Chamfering" "Middle" is displayed, and in the function display section H6 corresponding to the "Specular surface" "nil" is displayed.

In this way, by means of the function key F1 corresponding to "Lens type" "Single vision" is selected, by the function key F2 corresponding to "Course" "Auto" is selected, by the function key F3 corresponding to "Lens" "Plastic" is selected, by the function key F4 corresponding to "Frame" "Metal" is selected, by the function key F5 corresponding to "Chamfering" "Middle" is selected, and by the function key F6 corresponding to "Specular surface" "Nil" is selected. And when these selections are executed, setting will be completed only when the following machining begins.

In this state, the icons A1–A12 and the indicators C1–C12 will be displayed as shown in FIG. 27(B). The operator can confirm again the particulars of settings in this picture, and if any wrong setting is selected, he can avoid a wrong grinding operation by pressing a stop key 6*h* at the start of the machining work and thus avoid wasting glass lens.

Figure 60A:
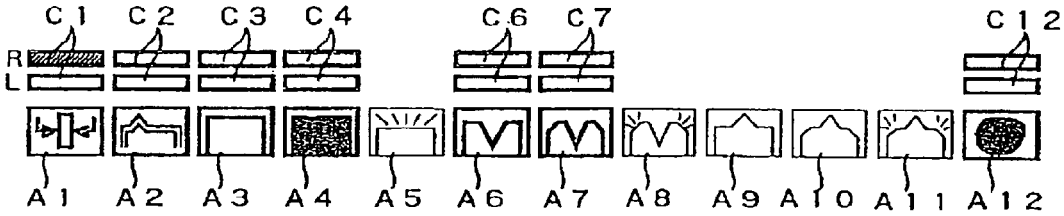
FIG. 60A to 60G shows icons and indicators used in a grooving process and a chamfering process.

When a machining work starts from this state, as shown in FIG. 60(A), the indicator C1 for the right eye (R) is lit showing that the work process on the glass lens for the right eye has progressed to the measurement of the flange thickness. And upon reception of a message that the measurement of the flange thickness has started, the indicator (indicator) corresponding to the icon for the measuring of the flange thickness are lit. In the similar way, indicators (indicators) of various work processes renews upon reception of starting messages.

Figure 60B:
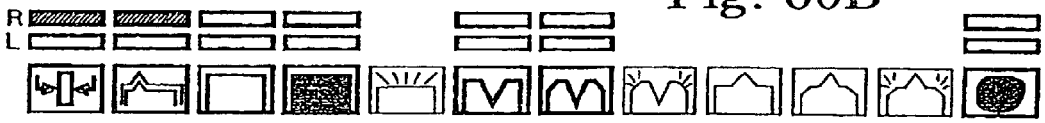
Figure 60C:
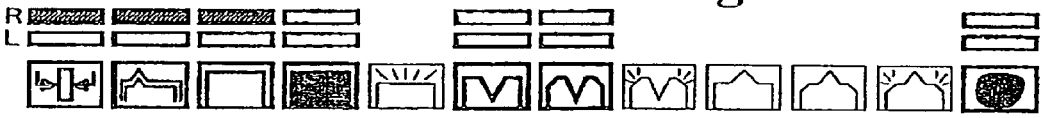
Figure 60D:
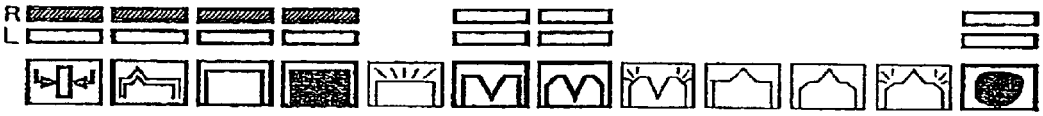
Figure 60E:
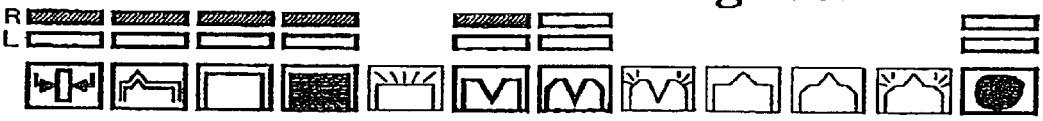
Figure 60F:
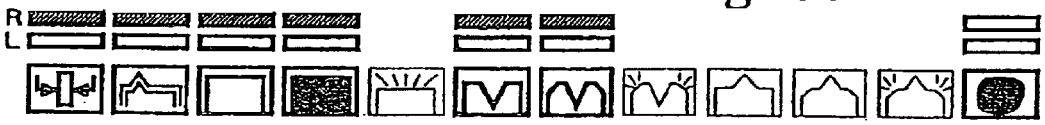
Figure 60G:
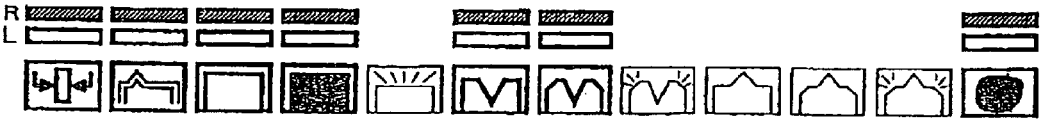

The indicators C2–C4, C6, C7 and C12 are successively lit and express visually and symbolically as shown in FIGS. 60(B)–60(G) showing instantaneously for each work step that the work process on the glass lens for the right eye has passed through the Edging simulation (FIG. 60(B)), roughing (FIG. 60(C)), Hirashiage (FIG. 60(D)), grooving (FIG. 60(E)), chamfering (FIG. 60(F)), and the completion of machining (FIG. 60(G)).

It should be noted in the meanwhile that among the icons A1–A12 those representing the type of machining that the operator want to execute are lit and those representing works not executed by the operator among the icons A1–A12 remain grey so that operators can avoid making any mistakes. And in case the screen is switched to that of "Layout" during the machining process, the indicators (indicators) C1–C12 do not advance and stays lit at the same position.

<In the Case of Trial Fitting>

Figure 61A:
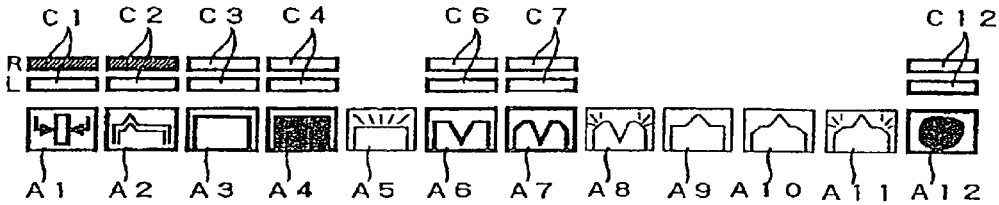
FIGS. 61A and 61B show examples of the icons and indicators displayed for a test grinding process.
Figure 61B:
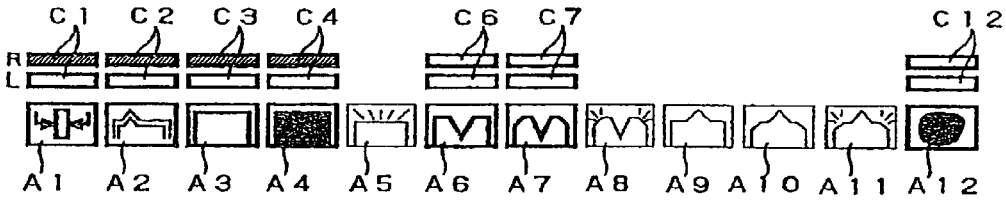

FIGS. 61(A)–61(B) show the cases of trial fitting. In case the monitor course is selected, after the whole process stopped at the level of the monitor screen (FIG. 61(A)), the application of a pressure on the "Refinishing/trial" switch 6*f* starts roughing and finishing work, and the process stops at the level of the monitor screen while the indicator C4 representing finishing work remains lit. Even the application of another pressure on the "Refinishing/trial" switch 6*f* does not change the state of indicator indication. And even after the machining work is restarted, the indicator indication remains unchanged, and upon receipt of a mirror grinding start message, the indicator indication is renewed. When the auto course is selected, however, the normal icon indication and the indicator indication described above are renewed.

<In Case of Machining and Additional Refinishing>

FIGS. 62(A)–62(F) show the case of grooving and chamfering a right eye-lens followed by a refinishing work by setting another mirror grinding work.

Figure 62A:
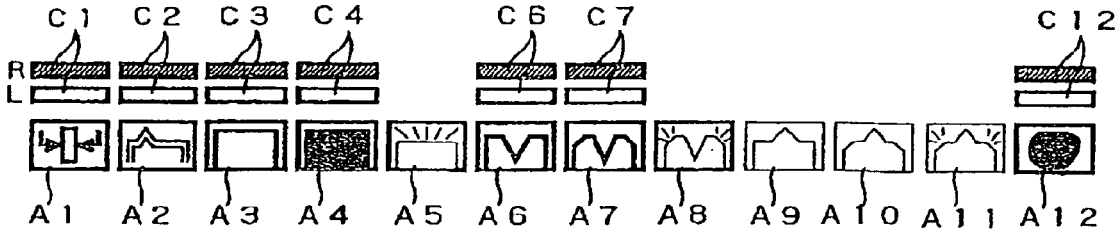
FIG. 62A to 62F show examples of the icons and indicators used in an additional grinding re-finishing process is selected.

When a right eye-lens is grooved and chamfered in the step mentioned in FIG. 60 and then a refinishing work is performed by setting another mirror grinding operation, a mirror grinding work is added while the grooving and chamfering operations shown in FIG. 62(A) is progressing and the "Refinishing/trial" switch 6*f* are pressed. A push on this switch 6*f* cancels the indication of the indicators C1–C3, C6 and C7 corresponding to the step of machining completed and brings about at the same time the indication of the indicators C4, C5 and C8 necessary for executing additional machining.

Figure 62B:
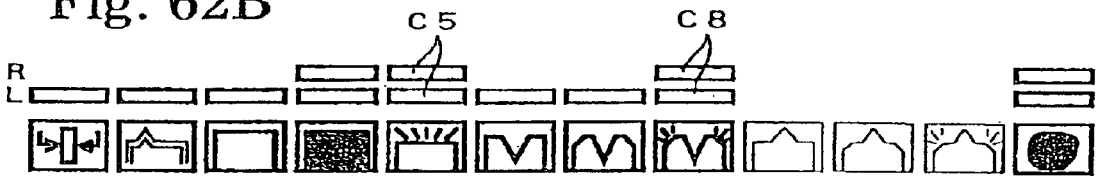

As shown in FIG. 62(A), however, the lit state of the icons A5 and A8 (color of indication or the thickness of the frame line) may be changed at the time of additional specification for confirming additional machining and then the indicator indications shown in FIG. 62(B) may be changed when a pressure is applied on the "Refinishing/trial" switch 6*f*. And also the icon indications and the indicator indications shown in FIG. 62(B) may be changed when a pressure is applied on the "Refinishing/trial" switch 6*f*.

Figure 62C:
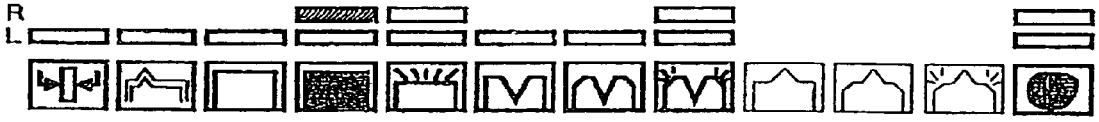
Figure 62D:
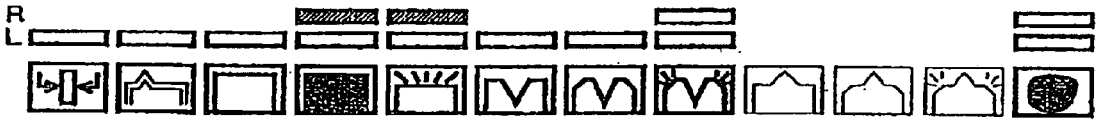
Figure 62E:
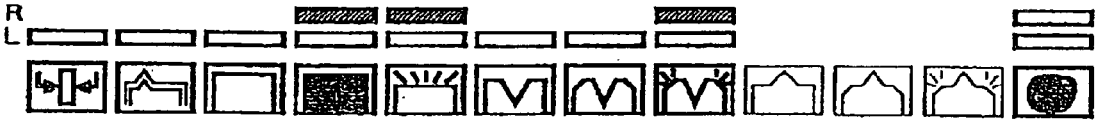
Figure 62F:
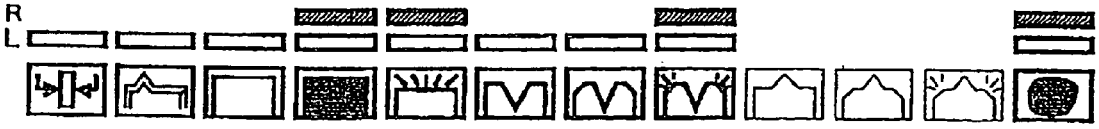

When the machining operation is started again from this state, as shown in FIGS. 62(C)–62(F), icons and indicators are successively lit to show instantaneously and express visually and symbolically the fact of passing through the steps of starting the finishing work (FIG. 62(C)), starting the mirror grinding (FIG. 62(D)), starting the chamfering of the specular surface (FIG. 62(E)), and ending the machining work (FIG. 62(F)).

<In Case of Shifting From the Grooving of the Flange to Edging>

FIGS. 63(A)–63(D) show the case of grinding the left eye-lens by shifting from grooving the flange to edging after the refinishing work of the right eye-lens shown in FIG. 62.

After finishing the refinishing work on the right eye-lens shown in FIG. 62 as described above (FIG. 63(A)), a shift from grooving on the edge to edging for the grinding of the left eye-lens corresponded to grooving, chamfering and mirror grinding on the right eye-lens. Therefore, the indicators C1–C8 and the indicator C12 corresponding to the entire machining are lit (FIG. 63(B)) and at the same time the indications of the indicators C1–C5 and C9–C12 on the left eye-lens side and the indications of icons for edging, chamfering and mirror grinding are switched (FIG. 63(C)).

Figure 63A:
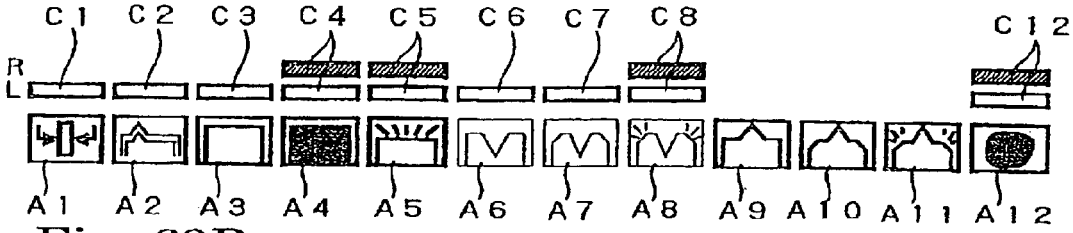
FIG. 63A to 63D show examples of icons and indicators when the process has been changed from a V-shaped protrusion grooving process to V-shaped protrusion grinding process.
Figure 63B:
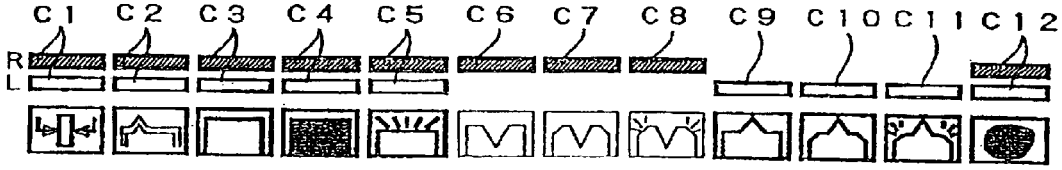
Figure 63C:
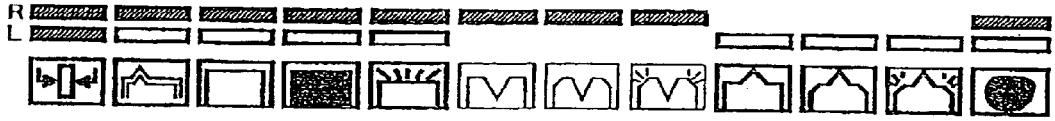
Figure 63D:
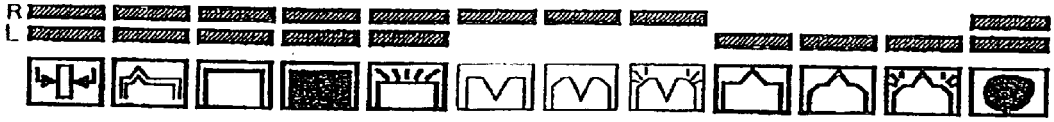

From this state the machining of the right eye-lens starts (FIG. 63(C)), and in the same way as described above the indicators and icons are successively lit to be remarkable instantaneously and to express visually and symbolically (FIG. 63(D)).

[Preferred Embodiment 2 of the Control Circuit]

Figure 65:
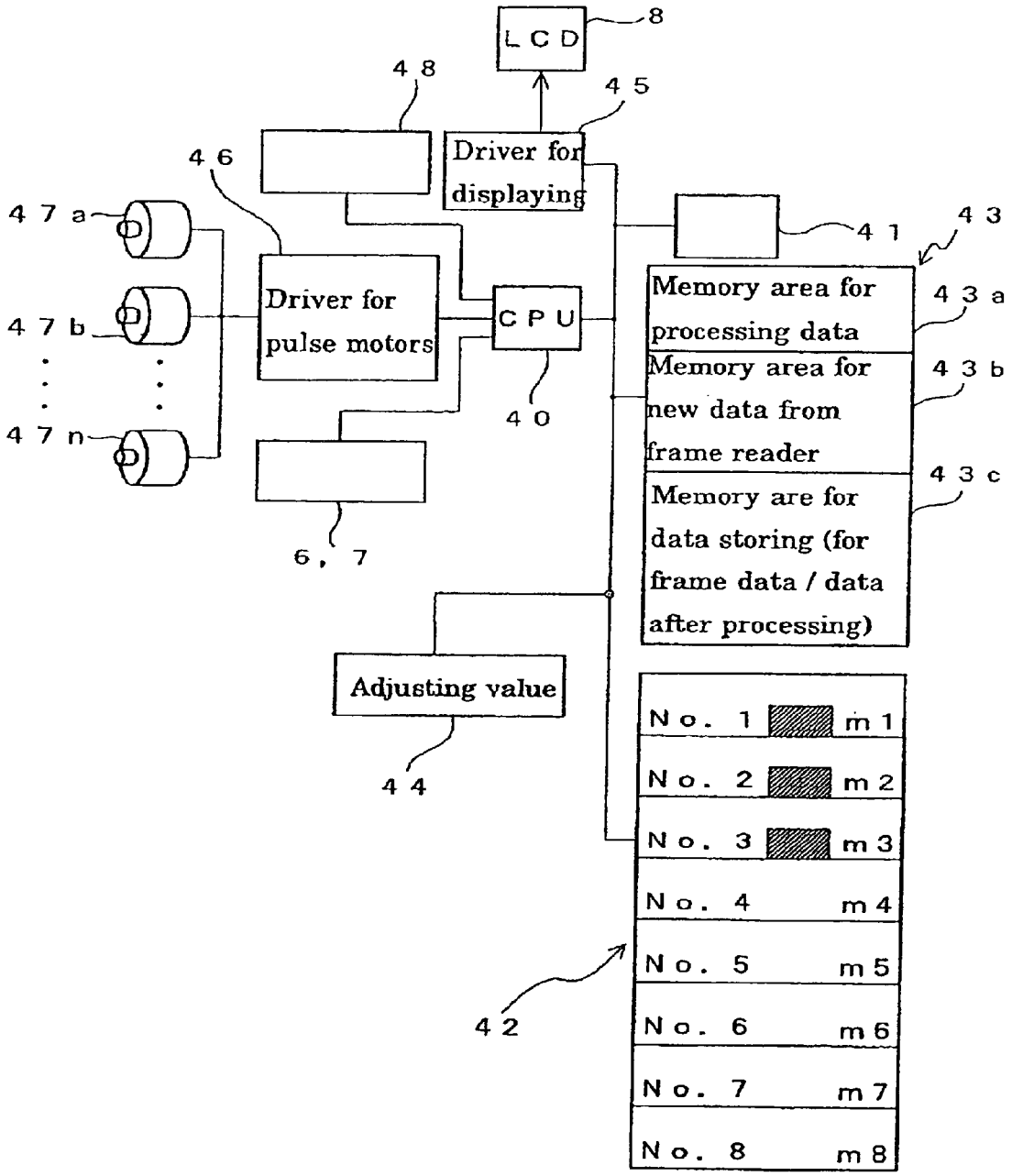
FIG. 65 is an explanatory view showing another example of the control circuit for the lens grinding apparatus.

FIG. 65 shows the other operation control circuit 40 of the lens grinding apparatus 2.

The operation control circuit 40 including a CPU is connected with an operating panel 6, ROM 41 for a memory means, a data memory 42 and a RAM 43 for memory means and a correction value memory 44. And the arithmetic control circuit 40 is connected with a liquid crystal display device 8 through a display driver 45, and with various driving motors (pulse motors) 47*a* . . . 47*n* of grinding means through a pulse motor drive 46. It is also connected with a frame shape measuring apparatus 1 shown in FIG. 1 through a communication port 48.

Figure 66:
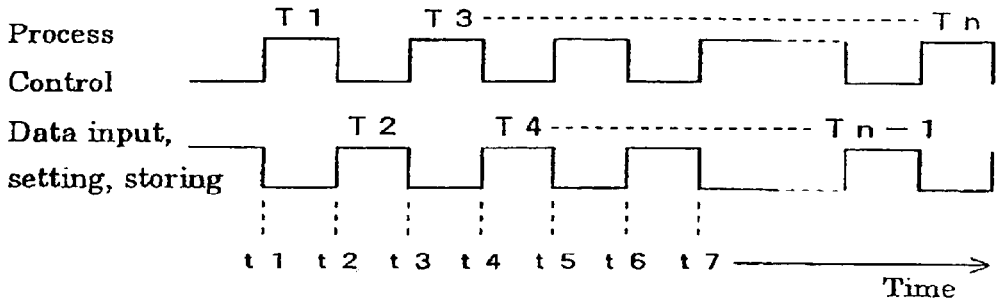
FIG. 66 is a time chart to explain one example of control operation of the control circuit for the lens grinding apparatus.

The arithmetic control unit 40 controls machining and controls the reading of data and the layout setting by time sharing as shown in FIG. 66 when data are read from the frame shape measuring apparatus 1 and data stored in the storage area m1–m8 of the data memory 42 are read after the start of machining control.

In other words, when the period between the time t1 and t2 is referred to as T1, the period between the time t2 and t3 as T2, the period between the time t3 and t4 as T3, . . . , and the period between the time tn−1 and tn as Tn, controls limited by the period T1, T3 . . . Tn are exercised, and controls on data reading and layout setting are performed during the period T2, T4. . . Tn−1. Therefore, while a lens is being ground, a plurality of subsequent round shape data are read and stored, data are read and layout are set (adjusted), etc. and thus the work efficiency of data processing can be drastically improved.

The ROM 41 stores various programs for controlling the operation of the lens grinding apparatus 2, and the data memory 42 contains a plurality of data storage areas. And the RAM 43 includes a machining data storage area 42*a* for storing machining data now used, a new data storage area 43*b* for storing new data, a data storage area 43*c* for storing frame data and machined data.

In the meanwhile, for the data memory 42, a flash electrically erasable and programmable memory may be used, and a RAM for which a backup power supply is used so that the contents may not be erased even if the main power supply fails.

And now the operation of a lens grinding apparatus provided with an arithmetic control circuit 40 of such a configuration.

When the main power supply is switched on from the starting waiting state, the arithmetic control circuit 40 determines whether there are any data read from the frame shape measuring apparatus 1.

In other words, the arithmetic control circuit 40 determines whether the "Data request" switch 7*c* of the operation panel 6 has been pushed. And when the "Data request" switch 7*c* is pushed and data are demanded, the lens shape information (θi, ρi) data are read from the frame shape measuring apparatus 1 into the data reading area 43*b* of the RAM 43. These read data are stored in any of the storage areas m1–m8 of the data memory 42 and the layout shown in FIG. 35 is displayed at the same time on a liquid crystal display device 8.

And when either the "Right" switch 6*c* or the "Left" switch 6*b* is pushed and a command for starting machining is given, the operation of driving motors 47*a*–47*n* is controlled through a pulse motor driver 46 to start the control of machining. At the same time the arithmetic control circuit 40 executes successively the measurement of the flange width, the setting of edging, roughing (including edging) and finishing work.

[Other Examples of Icons]

The preferred embodiment described above showed an example in which a plurality of indicators C1–C12 are provided for indication by being lit in accordance with the gradual progress of the lens grinding work from the step of measuring the width and shape of the flange to the end of grinding, and 12 icons A1–A12 are provided to correspond to these plural indicators C1–C12. But this invention is not limited to this configuration.

Figure 67:
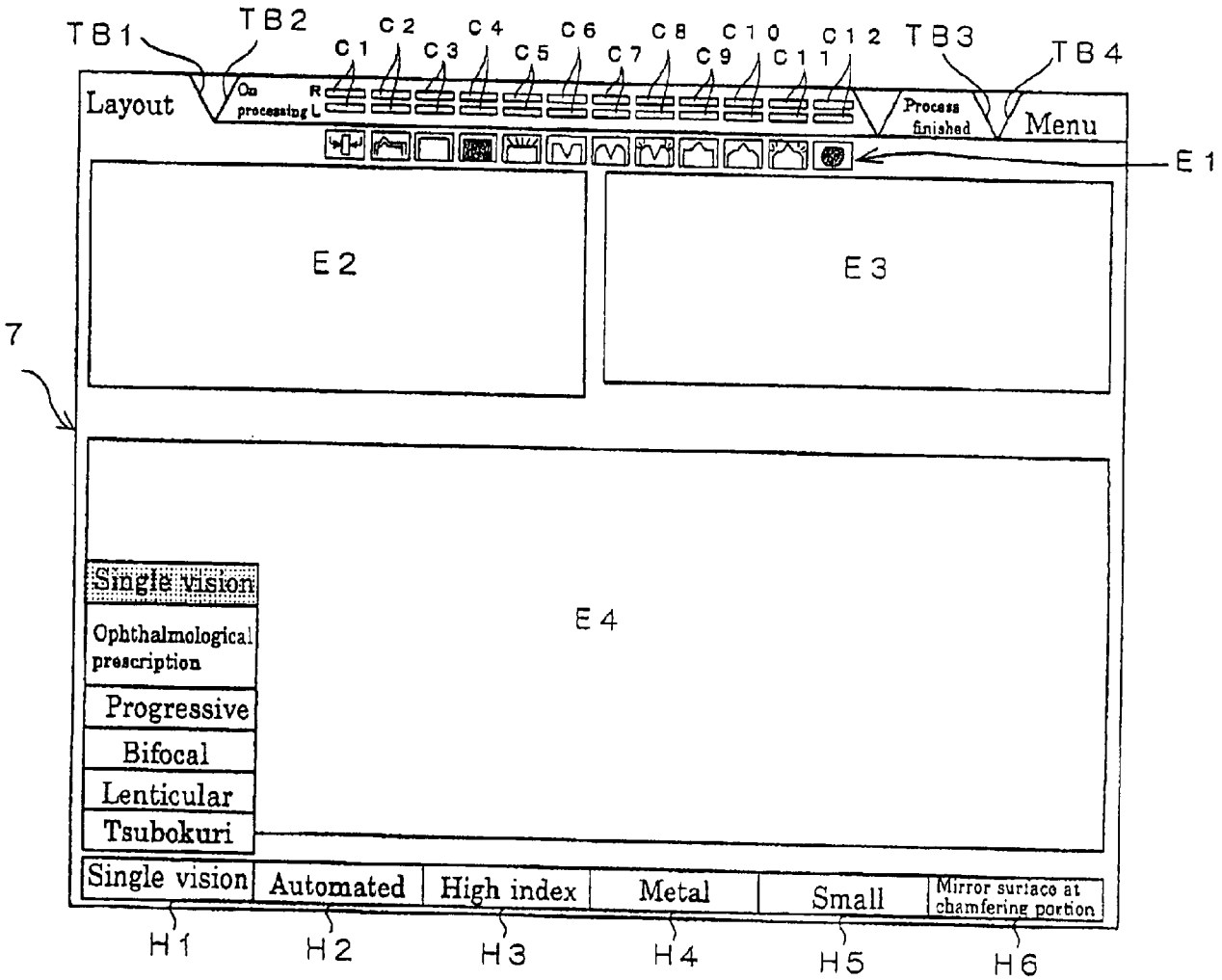
FIG. 67 is an explanatory view showing the display screen which includes another set of icons in accordance with the present invention.
Figures 68A, 68B, 68C:
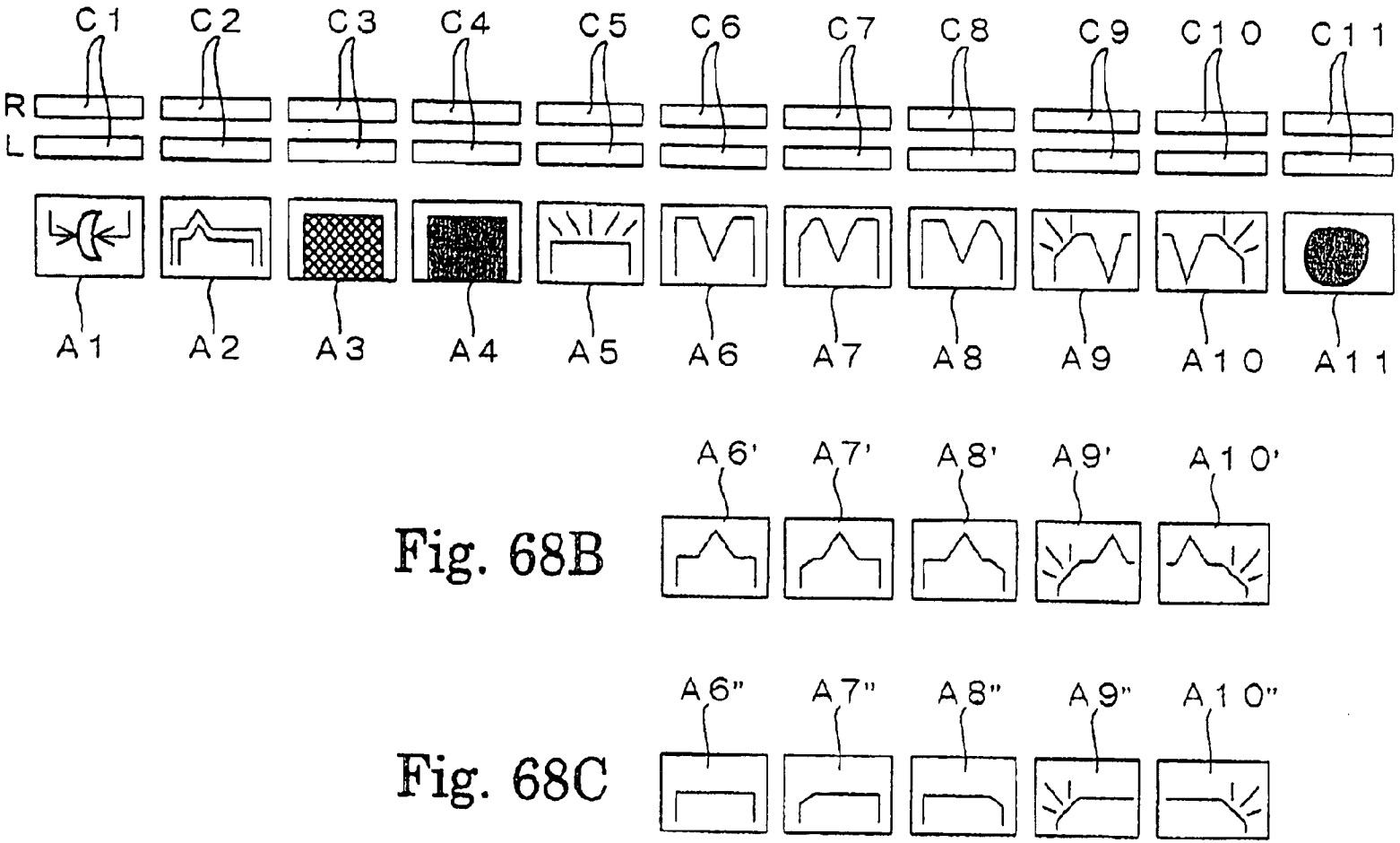
FIG. 68A is an enlarged explanatory view showing the relationship between the icons and indicators.
FIGS. 68B and 68C are the explanatory view showing another example of the icons and indicators.

For example, as shown in FIGS. 67 and 68(A), a plurality of indicators C1–C11 are provided for indication by being lit in accordance with the gradual progress of the lens grinding work from the step of measuring the width and shape of the flange to the step of grinding coming to an end, and 11 icons A1–A11 are provided to correspond to these plural indicators C1–C12.

The icon A1 here represents the state of measuring the flange width and shape of the frame of a pair of glasses based on lens shape information (θi, ρi) which is round shape data. The icon A2 represents the state of making a simulation of the edging shape formed on the flange of an eye-glass lens. The icon A3 represents the state of roughing the flange. The icon A4 represents the state of finishing work on the flange. The icon A5 represents the state of mirror grinding the flange. The icon A6 represents the state of grooving the flange. The icon A7 represents the state of chamfering the lens front surface side of the flange. The icon A8 represents the state of chamfering the lens rear surface side of the flange. The icon A9 represents the state of mirror grinding the chamfered portion of the lens front surface side of the flange. The icon A10 represents the state of mirror grinding the chamfered portion of the lens rear surface side of the flange. The icon A11 represents the end of grinding an eye-glass lens.

In addition, the icons A3–A10 represent a group of icons representing the state of machining flanges, and any suitable ones may be used depending on the functions of the apparatus (for example, an apparatus without means of mirror grinding). And the designs of the icons A1–A11 are not specially limited provided that they enable operators to easily identify the type of machining and other particulars of work. For example, icons A6'–A10' or icons A6"–A10", etc. which enable to easily identify similar contents with different designs as shown in FIG. 68(B) or 68(C) on anything corresponding to the icons A6–A10 can be used. Similarly, the work contents may be represented by letters and they may be represented by the icons A1–A11 respectively accompanied by letters describing the contents of work.

[Supplementary Explanation on this Invention]

The apparatus according to this invention includes an operating panel (a function setting means) 7 for setting various values necessary to process the round shape data of the frame of a pair of glasses and the eye-glass machining data for grinding eye-glass lens based on these round shape data, and a control circuit (a controlling means) 30 for adding, deleting or rearranging the values set by said operating panel (function setting means) 7.

And the conctrol circuit (controlling means) 30 according to this invention can control in such a way that the matters for setting may be set after the passage of a given time from the moment when the indicators PE2–PE3, etc. are brought into the items displayed on the screen of the liquid crystal display device 8 in response to the matters set by the operating panel (function setting means) 7.

Moreover, the function setting means according to this invention may be configured to include a "▽" switch (eye-glass lens selecting means) 7*e* for selecting the type of eye-glass lens, and a display area (input form displaying means) E62, E63, and E64 for inputting eye-glass lens machining information corresponding to the selected eye-glass lens.

And the function setting means according to this invention can include a "▽" switch (an eye-glass selecting means) 7*e* for selecting the type of eye-glass lens, a display area (input form displaying means) E62, E63 and E64 for inputting eye-glass machining information corresponding to the selected eye-glass lens, and a seesaw-type "−+" switch (edging data inputting means) 7*d* for edging in the edging shape depending on the selected eye-glass lens.

And the liquid crystal display device (displaying means) 8 according to this invention can be so configured as to display a tab TB1 displaying a layout work image plane for setting the layout of round shape data and a tab TB2 for displaying a machining work image plane including the state of measuring the flange width of eye-glass lens, the simulation of edging shape formed on the flange edge, and the state of grinding eye-glass lens, etc.

And said displaying means according to this invention may be so configured as to display the measurement loci when the flange width and shape of an eye-glass lens are measured on the basis of round shape data or the machining loci when an eye-glass lens is ground.

And said liquid crystal display device (displaying means) 8 may be so configured as to display an icon A1 for displaying the state of measuring the flange width and shape of an eye-glass lens based on the round shape data, an icon A2 for displaying the state of simulating the edging shape formed on the flange edge of eye-glass lens, an icon A9 displaying the state of machining the flange edge and an icon A12 indicating the end of grinding of the eye-glass lens.

In this configuration, said icon representing the state of machining the flange edge may consist of a combination of any of the icon A3 representing the state of roughing the flange edge, the icon A4 representing the state of finishing the flange edge, the icon A5 representing mirror grinding the flange edge, the icon A6 representing the state of grooving the flange edge and the icon A8 representing the state of chamfering the flange edge.

In addition, said displaying means according to this invention includes a level indicating means for indicating the level depending on the progression of lens grinding work from the step of measuring the flange width and shape until the end of the grinding work on the eye-glass lens based on the round shape data.

In this configuration, said level indicating means may be a plurality of indicators C1–C12 that indicate by being lit the step-by-step progression of lens grinding work from the step of measuring the flange width and shape to the end of the grinding work.

And said displaying means according to this invention can be so configured as to include the icon A1 for representing the state of measuring the flange width and shape of the eye-glass lens based on the round shape data, the icon A2 representing the state of simulating the edging shape formed on the flange edge of the eye-glass lens, the icons (A3–A11) representing the state of machining the flange edge, and the icon A12 representing the end of the grinding work on the eye-glass lens as well as a plurality of indicators that indicate by being lit the progression of a series of grinding work of lens.

In this configuration, said icons (A3–A11) representing the state of machining the flange edge of an eye-glass lens may include a combination of any ones of the icon A3 representing the state of roughing the flange edge, the icon A4 representing the state of finishing work on the flange edge, the icon A5 representing the mirror grinding of the flange edge, the icon A6 representing the state of grooving the flange edge, and the icon A7 representing the state of chamfering the flange edge. In addition, said indicators may be disposed facing one to one each of said icons.

This invention configured as described above can improve the convenience in setting data and thus improve the work efficiency of machining eye-glass lens and also enables to freely process data.

In more concrete terms, this invention can improve the convenience in inputting data by providing the following functions:

(i) The file form of round shape data of frames of a pair of glasses and eye-glass machining data necessary for machining eye-glass lens is modified into an easily recognizable and more convenient form for operators.

(ii) The loci of measuring the flange width and shape of eye-glass lens and that of grinding lens are displayed to enable the monitoring of the current state of work.

(iii) Icons highly identifiable with the particulars of work are displayed.

(iv) The progression of lens grinding work can be recognized.

(v) When data related with the machining of eye-glass lens are inputted or set, the items for setting can be added, deleted or rearranged.

(vi) By moving a indicator to the items that the operator wants to set, the particulars contained in the items are automatically set after the elapse of a given time.

(vii) The form of inputting data corresponding to the type of eye-glass lens such as single view lens, progressive multifocal lens, etc. is previously indicated, and in addition adequate position of edging triangle and other edging data suitable for each eye-glass lens can be inputted.

What is claimed is:

1. A lens layout setting apparanas for a lens grinding processing apparatus comprising:

function setting means for performing various settings required for processing eyeglass lens shape data for an eyeglass frame, and data used for grinding an eyeglass lens based on the eyeglass lens shape data, and setting one or more of setting items; and control means for controlling said function setting means, wherein said control means controls setting of said function setting means so that addition or deletion of said setting item of said function setting means, or re-arrangement of an order of said setting item, is carried out.

2. The lens layout setting apparatus for the lens grinding processing apparatus according to claim 1, wherein said function setting means includes a screen for displaying the various settings; and wherein said control means controls setting of said function setting means so that said setting item of said function setting means is set when a predetermined time has passed after a cursor is matched with an item displayed on said screen corresponding to said setting item and the item is specified.

3. A lens layout display apparatus for a lens grinding processing apparatus comprising:

display means on which eyeglass lens shape data for an eyeglass frame and data of eyeglass lens grinding process required for grinding an eyeglass lens based on the eyeglass lens shape data are displayed; and control means for controlling said display means, wherein said control means controls displaying of said display means so that at least either or both of a tab arranged to display a layout operating screen for setting a layout of the eyeglass lens shape data, and a tab arranged to display a state of measuring an edge thickness of the eyeglass lens, a simulation of a shape of a V-shaped protrusion formed on an edge of the eyeglass lens, and a grinding process screen such as a state of processing of the eyeglass lens, is displayed on the displaying means.

4. A layout display apparatus for a lens grinding processing apparatus comprising:

display means on which eyeglass lens shape data for an eyeglass frame, and data of eyeglass lens grinding process required to grind an eyeglass lens based on the eyeglass lens shape data are displayed; and control means for controlling said display means, wherein said control means controls level display means which displays a level corresponding to a state of a progress of grinding processing of the eyeglass lens composed from a step measuring an edge thickness of the eyeglass lens based on the eyeglass lens shape data to a step on which a grinding process of the eyeglass lens has been completed, and controls displaying of said display means so that said level display means is displayed on said display means.

5. A lens layout display apparatus for a lens grinding processing apparatus comprising:

display means on which eyeglass lens shape data for an eyeglass frame, and data of eyeglass lens grinding process required to grind an eyeglass lens based on the eyeglass lens shape data are displayed; and control means for controlling said display means, wherein said control means controls level display means which displays a level corresponding to a state of a progress of grinding processing of the eyeglass lens composed from a step measuring an edge thickness of the eyeglass lens based on the eyeglass lens shape data to a step on which a grinding process of the eyeglass lens has been completed, and controls displaying of said display means so that said level display means is displayed on said display means, and, wherein said level display means is a plurality of indicators which is lit and displays corresponding to a state of the progress of the grinding processing of the eyeglass lens composed from the step measuring the edge thickness of the eyeglass lens to the step on which the grinding process of the eyeglass lens has been completed.

6. The lens layout setting apparatus for the lens grinding processing apparatus according to claim 1, wherein said control means controls the setting of said function setting means so that the re-arrangement of the order of said setting item is carried out according to a using frequency of said setting item.

7. The lens layout setting apparatus for the lens grinding processing apparatus according to claim 6, wherein said control means displays said setting item of said function setting means on display means.

8. The lens layout setting apparatus for the lens grinding processing apparatus according to claim 1, wherein said function setting means performs said various settings and the setting of said setting item on display means, and said control means displays displaying of the addition or the deletion of said setting item, or the re-arrangement of the order of said setting item.

* * * * *